US008926895B2

(12) United States Patent
Strelbisky et al.

(10) Patent No.: US 8,926,895 B2
(45) Date of Patent: Jan. 6, 2015

(54) POST-COMBUSTION LANCE INCLUDING AN INTERNAL SUPPORT ASSEMBLY

(75) Inventors: Michael J. Strelbisky, Burlington (CA); Kerry J. Legeard, Caledonia (CA); Goran Dimitrijevik, Oakville (CA)

(73) Assignee: A.H. Tallman Bronze Company, Limited, Burlington, Ontario (CA)

( * ) Notice: Subject to any disclaimer, the term of this patent is extended or adjusted under 35 U.S.C. 154(b) by 285 days.

(21) Appl. No.: 13/461,300

(22) Filed: May 1, 2012

(65) Prior Publication Data

US 2012/0211929 A1 Aug. 23, 2012

Related U.S. Application Data

(63) Continuation-in-part of application No. 12/359,825, filed on Jan. 26, 2009, now Pat. No. 8,216,507.

(60) Provisional application No. 61/023,275, filed on Jan. 24, 2008.

(51) Int. Cl.

| | |
|---|---|
| ***C21C 5/30*** | (2006.01) |
| ***C21C 5/46*** | (2006.01) |
| ***F27D 3/16*** | (2006.01) |
| ***F27D 17/00*** | (2006.01) |
| *C21B 7/16* | (2006.01) |
| *C21B 13/00* | (2006.01) |

(52) U.S. Cl.

CPC . *C21C 5/30* (2013.01); *C21C 5/462* (2013.01); *F27D 3/16* (2013.01); *F27D 17/008* (2013.01); *C21C 5/305* (2013.01); *C21C 5/4606* (2013.01); *F23C 2900/07021* (2013.01)

USPC ..... 266/265; 266/44; 266/225; 266/226

(58) Field of Classification Search

CPC ... C21C 5/4606; C21C 5/4693; F27D 25/008; F27D 3/16; F27D 2003/169; F27D 2003/164

USPC ..... 266/44, 225–226

See application file for complete search history.

(56) References Cited

U.S. PATENT DOCUMENTS

| | | | | |
|---|---|---|---|---|
| 4,047,936 | A | 9/1977 | Chang | |
| 4,083,543 | A | 4/1978 | Berry et al. | |
| 4,106,756 | A | 8/1978 | Rymarchyk et al. | |
| 4,365,992 | A | 12/1982 | Sieckman | |
| 4,732,370 | A | 3/1988 | Berry et al. | |
| 5,308,043 | A | 5/1994 | Floyd et al. | |
| 5,377,960 | A | 1/1995 | Leczo et al. | |
| 5,788,921 | A | 8/1998 | Gitman et al. | |
| 5,865,876 | A * | 2/1999 | Watkins et al. | 75/548 |

(Continued)

*Primary Examiner* — Kaj K Olsen
*Assistant Examiner* — Alexander Polyansky

(57) ABSTRACT

A post-combustion lance for directing a gas at least partially therethrough. The post-combustion lance includes a body extending between an upstream end and a downstream end of the lance, the body including upper and lower portions and a post-combustion distributor mounted therebetween. The lance also includes an internal support assembly for supporting the body, the internal support assembly including an internal tube positioned inside the body and at least partially engaged with the lower portion, and at least partially engaged with the upper portion of the body, so that the internal support assembly supports the body both upstream and downstream relative to the distributor. The lance also includes a lower o-ring gland positioned downstream relative to the internal support assembly and an upper o-ring gland positioned upstream relative to the lower o-ring gland.

1 Claim, 39 Drawing Sheets

(56) References Cited

U.S. PATENT DOCUMENTS

| | | | |
|---|---|---|---|
| 6,322,610 | B1 | 11/2001 | Pavlicevic et al. |
| 6,558,614 | B1 | 5/2003 | Fritz |
| 6,773,659 | B2 | 8/2004 | Dunne et al. |
| 2004/0201142 | A1 | 10/2004 | Rumen |
| 2008/0128963 | A1 | 6/2008 | Cingle et al. |

* cited by examiner

POST-COMBUSTION LANCE INCLUDING AN INTERNAL SUPPORT ASSEMBLY

This application is a continuation-in-part of U.S. patent application Ser. No. 12/359,825, filed on Jan. 26, 2009, which claims the benefit of U.S. Provisional Application No. 61/023,275, filed on Jan. 24, 2008, each of which is hereby incorporated by reference in its entirety.

FIELD OF THE INVENTION

This invention is related to a post-combustion lance with a body including an internal support assembly for supporting the body.

BACKGROUND OF THE INVENTION

Metallurgical processes such as basic oxygen steelmaking often employ large water-cooled oxygen lances (typically, about 8 inches to about 16 inches in diameter and approximately 65-85 feet long) to efficiently remove oxidizable elements from molten metal in a metallurgical converter. These lances, which typically weigh up to approximately 10 tons, are known as post-combustion lances. Typically, in addition to the primary oxygen ports at the tip of the lance, the prior art post-combustion lance includes a ring of small oxygen ports located on the outside of the lance a distance up the lance from the primary oxygen tip. The ring is known as a post-combustion (or "PC") distributor.

Due to heat transfer requirements, and also to protect the PC distributor from the furnace atmosphere and the localized heat generated from the post-combustion reaction, the PC distributor (and often, the piping associated therewith) is made of high thermal conductivity metals such as high purity copper.

Although the post-combustion lance often is used to direct oxygen into a metallurgical converter, various other gases may be directed through the lance, depending on the reactions desired. Any and all reaction gases directed through the lance are generally referred to hereinafter as a "gas" for convenience, it being understood that the gas may be oxygen or any other reaction gas, or any mixture of any such gases. Typically, the gas is injected through the lance at very high rates. For example, oxygen may be injected into the lance at rates of between 300 cubic meters/min. and 600 cubic meters/min.

Cross-sections of a typical post-combustion lance 10 of the prior art are provided in FIGS. 1A and 1B.

The lance 10 extends between an upstream end 12, at which the gas is introduced therein, and a downstream end 14, at which a primary tip 16 is positioned. The introduction of the gas at the upstream end is represented by arrow "A" in FIG. 1A. A PC distributor 18 is positioned at a predetermined distance (designated "L" in FIG. 1A) from the end of the tip 16. The typical lance includes a lance body 20 having an upper portion 22 and a lower portion 24, being the outermost tube elements. The upper portion 22 typically has slightly larger inner and outer diameters than those of the lower portion 24 respectively. The body 20 includes the PC distributor 18, which is mounted between the upper and lower portions 22, 24, as shown in FIG. 1B. Typically, the upper and lower portions 22, 24 are substantially round in cross-section, i.e., they are generally cylindrical.

As shown in FIGS. 1A and 1B, the prior art post-combustion lance 10 typically (but not necessarily) also includes an upper inner tube 26 with an upstream first portion 28, a larger second portion 30, and a connecting portion 32 connecting the first and second portions 28, 30. Also, a lower inner tube 34 is positioned inside the body 20, downstream from the upper inner tube 26. Typically, the upper and lower inner tubes 26, 34 are positioned coaxial with each other and with the body 20. The upper and lower inner tubes 26, 34 are shaped to direct part of the gas to the PC distributor 18, and also to direct a part of the gas toward the lower inner tube 34, from which such part exits the lance at the tip 16. For example, the first part of the gas typically may be about ten percent of the gas flowing through the lance, with the second part being the balance. The part of the gas exiting the PC distributor is represented by arrows "B" in FIG. 1A, and the part of the gas exiting the tip 16 is represented by arrow "C" in FIG. 1A.

As is well known in the art, the upper and lower portions 22, 24 typically include cavities 25 through which water (not shown) is circulated while the post-combustion lance 10 is in use, to cool the lance body 20. Typically, the water is introduced at the upstream end 12 into an intake cavity which extends to the downstream end 14 and the primary tip 16, and the water returns to the upstream end 14 via an output cavity. The cavity 25 is at least partially defined by an upper intermediate element 29 in the upper portion 22 (FIG. 1B). In the lower portion 24, the cavity 25 is at least partially defined by a lower intermediate element 31.

As is also well known in the art, both the upper inner tube 26 and the lower inner tube 34 are secured to the body. The upper and lower portions 22, 24 are substantially cylindrical, and positioned substantially coaxial with each other. For instance, the axes defined by the upper and lower portions 22, 24 are identified by reference numeral 27 in FIG. 1B. In addition, the upper inner tube 26 typically is positioned substantially coaxial with the upper and lower portions 22, 24. Also, in the prior art lances in which the lower inner tube 34 is included, the lower inner tube 34 (which typically is substantially cylindrical) typically is positioned substantially coaxial with the upper and lower portions 22, 24 and with the upper inner tube 26. It will be understood that various prior art lances are known.

The lance is subjected to bending stresses during its service life, particularly during loading and unloading operations and during lance deskulling operations, where steel and slag buildup on the lance exterior surfaces 36 is removed using aggressive mechanical means, including, e.g., machinery employing hydraulic and/or pneumatic hammers and steel tips. When in use, the lance typically is supported only at the upper portion (i.e., above the distributor). Accordingly, the prior art lance typically is subject to deflection (i.e., substantially or at least partially transverse deflection) due to the bending stresses to which it is subjected. For example, the prior art lance 10 in FIG. 1B may be urged to deflect transversely (i.e., relative to the axis 27) by downward deflection of the lower portion relative to the upper portion, as indicated by arrow "D" in FIG. 1B.

Lances equipped with the PC distributor typically are prone to severe bending (i.e., deflection) and, in some cases, failure at the PC distributor, because of the relatively low yield strength of the high thermal conductivity components in the PC distributor. Since the introduction of the mid-lance PC distributor (i.e., at least in the 1980s, and possibly earlier), no effective solutions to the bending and/or failure problems have been implemented. Prior art post-combustion lances typically bend after a relatively short period in service, requiring relatively frequent replacement of the PC distributor.

Previous attempts to address this problem included the development of external removable protective sleeves which are put on new and refurbished PC distributor equipped lances to protect the lances during shipping to the user's facilities. However, the protective sleeves must be removed before the lance is put into service. In practice, sleeves are typically removed prior to completion of the unloading and installation of the lance. As a result, the lance is often bent subsequent to the protective sleeve removal, i.e., during the completion of installation, while in service, or while the lance is loaded back onto the truck for return repair at the end of its service life.

As is well known in the prior art, post-combustion lances may also include one or more spacers 21', to maintain proper alignment of the tubes when the lance is being assembled. The spacers 21' also serve to stiffen the lance to a small extent, however, it appears that they generally have only a limited, localized effect in this regard. For instance, another prior art post-combustion lance 10' including spacers 21' is illustrated in FIGS. 1C-1H. (The balance of the drawings disclose the invention herein.) The reference numerals relating to the prior art lance illustrated in FIGS. 1C-1H are designated by prime (') symbols for the sake of convenience.

As can be seen, for example, in FIG. 1D, in the prior art, spacers 21' are mounted on a lower intermediate element 31'. In general, the typical spacers 21' are formed as elongate ridges on an outer surface of a tube element. The spacers 21' preferably are relatively narrow (FIG. 1F), and spaced apart from each other around an outer surface 33' of the lower intermediate element 31' (FIG. 1F).

Additional spacers 21' are shown in FIG. 1E. For instance, spacers 21A', 21B' are mounted on an upper inner tube 26' (FIG. 1E). Additional spacers 21C', 21D' are positioned on a slip joint part 26A' of the upper inner tube 26' (FIG. 1E). Also, and as can be seen in FIG. 1E, spacers 21E', 21F' are mounted on an upper intermediate element 29'. The PC distributor 18' is also illustrated in FIG. 1E, and additional spacers 21G', 21H', mounted on the lower intermediate element 31', can also be seen in FIG. 1E.

FIG. 1E also shows that a first internal element 23' of the PC distributor 18' is welded to a lower inner tube 34' and positioned adjacent to a second internal element 38'. As can be seen in FIG. 1E, the post-combustion lance 10' also includes an o-ring gland 35' mounted in the first internal element 23', to enable movement of the first internal element 23' and the second internal element 38' relative to each other generally axially (i.e., in a direction substantially parallel to the axis 27'). As can be seen in FIG. 1E, the o-ring gland 35' preferably includes a number of o-rings 37'. Those skilled in the art will appreciate that, in order for such movement to take place, a similar arrangement (i.e., an o-ring gland, to permit substantially axial relative movement of adjacent elements) is typically also included at the upper end of the upper portion 22'. This other o-ring gland or similar arrangement (not shown) typically is positioned near a manifold (not shown) through which oxygen (and other gases, as required) and water are provided to the lance. As is well known in the art, the o-ring glands are needed in order to permit expansion and/or contraction of various elements in the lance 10', due to extreme temperature differences.

As noted above, because the PC distributor tends to be relatively weak (i.e., because it is primarily made of copper), the lance 10' tends to bend at the distributor. In general, the lower portion 24' tends to move downwardly (under the influence of gravity), in the direction indicated by arrow "J" in FIG. 1C. From FIGS. 1C and 1E, however, it can be seen that the o-ring gland 35' also provides a relatively weaker area in the lance 10', about which the lower portion 34' tends to bend downwardly. In effect, the positioning of the o-ring gland 35' in the PC distributor 18' tends to undermine the overall structural integrity of the lance 10'.

For example, as can be seen in FIGS. 1F-1H, spacers 21J' and 21K' are positioned on an outer surface 39' of the lower inner tube 34'. However, each of the spacers 21J' and 21K' has an outer region 41' that faces an inner surface 43' of the lower intermediate element 31', i.e., the outer region 41' is positioned opposite to the inner surface 43'. The outer region 41' and the inner surface 43' are separated by a gap 45'. Similarly, spacers 21L' and 21M' are mounted on the outer surface 33' of the lower intermediate element 31'. Each of the spacers 21L', 21M' includes an outer region 47' that faces an inner surface 49' of an exterior tube 51'. In each case, the outer region 47' is spaced apart from the inner surface 49' by a gap 53' (FIG. 1H).

It can be seen, therefore, that the spacers of the prior art generally do not provide sufficient support to the body, and that positioning one or more of the o-ring glands at or near the distributor tends to weaken the lance.

SUMMARY OF THE INVENTION

For the foregoing reasons, there is a need for an internal support assembly for a post-combustion lance, and a post-combustion lance including same.

In its broad aspect, the invention provides a post-combustion lance for directing a gas at least partially therethrough. The post-combustion lance includes a body extending between an upstream end and a downstream end of the lance, the downstream end having a primary tip through which a first part of the gas exits the lance. The body includes upper and lower portions and a post-combustion distributor mounted between the upper and lower portions at a predetermined distance from the primary tip. The distributor includes a number of ports through which a second part of the gas exits the lance. The upper and lower portions are located upstream and downstream respectively relative to the distributor. The lance also includes an internal support assembly for supporting the body. The internal support assembly includes an internal tube positioned inside the body and at least partially engaged with the lower portion thereof. Also, the internal support assembly is at least partially engaged with the upper portion of the body so that the internal support assembly supports the body upstream and downstream relative to the distributor. The lance also includes a lower o-ring gland positioned downstream relative to the distributor to permit movement of at least part of the internal support assembly and at least part of the body relative to each other due to thermal expansion. In addition, the lance includes an upper o-ring gland positioned upstream relative to the lower o-ring gland, to permit movement of at least part of the internal support assembly and at least part of the body relative to each other due to thermal expansion.

In another of its aspects, the invention provides a post-combustion lance having a body at least partially defined by an axis thereof and extending between an upstream end and a downstream end of the lance, the upstream end being adapted to receive the gas, and the downstream end comprising a primary tip through which a first part of the gas exits the lance. The body includes upper and lower portions and a post-combustion distributor mounted between the upper and lower portions at a predetermined distance from the primary tip, the distributor having a number of ports through which a second part of the gas exits the lance, the upper and lower portions being located upstream and downstream respectively relative to the distributor. The body also includes an upper inner tube positioned at least partially upstream from the distributor, a lower inner tube positioned at least partially downstream from the distributor, and a connecting tube for directing the gas to the upper portion. In addition, the lance includes an internal support assembly for supporting the body, the internal support assembly including an internal tube positioned inside the body and engaged with at least a part of the lower inner tube, one or more collars positioned between the internal tube and the upper portion, so that the internal support assembly supports the body upstream and downstream relative to the distributor. The lance also has a lower o-ring gland positioned proximal to the lower portion, to permit movement of the internal tube and the primary tip relative to each other due to thermal expansion at least partially in an axial direction substantially parallel to the axis, and an upper o-ring gland positioned proximal to the upper portion, to permit movement of the upper inner tube and the connecting tube relative to each other due to thermal expansion at least partially in the axial direction.

In another aspect, the invention provides a post-combustion lance including a body at least partially defined by an axis thereof and extending between an upstream end and a downstream end of the lance, the upstream end being adapted to receive the gas, and the downstream end including a primary tip through which a first part of the gas exits the lance. The body includes upper and lower portions and a post-combustion distributor mounted between the upper and lower portions at a predetermined distance from the primary tip, the distributor including a number of ports through which a second part of the gas exits the lance, the upper and lower portions being located upstream and downstream respectively relative to the distributor. The distributor additionally includes a distributor tube extending upstream relative to the ports. The body also includes an upper inner tube positioned at least partially upstream from the distributor, an adaptor secured to the upper inner tube and engageable with the distributor tube, and a lower inner tube positioned at least partially downstream from the distributor. The lance also includes an internal support assembly for supporting the body, the internal support assembly having an internal tube positioned inside the body and engaged with the lower inner tube at least partially downstream relative to the distributor and the upper inner tube at least partially upstream relative to the distributor. The lance additionally includes a lower o-ring gland positioned proximal to the lower portion, to permit movement of the lower inner tube and the primary tip relative to each other due to thermal expansion at least partially in an axial direction substantially parallel to the axis, and an upper o-ring gland positioned on the adaptor for engagement with the distributor tube, to permit movement of the upper inner tube and the distributor tube relative to each other due to thermal expansion at least partially in the axial direction.

BRIEF DESCRIPTION OF THE DRAWINGS

The invention will be better understood with reference to the attached drawings, in which.

DETAILED DESCRIPTION

Figure 1A:
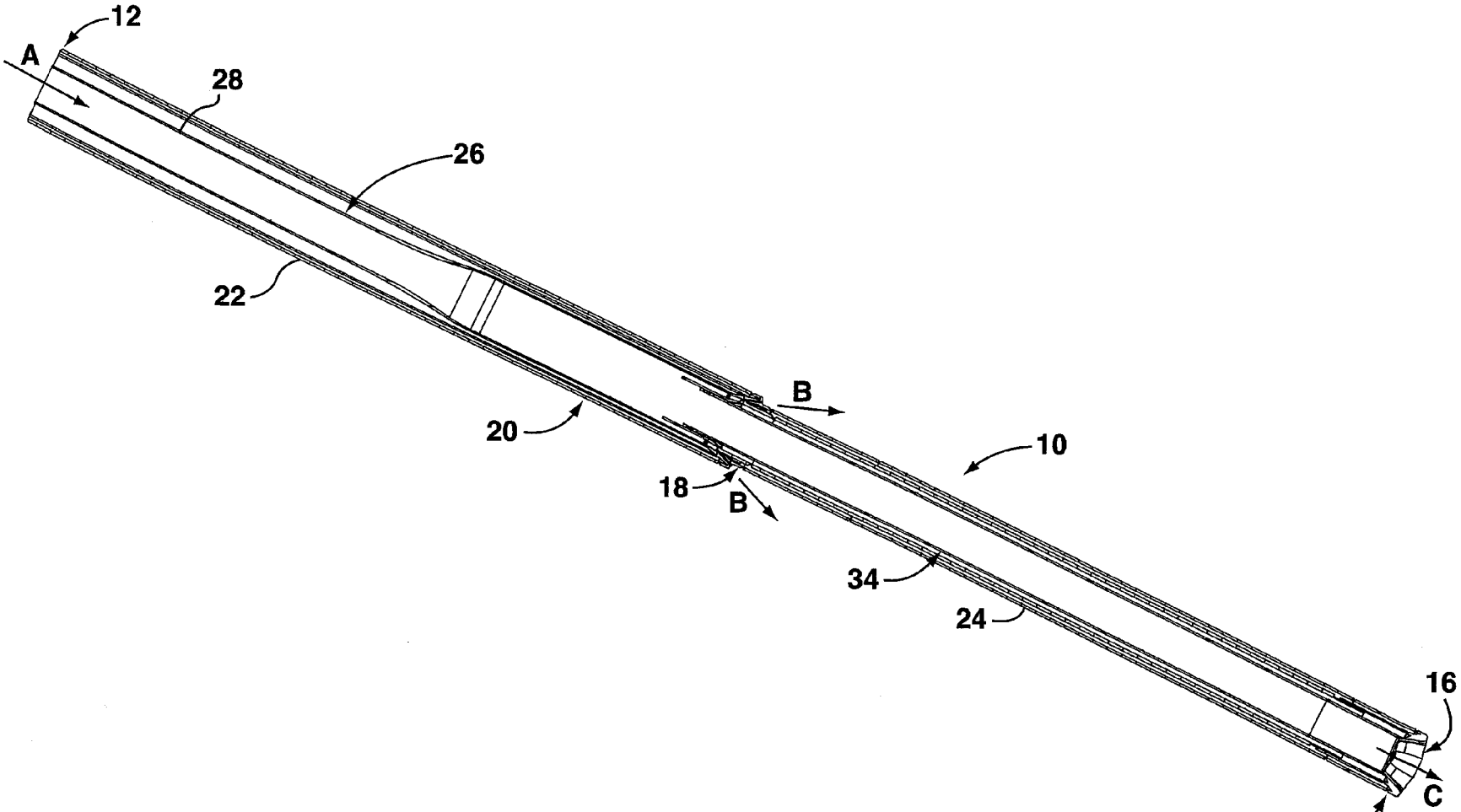
FIG. 1A (Prior Art)
FIG. 1A (also described previously) is a cross-section of a post-combustion lance of the prior art.
Figure 1B:
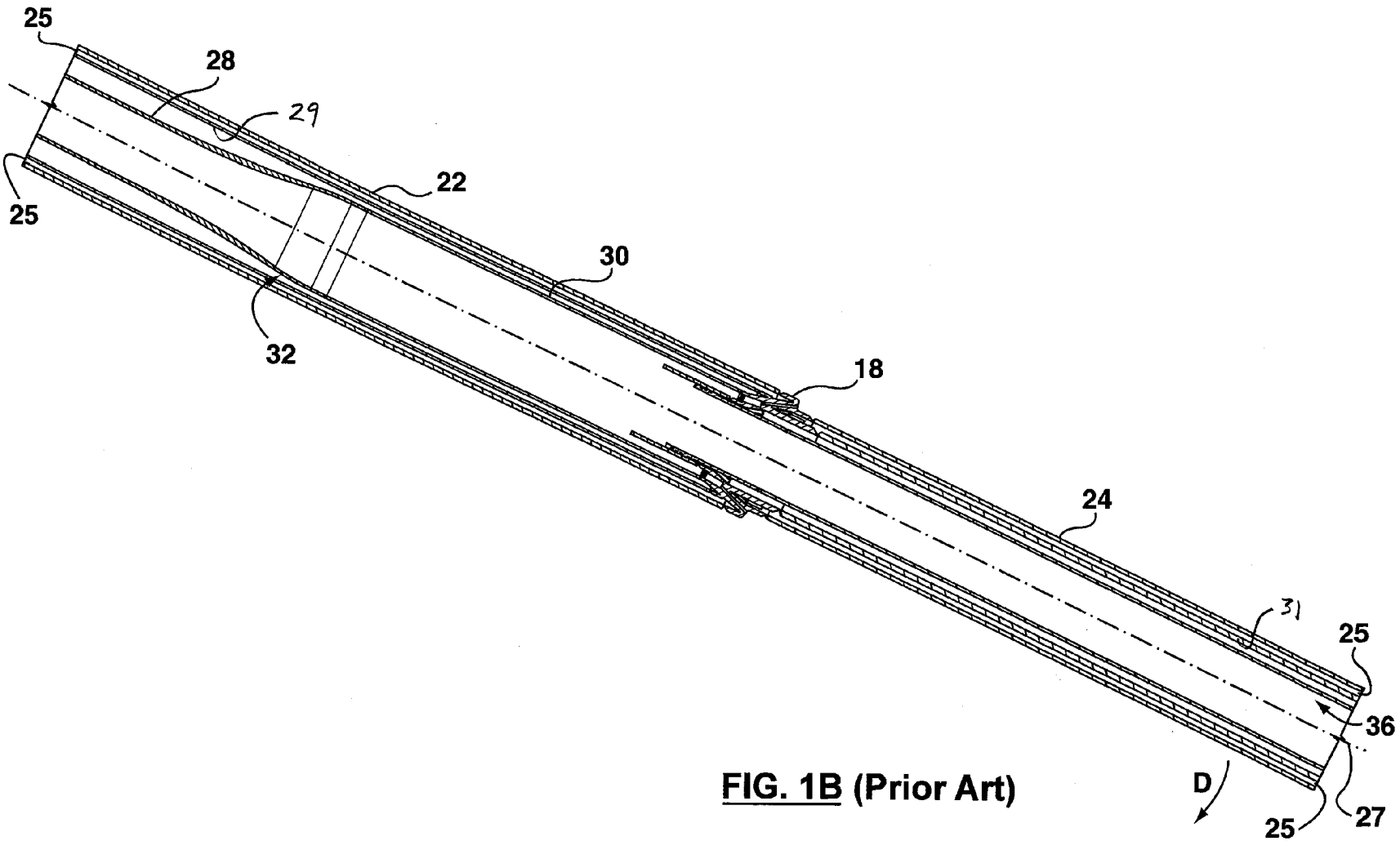
FIG. 1B (Prior Art)
FIG. 1B (also described previously) is a cross-section of a portion of the prior art post-combustion lance of FIG. 1A, drawn at a larger scale.
Figure 1C:
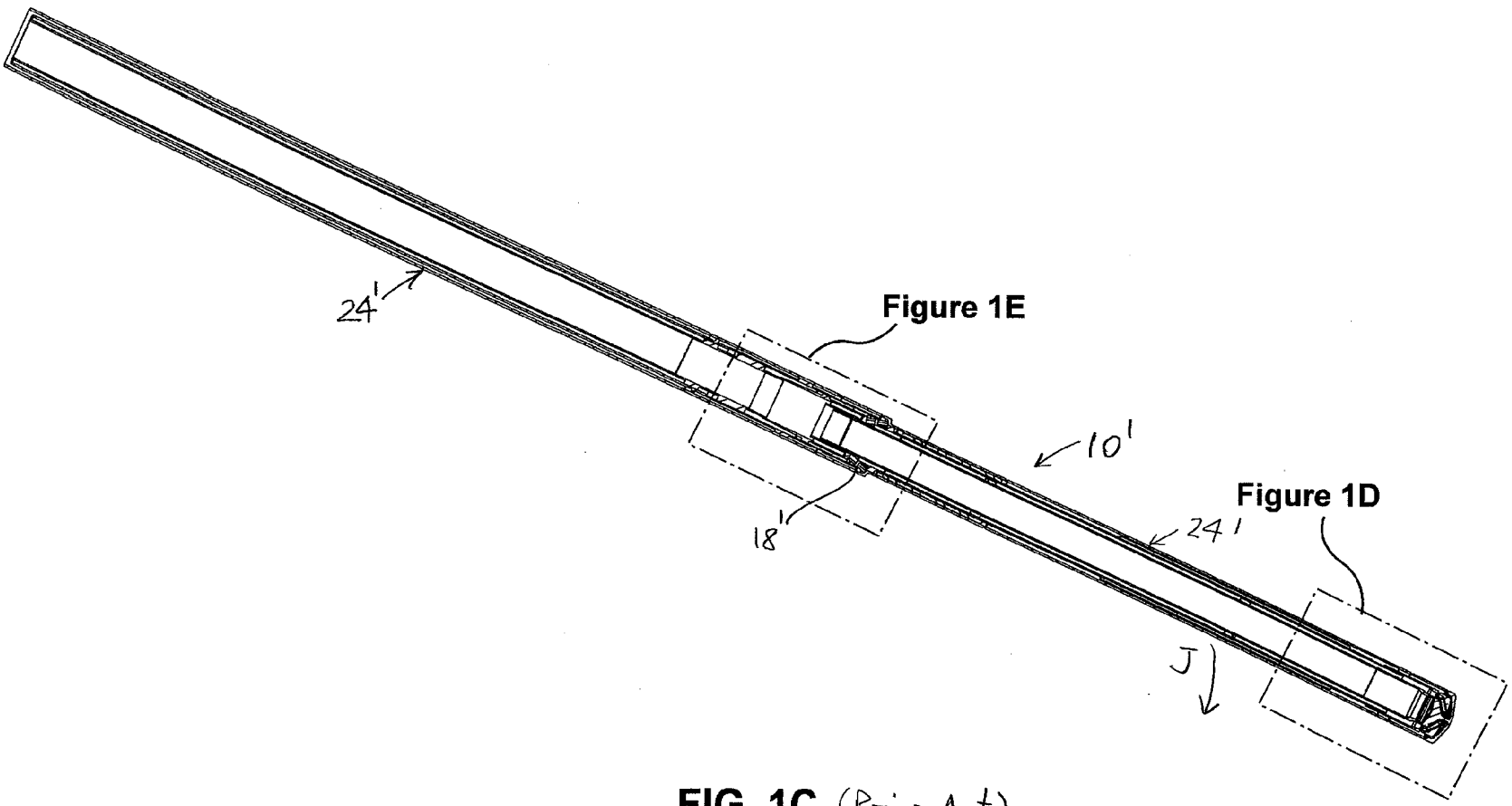
FIG. 1C (Prior Art)
FIG. 1C (also described previously) is a cross-section of another post-combustion lance of the prior art, drawn at a smaller scale.
Figure 1D:
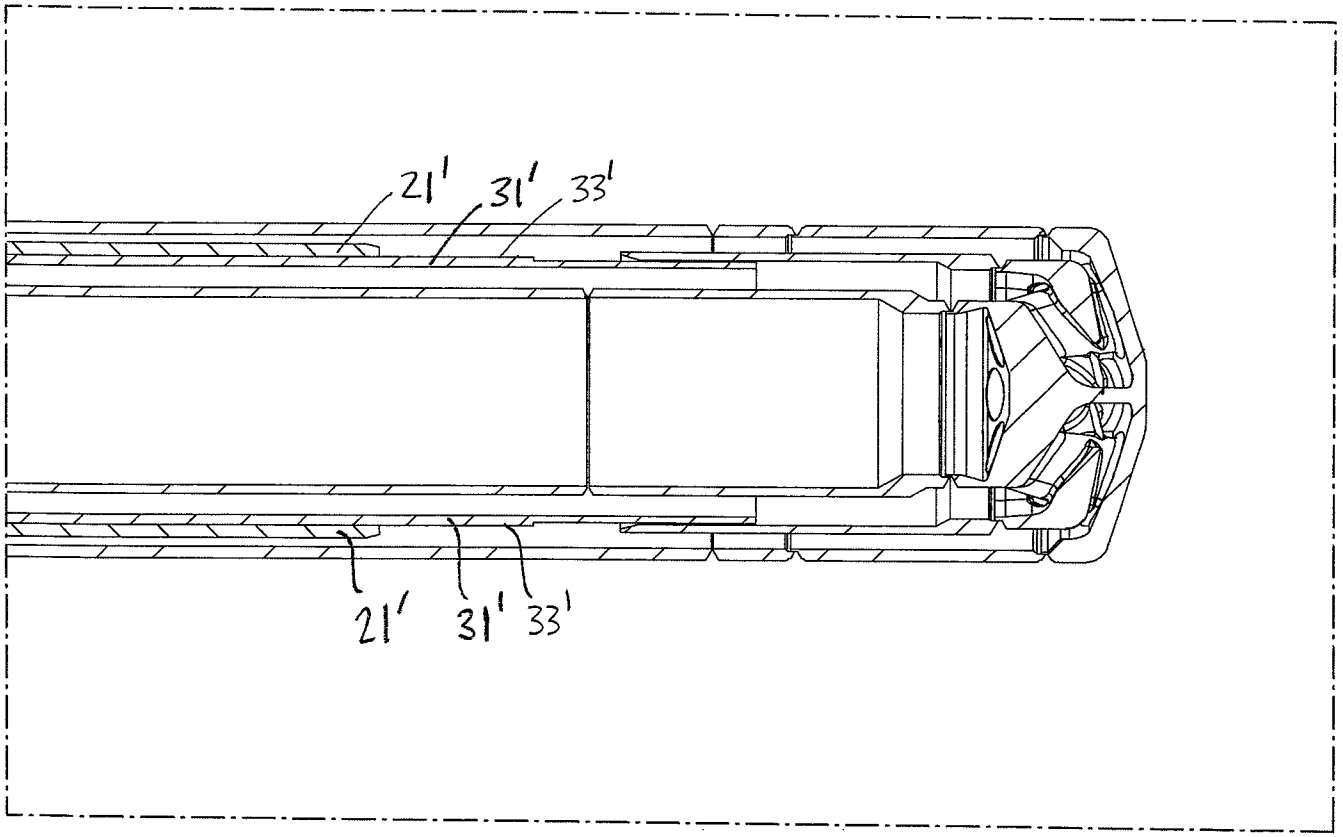
FIG. 1D (Prior Art)
FIG. 1D (also described previously) is a cross-section of a portion of the lance of FIG. 1C, drawn at a larger scale.
Figure 1E:
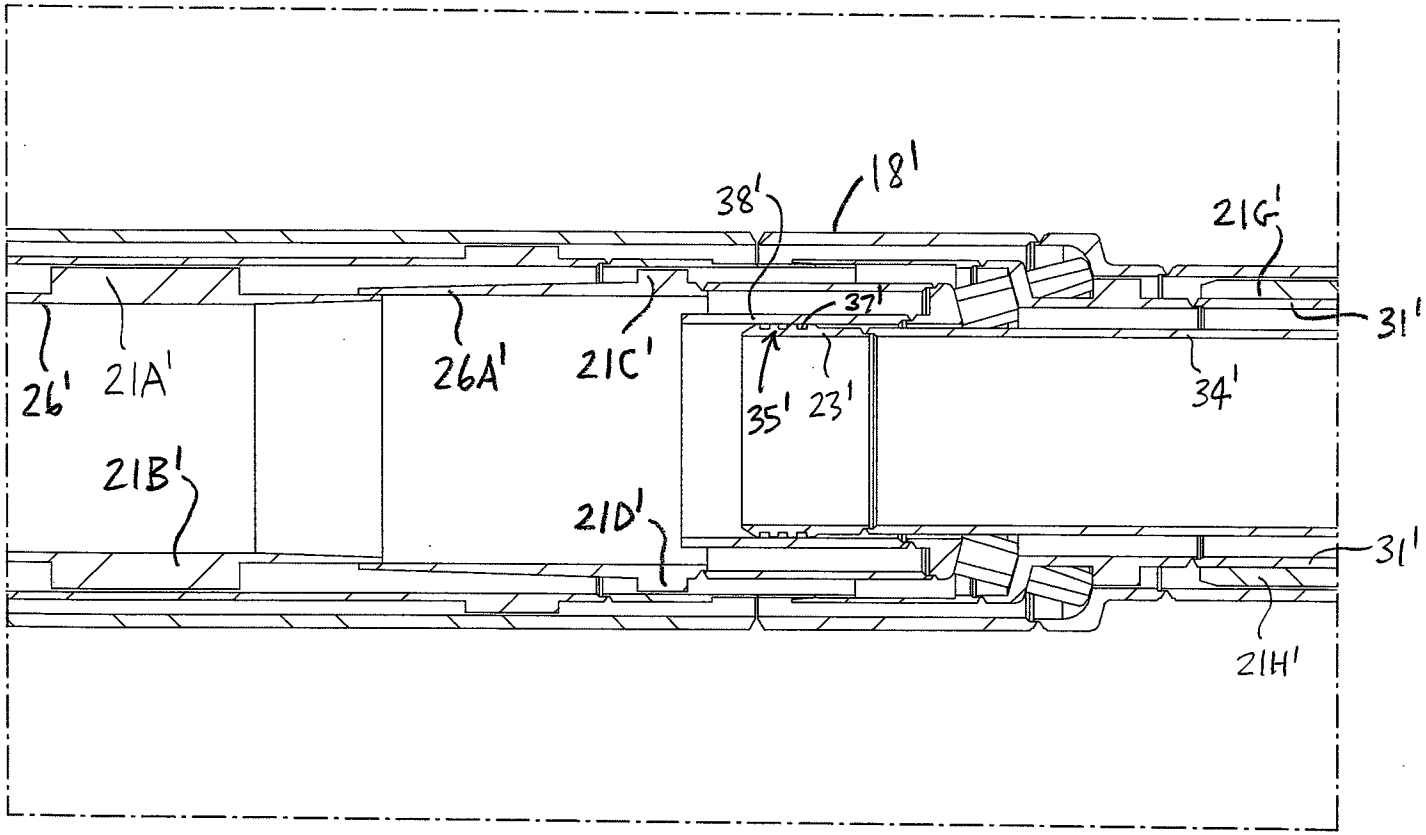
FIG. 1E (Prior Art)
FIG. 1E (also described previously) is a cross-section of another portion of the lance of FIG. 1D.
Figure 1F:
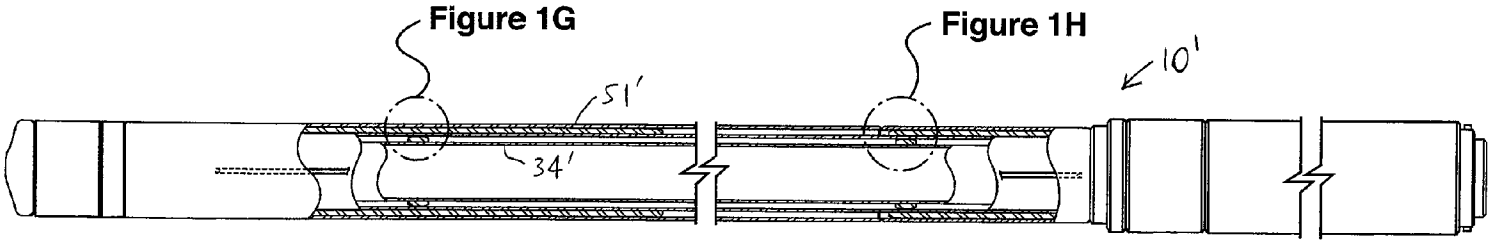
FIG. 1F (Prior Art)
FIG. 1F (also described previously) is another cross-section (partially cut away) of a portion of the lance of FIG. 1C in which certain spacers are illustrated, drawn at a smaller scale.
Figure 1H:
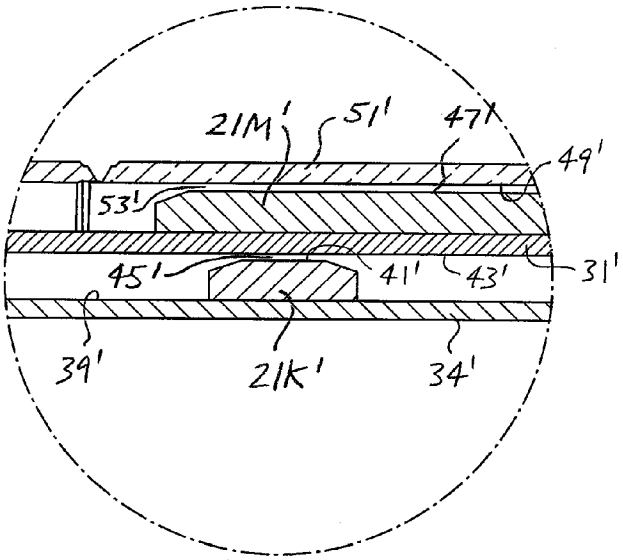
FIG. 1H (Prior Art)
FIG. 1H (also described previously) is a cross-section of another portion of the lance of FIG. 1F.
Figure 1G:
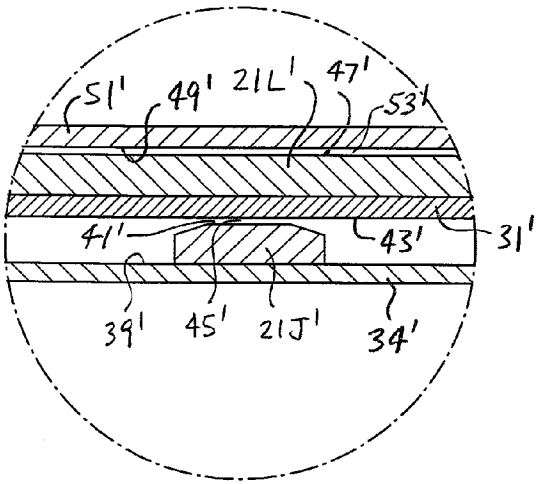
FIG. 1G (Prior Art)
FIG. 1G (also described previously) is a cross-section of a portion of the lance of FIG. 1F, drawn at a larger scale.

To simplify the description, the reference numerals used previously in FIGS. 1A and 1B will be used again in connection with the description of the invention hereinafter, except that each such reference numeral is raised by 100 (or by whole number multiples thereof, as the case may be), where the parts described correspond to parts described above.

Reference is first made to FIGS. 2A-2E and 6A-6C to describe an embodiment of a post-combustion lance in accordance with the invention indicated generally by the numeral 140. The post-combustion lance 140 is for directing a gas (not shown) at least partially therethrough. In one embodiment, the post-combustion lance 140 includes a body 120 extending between an upstream end 112 and a downstream end 114 of the lance 140. The upstream end 112 is adapted to receive the gas, and the downstream end 114 includes a primary tip 116 through which a first part of the gas exits the lance 140. The body 120 also includes upper and lower portions 122, 124 and a post-combustion distributor 118 mounted therebetween at a predetermined distance from the primary tip 116. The distributor 118 includes a plurality of ports 119 through which a second part of the gas exits the lance 140. In one embodiment, the lance 140 preferably includes an upper inner tube 126 positioned at least partially upstream from the distributor 118 and attached to the upper portion 122, and a lower inner tube 134 positioned at least partially downstream from the distributor 118 and attached to the lower portion 124. Preferably, the lance 140 also includes an internal support assembly 142 for supporting the body 120, as will be described. In one embodiment, the internal support assembly 142 preferably includes an internal tube 144 positioned inside the body 120 and also positioned at least partially upstream relative to the lower inner tube 134. The internal tube 144 preferably is engaged with the lower inner tube 144, as will also be described. The internal support assembly 142 also includes one or more collars 146 positioned between the upper inner tube 126 and the internal tube 144 to support the internal tube 144 in a predetermined position coaxial with the body 120 so that the internal tube 144 resists deflection of the body 120.

Figure 6A:
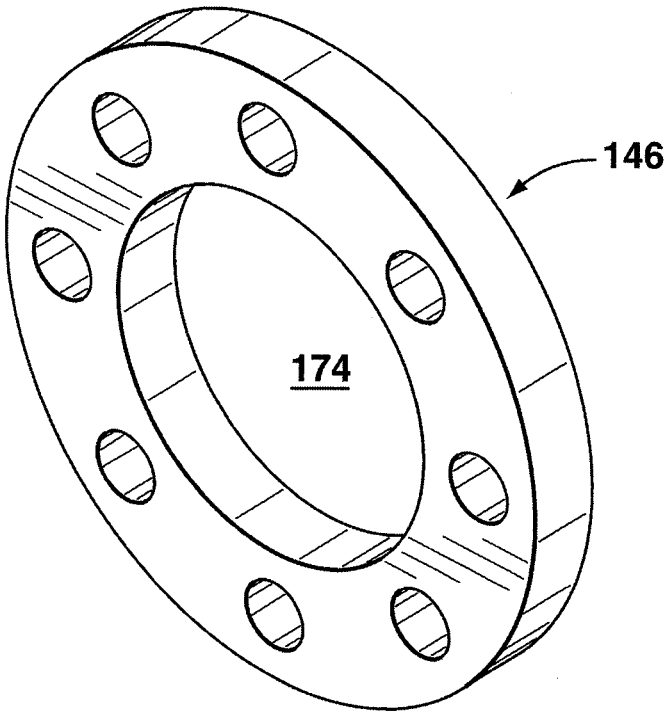
FIG. 6A is an isometric view of an embodiment of a collar of the invention, drawn at a larger scale.
Figure 6C:
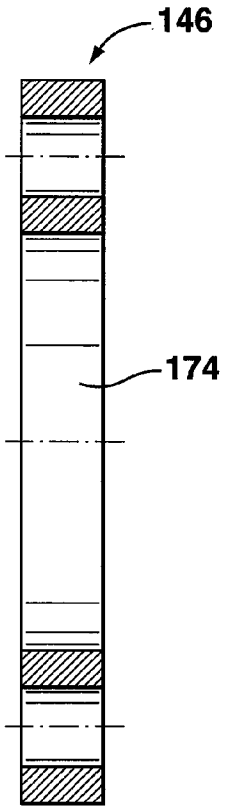
FIG. 6C is a cross-section of the collar of FIGS. 6A and 6B taken along line A-A in FIG. 6B.
Figure 6B:
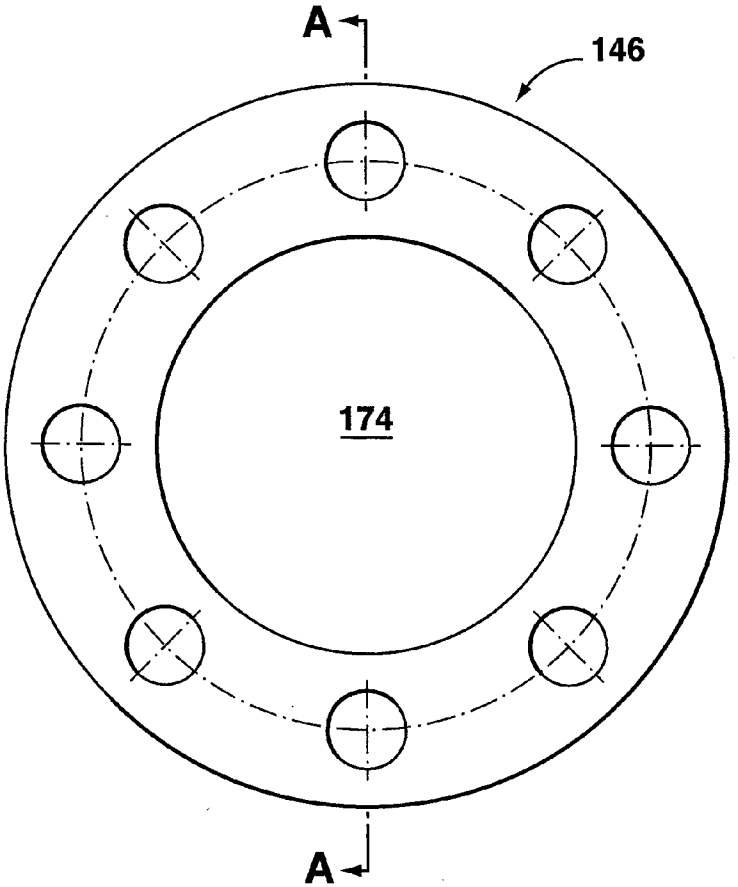
FIG. 6B is a front view of the collar of FIG. 6A, drawn at a larger scale.

An embodiment of the collar 146 of the invention is shown in FIGS. 6A-6C. Preferably, each collar 146 is secured to the internal tube 144. For example, the collar 146 is welded to the internal tube 144, in one embodiment. Also, it is preferred that the collar 146 (i.e., at least one collar 146) is attached to the upper inner tube 126.

Figure 2A:
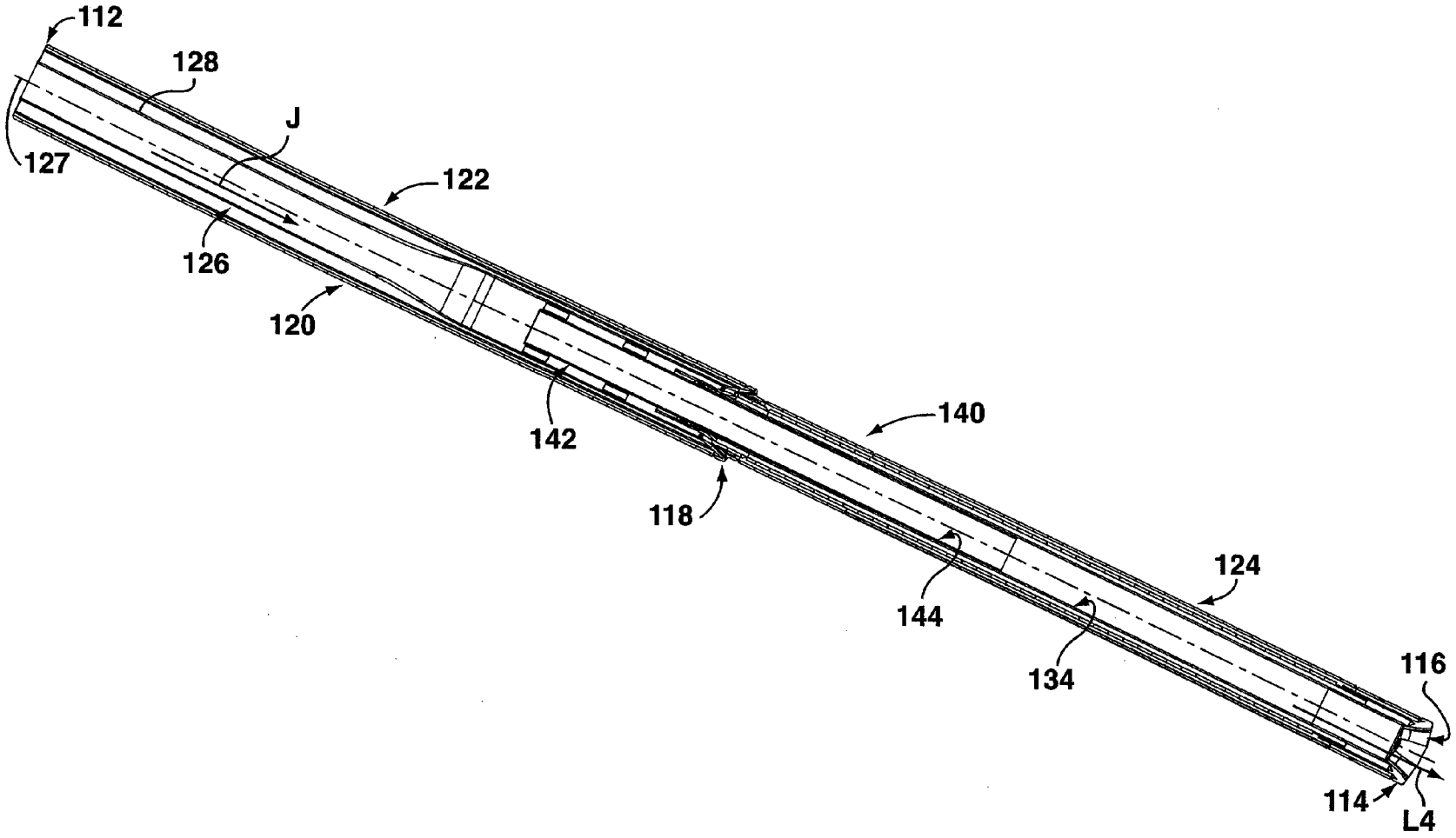
FIG. 2A is a cross-section of an embodiment of a post-combustion lance of the invention including an embodiment of an internal support assembly of the invention, drawn at a smaller scale.
Figure 2B:
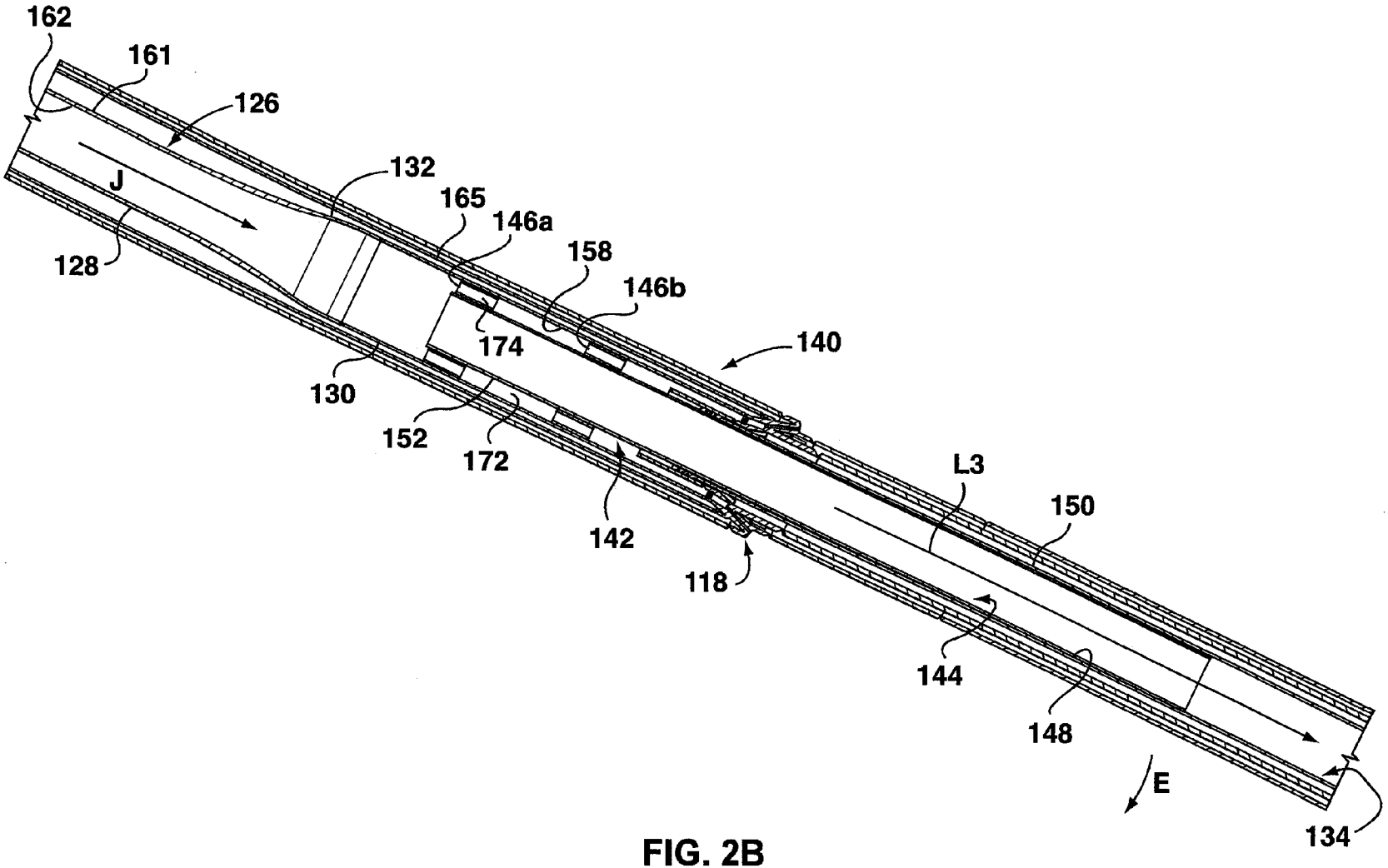
FIG. 2B is a cross-section of a portion of the lance of FIG. 2A, drawn at a larger scale.
Figure 2C:
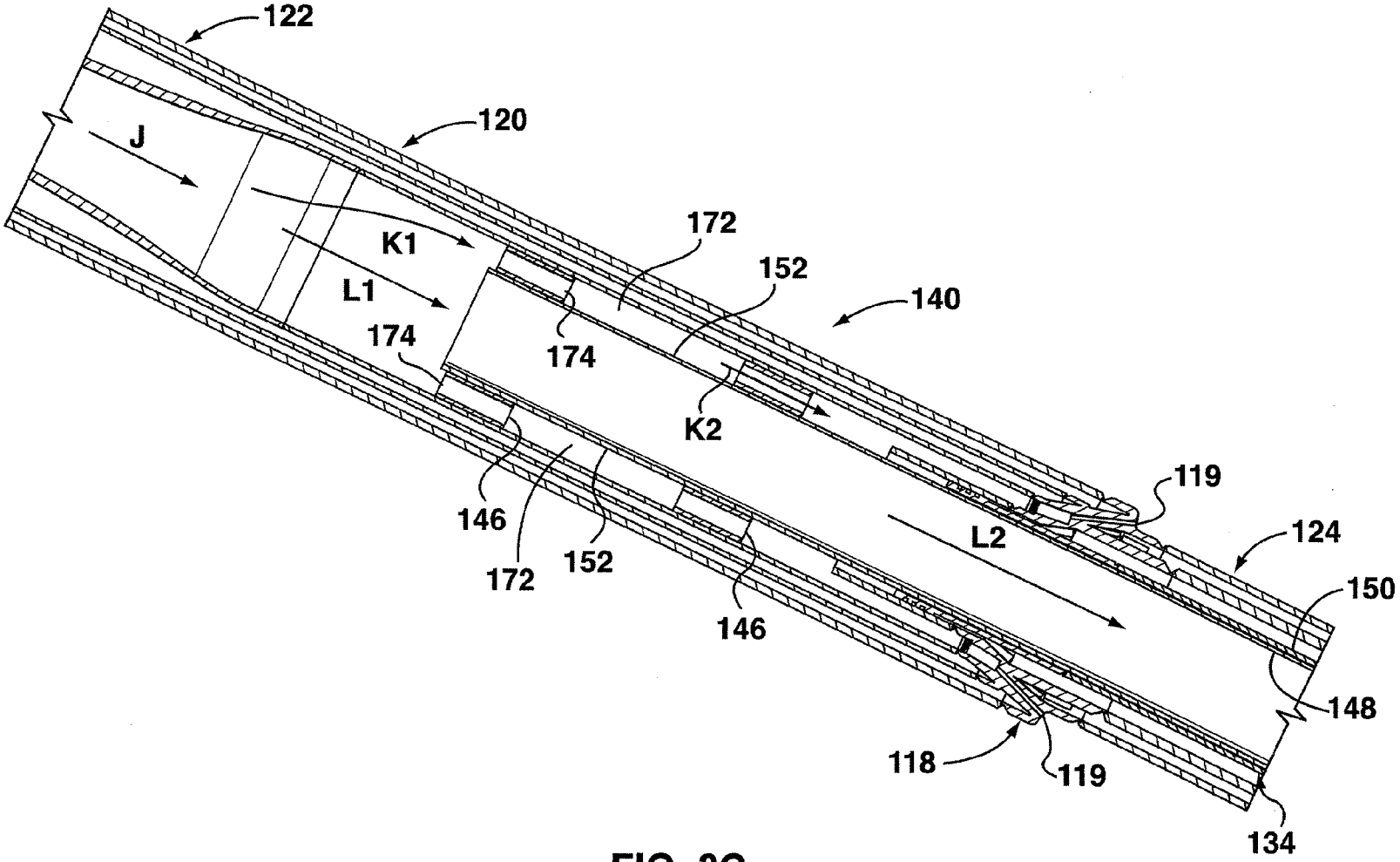
FIG. 2C is a cross-section of a portion of the post-combustion lance of FIG. 2B, drawn at a larger scale.

As can be seen in FIGS. 2B and 2C, a downstream portion 148 of the internal tube 144 engages an upstream portion 150 of the lower inner tube 134. This enables the internal tube 144 to resist deflection of the body 120, and in particular, to resist transverse deflection of the body 120.

The upper inner tube 126 is securely mounted to the upper portion 122. Also, the lower inner tube 134 is securely mounted to the lower portion 124. The manner in which the upper and lower inner tubes 126, 134 are secured to the upper and lower portions 122, 124 is well known in the art, and therefore does not need to be described. As shown in FIGS. 2A-2C, and as will be described, the internal support assembly 142 is connected with each of the upper and lower inner tubes 126, 134 respectively, and thereby also indirectly connected with the upper and lower portions 122, 124.

Figure 2D:
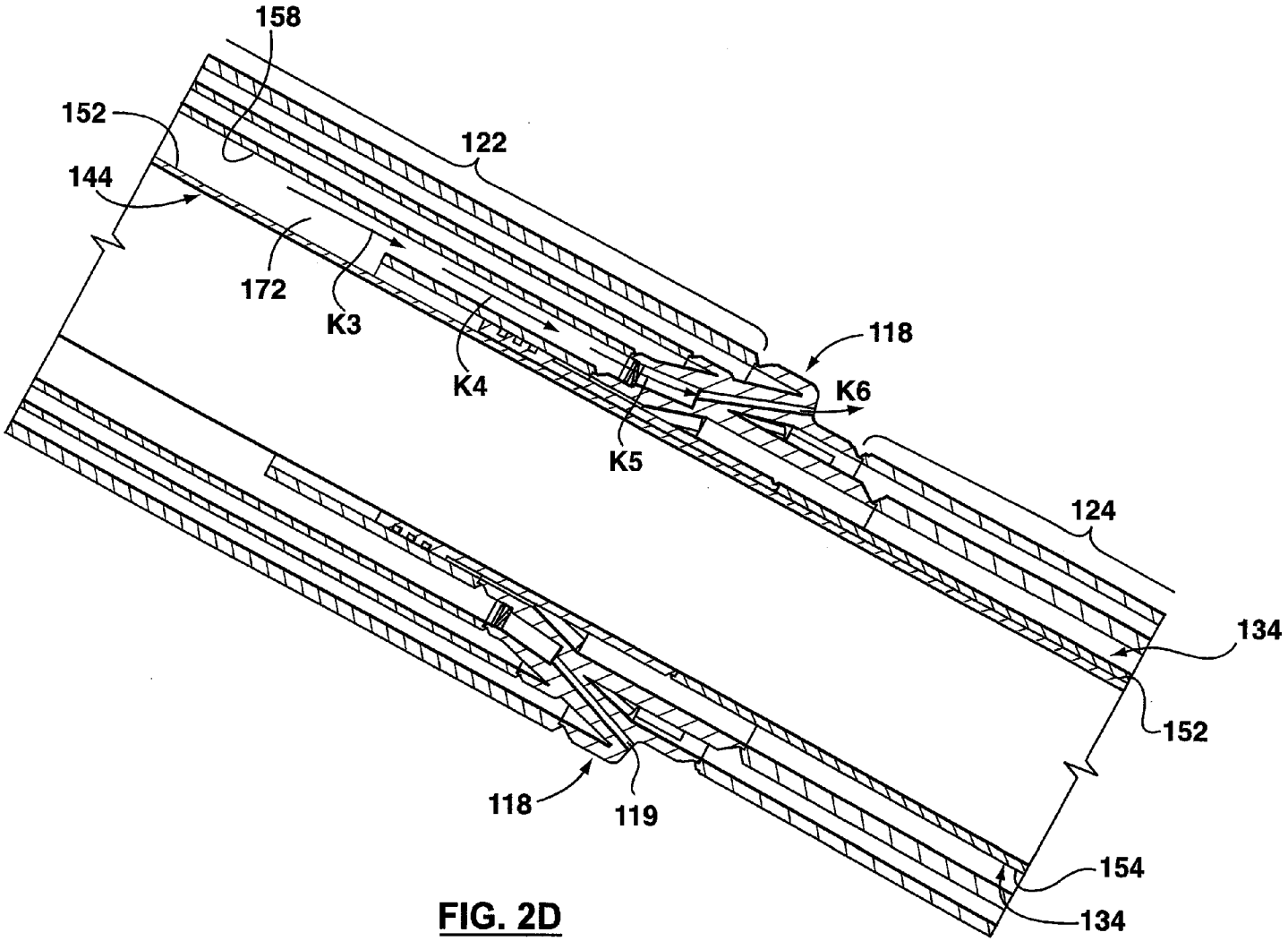
FIG. 2D is a cross-section of a portion of the post-combustion lance of FIG. 2C, drawn at a larger scale.

In one embodiment, an outer wall 152 of the internal tube 144 in the downstream portion 148 thereof engages an inner wall 154 of the lower inner tube 134 in the upstream portion 150 thereof so that the internal tube 144 supports the body 120 (FIG. 2D). Preferably, the downstream portion 148 of the internal tube 144 and the upstream portion 150 of the lower inner tube 134 are slidingly engaged with each other, i.e., longitudinal sliding movement of the internal tube 144 relative to the lower inner tube 134 (and vice versa) is permitted. However, bending (i.e., deflection) of the lower inner tube in an at least partially transverse direction is resisted by the internal tube 144, due to the close engagement of the internal tube 144 and the lower inner tube 134.

As can be seen in FIGS. 2A-2C, the lance 140 preferably includes a plurality of collars 146*a*, 146*b* in which each collar is secured to the outer wall 152 of the internal tube 144. It is preferred that the collars 146 are attached or secured to an upstream portion 156 of the internal tube 144, i.e., a portion of the internal tube upstream relative to the ports 119. Preferably, one of the collars (in the drawings, the collar 146*b*) is also attached to an inner wall 158 of the upper inner tube 126, to position the internal tube 144 substantially coaxially with the body 120. The axes 127 of the upper and lower portions are shown in FIG. 2A. For example, it is preferred that each collar 146*a*, 146*b* is welded to the outer wall 152 of the internal tube 144. As will be described, in one embodiment, only one of the collars (e.g., the collar 146*b*, as shown in FIG. 2C) preferably is attached to the inner wall 158 of the upper inner tube 126 (FIGS. 2B, 2C). As can be seen in FIGS. 2B and 2C, where the collar 146*b* is attached (e.g., by welding) to the inner wall 158, the other collar 146*a* preferably engages the inner wall 158.

Accordingly, and as noted above, it can be seen that the upstream portion 156 of the internal tube 144 is indirectly connected (i.e., via the engagement and/or attachment of the collars to the upper inner tube) with the upper portion 122 of the body 120, and the downstream portion 148 of the internal tube 144 is indirectly connected (i.e., via the engagement of the downstream portion of the internal tube with the upstream portion of the lower inner tube) with the lower portion 124 of the body 120. Because of the indirect connection of the internal tube's upstream portion 156 and downstream portion 148 with the upper and lower portions 122, 124 respectively, the internal support assembly 142 resists deflection o the body, particularly deflection thereof in an at least partially transverse direction.

As can be seen in FIGS. 2A-2C, the upper inner tube 126 preferably includes an upstream portion 128 proximal to the upstream end 112. The upstream portion 128 preferably is substantially cylindrical, and has outer and inner diameters defined by outer and inner walls 161, 162 (FIG. 2B). The upper inner tube 126 preferably also includes a downstream portion 130 located proximal to the distributor 118. The downstream portion 130 preferably has an outer diameter defined by an outer wall 165 substantially larger than the outer diameter of the upstream portion 128 and an inner diameter defined by the inner wall 158 substantially larger than the inner diameter of the upstream portion 128 (FIG. 2B). In addition, the upper inner tube 126 preferably also includes a connecting portion 132 connecting the upstream and downstream portions 128, 130. The internal tube 144 preferably has an outer diameter defined by the outer wall 152 thereof, which is substantially smaller than the inner diameter of the downstream portion 130. An annulus 172 is defined accordingly between the internal tube 144 and the downstream portion 130 (FIGS. 2B, 2C). Preferably, the annulus 172 is in fluid communication with the ports 119 (FIGS. 2B, 2C, 2C).

In addition, and as can be seen in FIGS. 2C, 6A, 6B, and 6C, each collar 146 preferably includes one or more apertures 174 to permit the second part of the gas to flow therethrough to the ports 119.

As noted above, the upper portion 122 and the lower portion 124 of the lance body 120 preferably are made of steel. The distributor 118 typically includes materials with relatively good heat conductivity, e.g., copper.

Figure 2E:
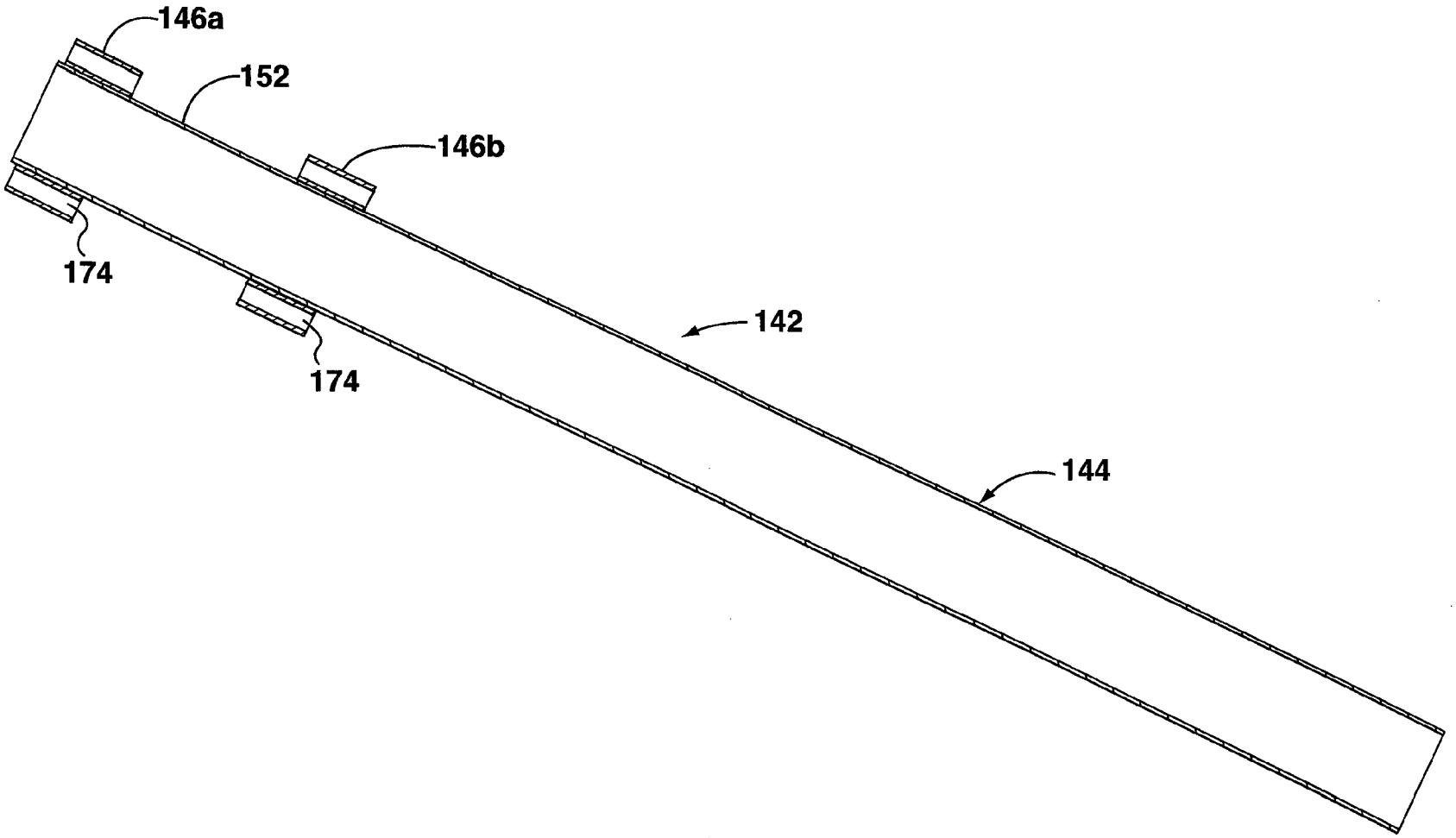
FIG. 2E is a cross-section of an embodiment of an internal support assembly of the invention, drawn at a smaller scale.

The internal support assembly 142 may be made of any suitable materials. For example, the internal tube 144 and the collars 146 may be made of steel. As shown in FIG. 2E, in one embodiment, the support assembly 142 preferably includes the internal tube 144 and two collars 146*a*, 146*b*.

As described above, the internal tube 144 is positionable inside the body 120 and at least partially upstream relative to the lower inner tube 134. Preferably, the internal tube 144 is engageable with the lower inner tube 134. Also, the internal support assembly 142 includes one or more collars 146 which are securable to the internal tube 144 and positionable between the upper inner tube 126 and the internal tube 144, to maintain the internal tube 144 in a predetermined position relative to the upper inner tube 126 and the lower inner tube 134. Preferably, the internal tube 144 is positioned coaxial with the upper and lower inner tubes 126, 134, to facilitate flow of the gas through the lance 140. As well, and as described above, the internal tube 144 is positioned to resist deflection of the body 120.

In use, the lance 140 is supported at or close to the upstream end 112. Because only the upper portion is directly supported while the lance is in operation, gravity urges the lower portion 124 of the lance downwardly, as indicated by arrow "E" in FIG. 2B. The downwardly directed force is substantially transverse (or at least partially transverse) to the body. However, as can be seen in FIG. 2B, the internal tube 144 resists deflection of the lance body because the internal tube 144 is engaged with the lower inner tube at the downstream portion 148 thereof, and the internal tube 144 is also engaged with the upper inner tube 126, i.e., via the collars 146*a*, 146*b*.

The internal support assembly 142 is assembled by securing the collars 146 to the outer wall 152 of the internal tube 144 (FIG. 2E). The internal support assembly 142 is positioned in the body 120 as shown in FIGS. 2A-2C. Preferably, the internal tube 144 is mounted in the body 120 substantially coaxial with the body 120, so that the internal tube 144 resists deflection of the body. The gas as initially introduced into the lance 140 is represented by arrow "J" in FIGS. 2A, 2B, and 2C. Part of the gas (represented by arrows "K1", "K1", "K3", "K4", "K5", and "K6" in FIGS. 2C and 2D) is directed through the apertures 174 in the collars 146*a*, 146*b* and along the annulus 174 to the port 119, where the part of the gas exits the lance 140. The other part of the gas (represented by arrows "L1", "L2", "L3" in FIGS. 2A, 2B, 2C, and 2D) is directed inside the internal tube 144 and through the lower inner tube 134 to the tip 116, where it exits the lance 140.

Additional embodiments of the invention are shown in FIGS. 3A-5C and 7A-8B. In FIGS. 3A-5C and 7A-8B, elements are numbered so as to correspond to like elements shown in FIGS. 2A-2E and 6A-6C.

It will be understood that the internal support assembly 142 of the invention may be retrofitted into an existing post-combustion lance. The steps of the method of retrofitting the internal support assembly 142 in a prior art post-combustion lance are shown in FIGS. 7A-7E.

Figure 7A:
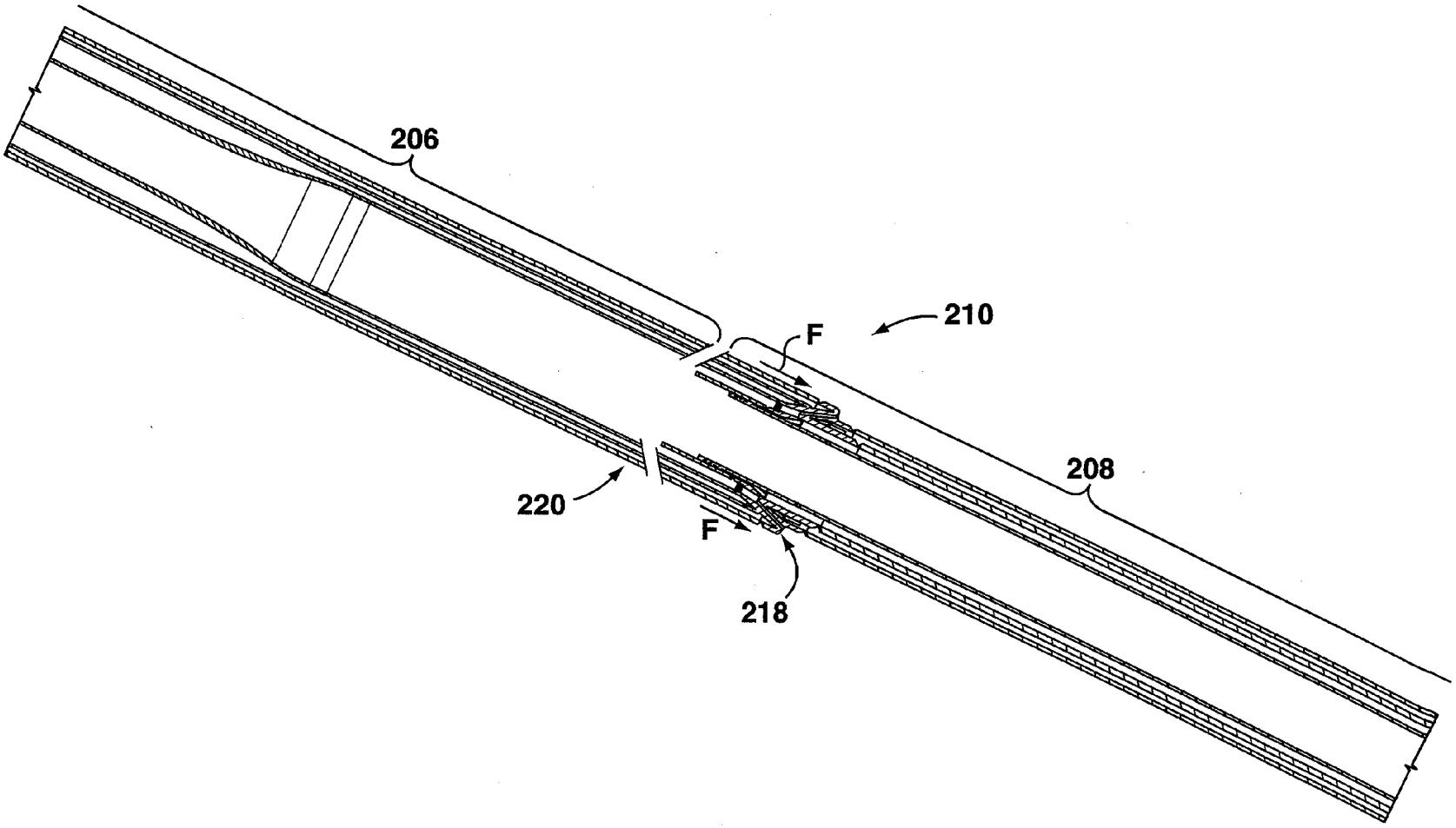
FIG. 7A is a cross-section of a portion of a prior art lance illustrating a first step in an embodiment of a method of the invention.

As shown in FIG. 7A, a prior art lance 210 is cut using any suitable means for doing so at a suitable location on the lance body, the suitable location preferably being upstream relative to the distributor 218. For example, the body may be cut by a cutting torch. The cut defines upper and lower cut portions 206, 208 of the lance body 220.

Figure 7B:
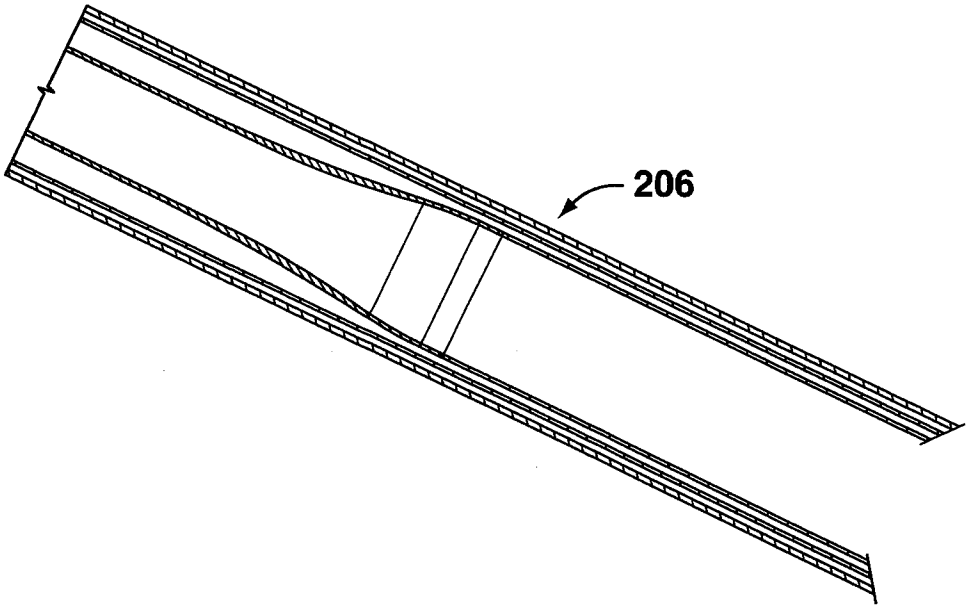
FIG. 7B is an illustration of a second step of the method of FIG. 7A.

Preferably, the lower cut portion 208 is then removed from the upper cut portion 206, as indicated by arrows "F" in FIG. 7A. The upper cut portion 206 is shown in FIG. 7B.

Figure 7C:
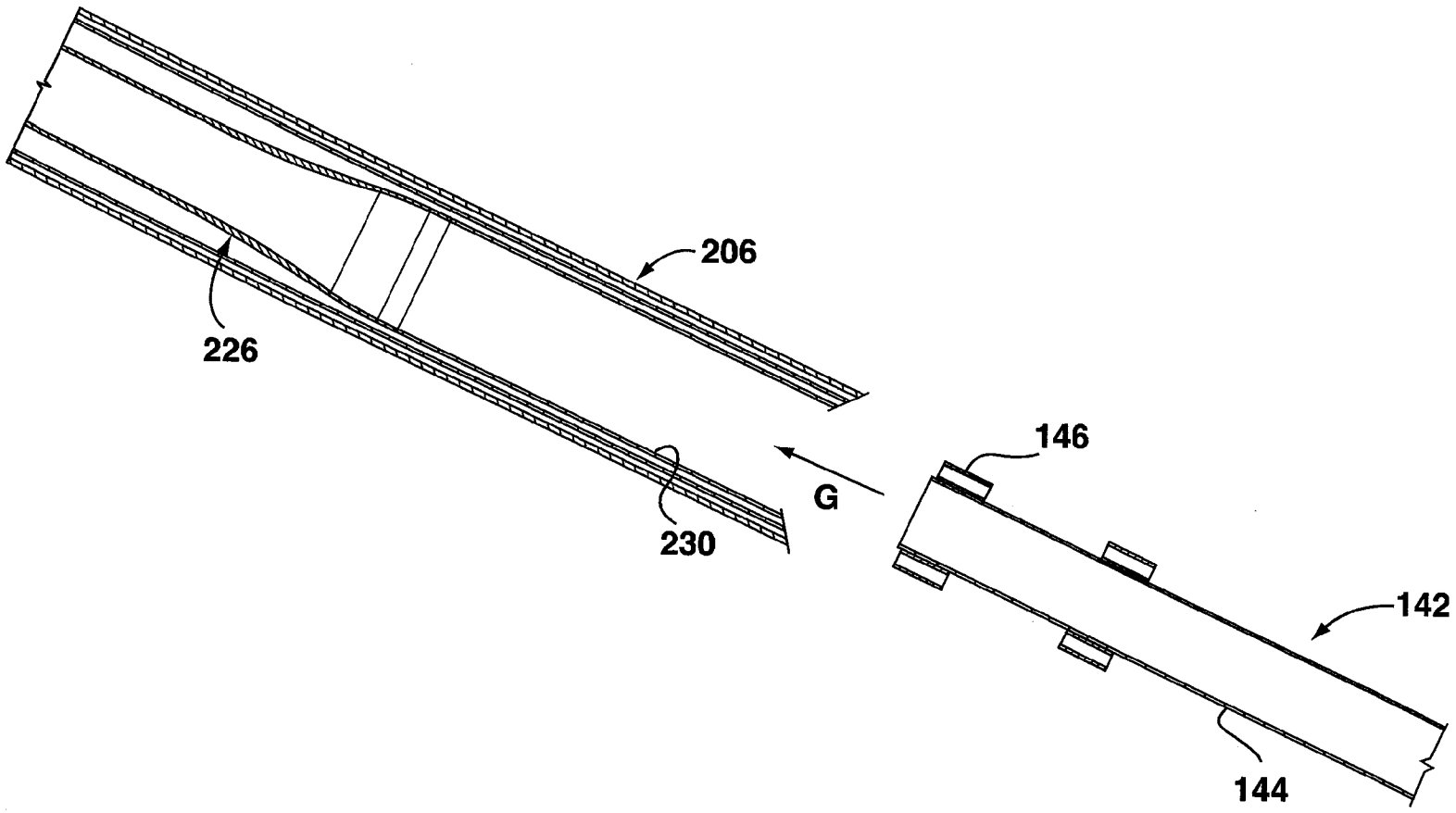
FIG. 7C is an illustration of a third step of the method of FIG. 7A.
Figure 7D:
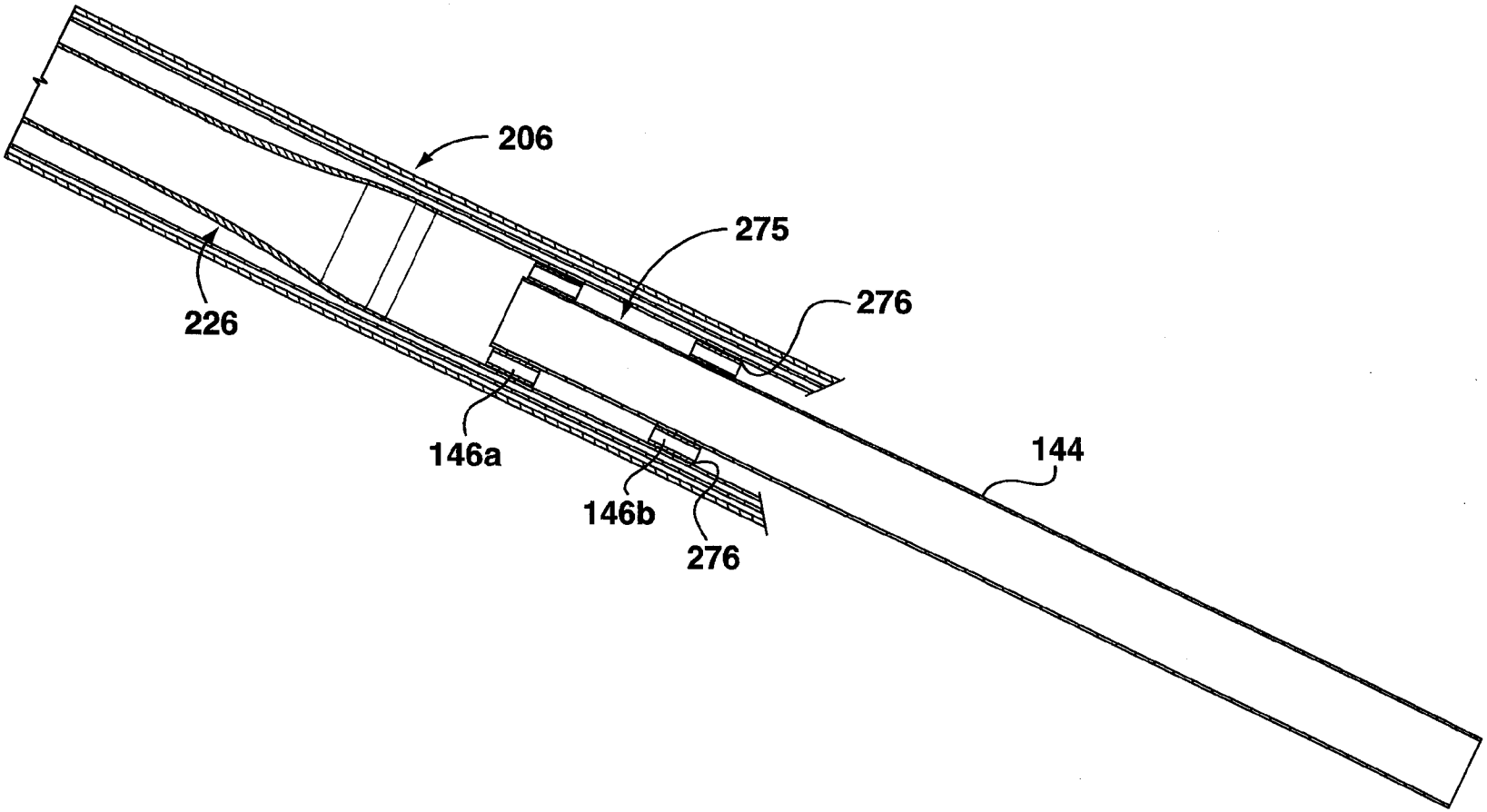
FIG. 7D is an illustration of a fourth step of the method of FIG. 7A.

In FIG. 7C, the next step is shown. In this step, the internal support assembly 142 is moved into the upper cut portion 206, in the direction indicated by arrow "G" in FIG. 7C. The internal support assembly 142 preferably is formed so that the collars 146 are slidingly receivable in the downstream portion 230 of the upper inner tube 226.

Once a predetermined portion 275 of the internal support assembly 142 is positioned in the downstream portion 230 of the upper inner tube 226, one of the collars 146 is attached to the upper inner tube 226. For example, it is preferred that the collar 146*b* is welded to the upper inner tube 226, at the location identified by reference numeral 276 in FIG. 7D.

Figure 7E:
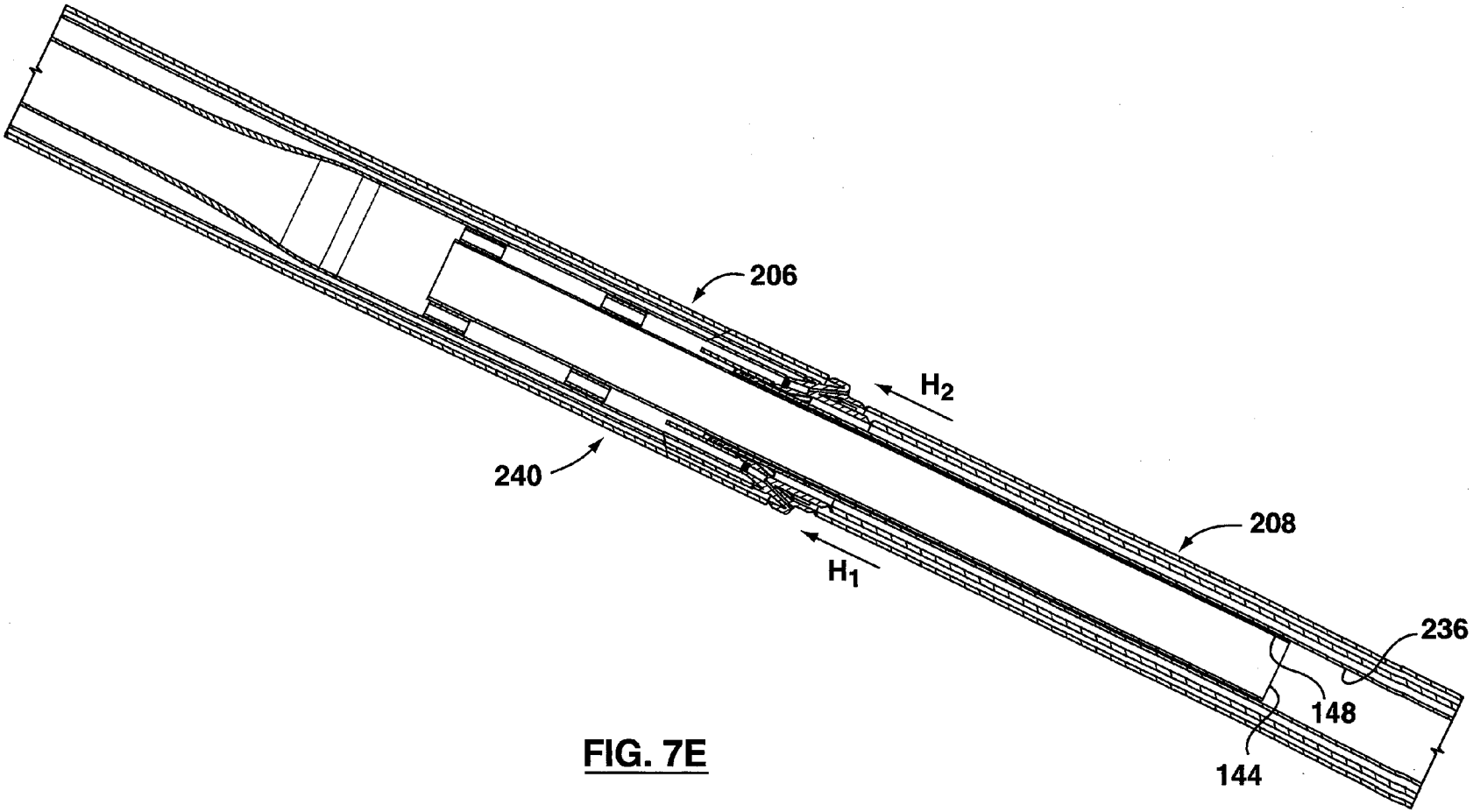
FIG. 7E is an illustration of a fifth step of the method of FIG. 7A.

In FIG. 7E, the lower cut portion 208 (or a replacement thereof, as described below) is slidingly engaged with the internal tube 144 as the lower cut portion 208 is moved in the direction indicated by arrows "H" in FIG. 7E. As can be seen in FIG. 7E, the lower inner tube 236 in the lower cut portion 208 is slidingly engaged with the downstream portion 148 of the internal tube 144 as the lower cut portion 208 is moved in the direction indicated by arrows "H1" and "H2". Once the lower cut portion 208 abuts the upper cut portion 206, the lower cut portion 208 is in position.

Finally, the lower cut portion 208 is attached to the upper cut portion 206 of the lance body 220, using any suitable means. For instance, the lower cut portion 208 may be welded to the upper cut portion 206. The result is a post-combustion lance 240 of the invention, as shown in FIG. 7E.

Those skilled in the art would appreciate that a new lower cut portion (i.e., rather than the lower cut portion which was removed) may be attached to the upper cut portion. Using a new portion may be preferable if, for example, the old portion was deformed.

Figure 3A:
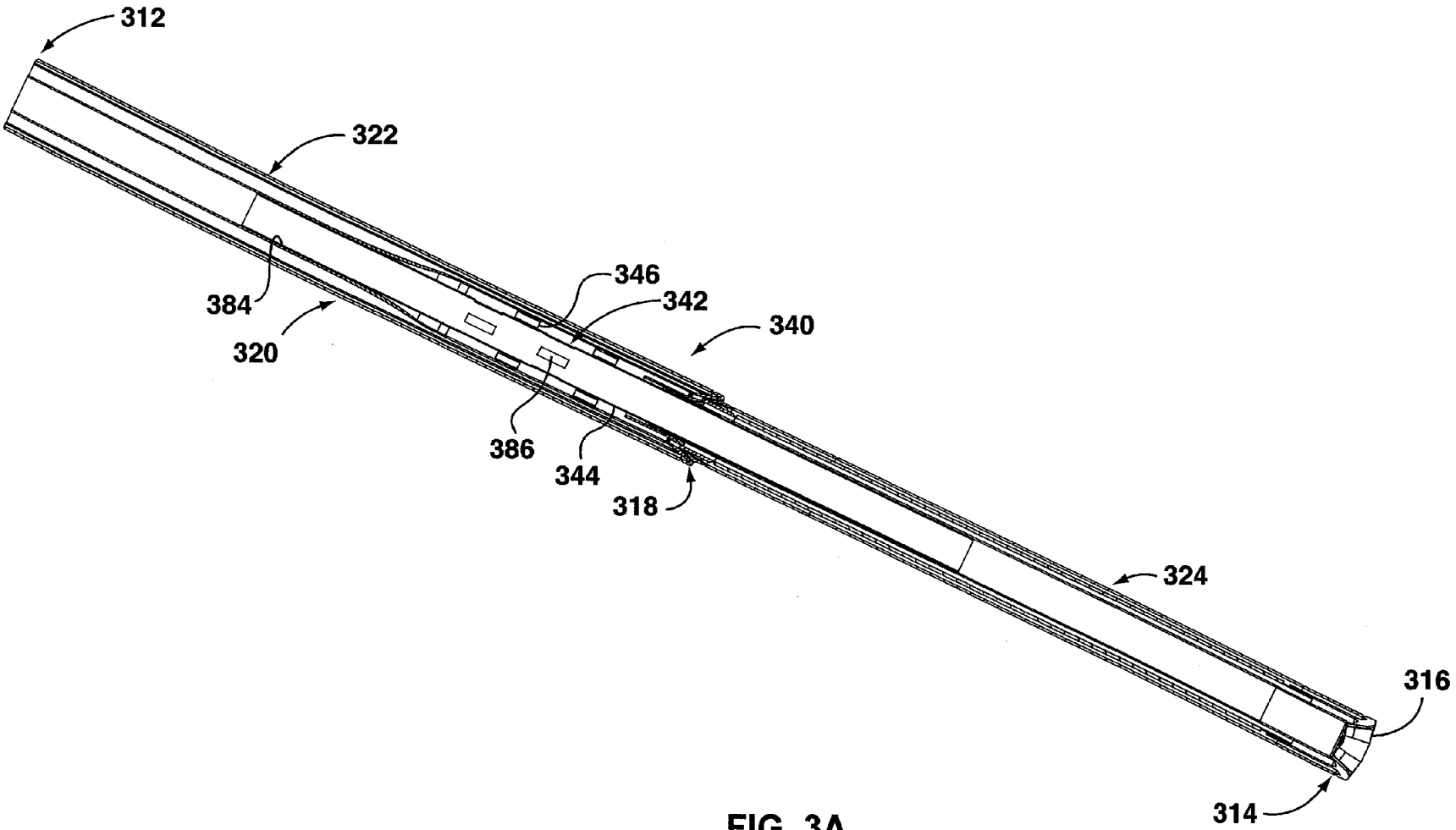
FIG. 3A is a cross-section of another embodiment of the post-combustion lance of the invention, drawn at a smaller scale.
Figure 3B:
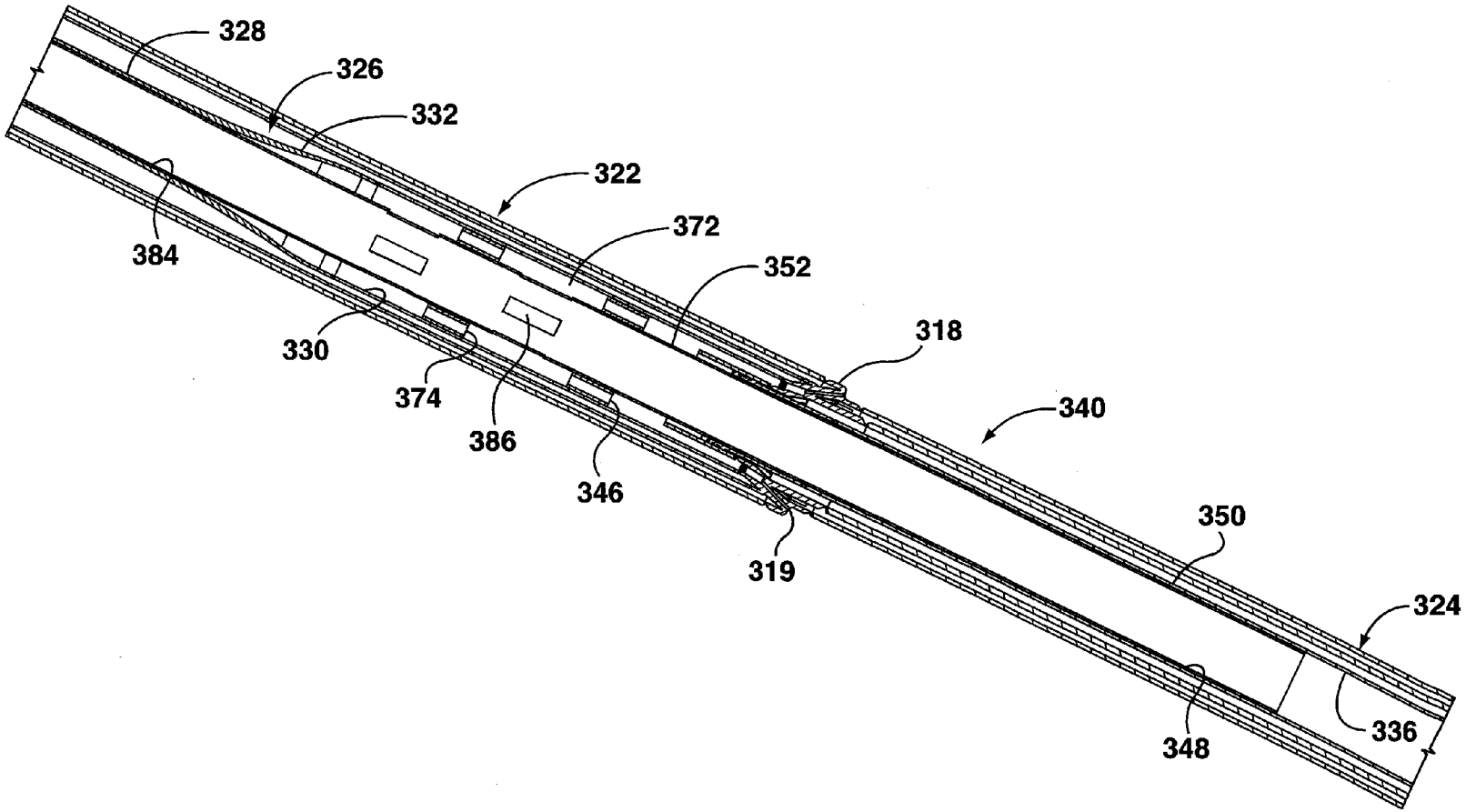
FIG. 3B is a cross-section of a portion of the post-combustion lance of FIG. 3A, drawn at a larger scale.
Figure 3C:
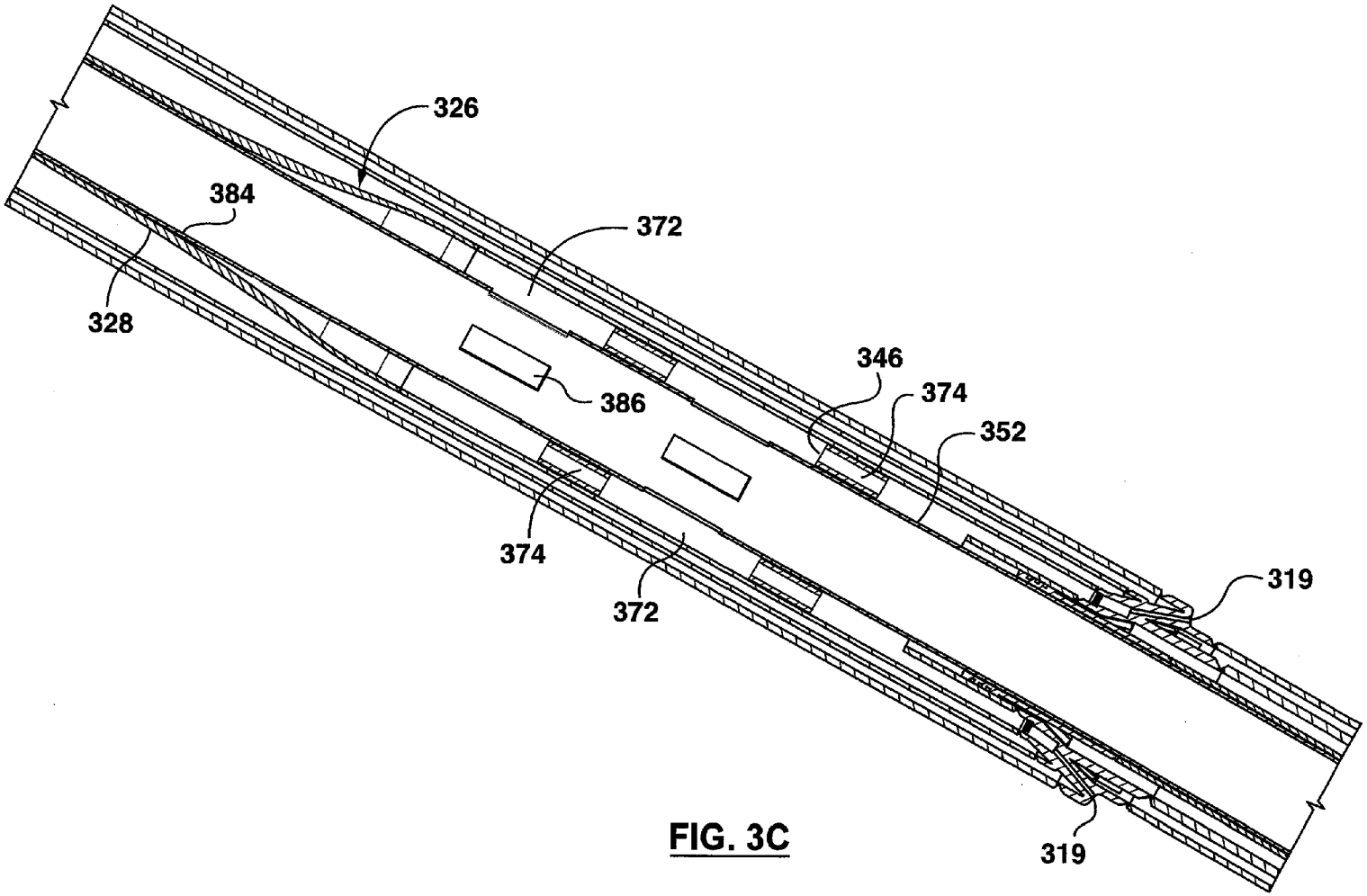
FIG. 3C is a cross-section of a portion of the post-combustion lance of FIG. 3B, drawn at a larger scale.

FIGS. 3A-3C disclose another embodiment of the post-combustion lance 340 of the invention in which an internal support assembly 342 includes an internal tube 344 which preferably has an upstream portion 384 engaged with the upstream portion 328 of the upper inner tube 326. Preferably, the internal tube 344 additionally includes one or more apertures 386 positioned at least partially upstream relative to the distributor 118 to permit the second part of the gas to flow to an annulus 372 from the upstream portion of the upper inner tube 326.

As can be seen in FIG. 3A, the post-combustion lance 340 includes a body 320 extending between an upstream end 312 and a downstream end 314. Gas is receivable at the upstream end, and a first part of the gas exits the lance 340 via a primary tip 316 positioned at the downstream end 314. A distributor 318 mounted between the upstream and downstream ends 312, 314 is positioned between upper and lower portions 322, 324 of the body.

The upstream portion 384 of the internal tube 344 preferably extends further in an upstream direction (i.e., upstream beyond the downstream portion 330 and the connecting portion 332 of the upper inner tube 326) to engage the upstream portion 328 of the upper inner tube 326. The advantage of this embodiment (as compared to the lance 140, described above) is that it provides an additional area of engagement (i.e., as compared to lances 140 and 240) between the internal tube and the upper inner tube. In one embodiment, the collars 346 are positioned between the internal tube 344 and the upper inner tube 326. Because the upper inner tube 326 is secured to the upper portion 322, this means that the internal tube 344 is indirectly connected with the upper portion 322 via the collars 346, and also via the engagement of the upstream portion 384 of the internal tube 344 with the upstream portion 328 of the upper inner tube 326. A downstream portion 348 of the internal tube 344 is also engaged with an upstream portion 350 of the lower inner tube 336. Accordingly, the internal support assembly 342 resists deflection of the body 320.

Preferably, the upstream portion 384 of the internal tube 344 is slidingly engaged with the upstream portion 328, and the downstream portion 348 of the internal tube 344 is slidingly engaged with the upstream portion 350 of the lower inner tube 336.

As shown in FIGS. 3A-3C, because of the engagement of the upstream portion 384 of the internal tube 344 with the upstream portion 328 of the upper inner tube 326, the apertures 386 are provided in the internal tube 344. An annulus 372 is defined between an outer wall 352 of the internal tube 344 and the connecting and downstream portions 332, 330 of the upper inner tube 326. The annulus 372 is in fluid communication with the ports 319 via apertures 374 in the collars 346.

Figure 4A:
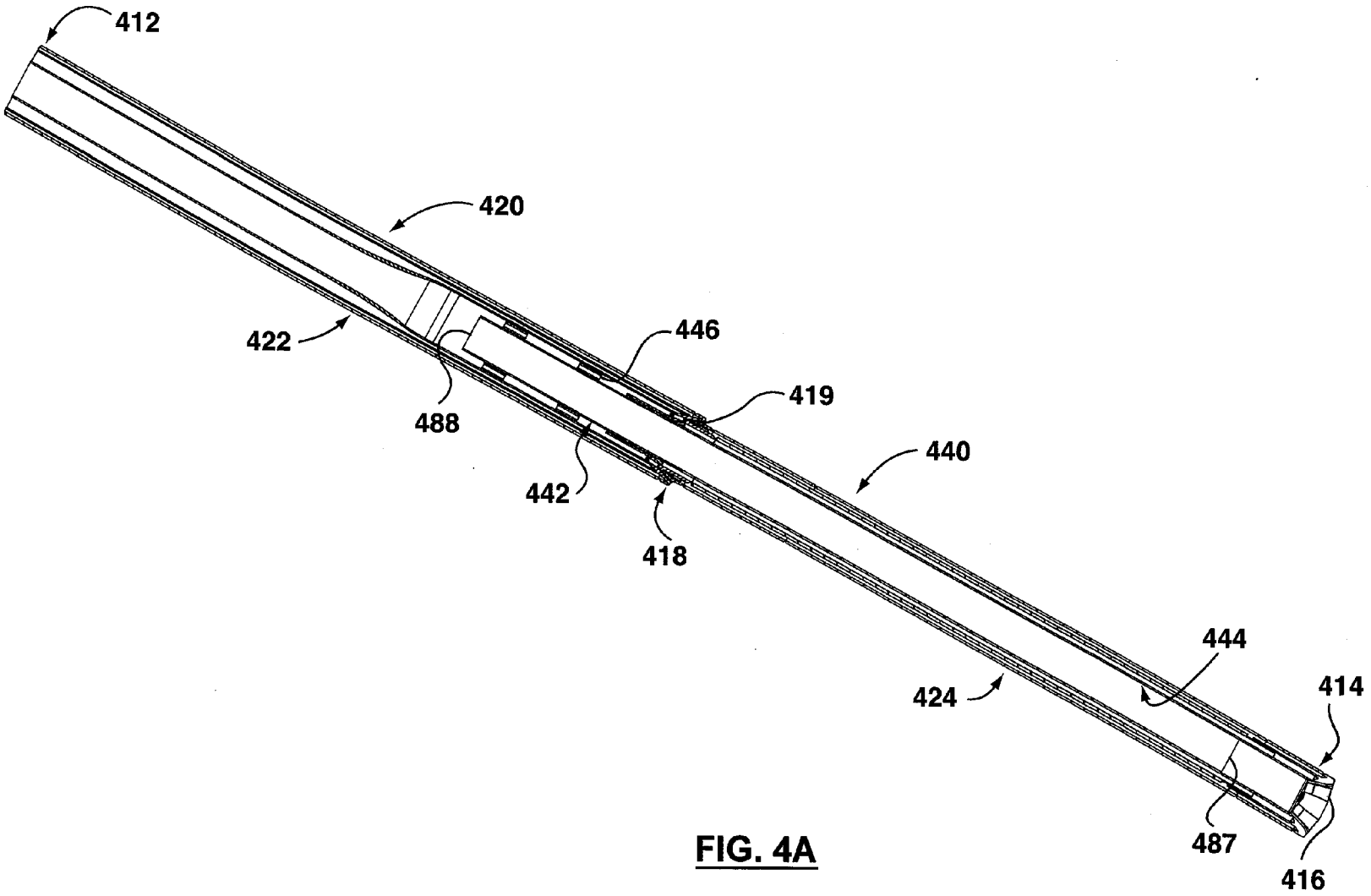
FIG. 4A is a cross-section of another embodiment of the post-combustion lance of the invention, drawn at a smaller scale.
Figure 4B:
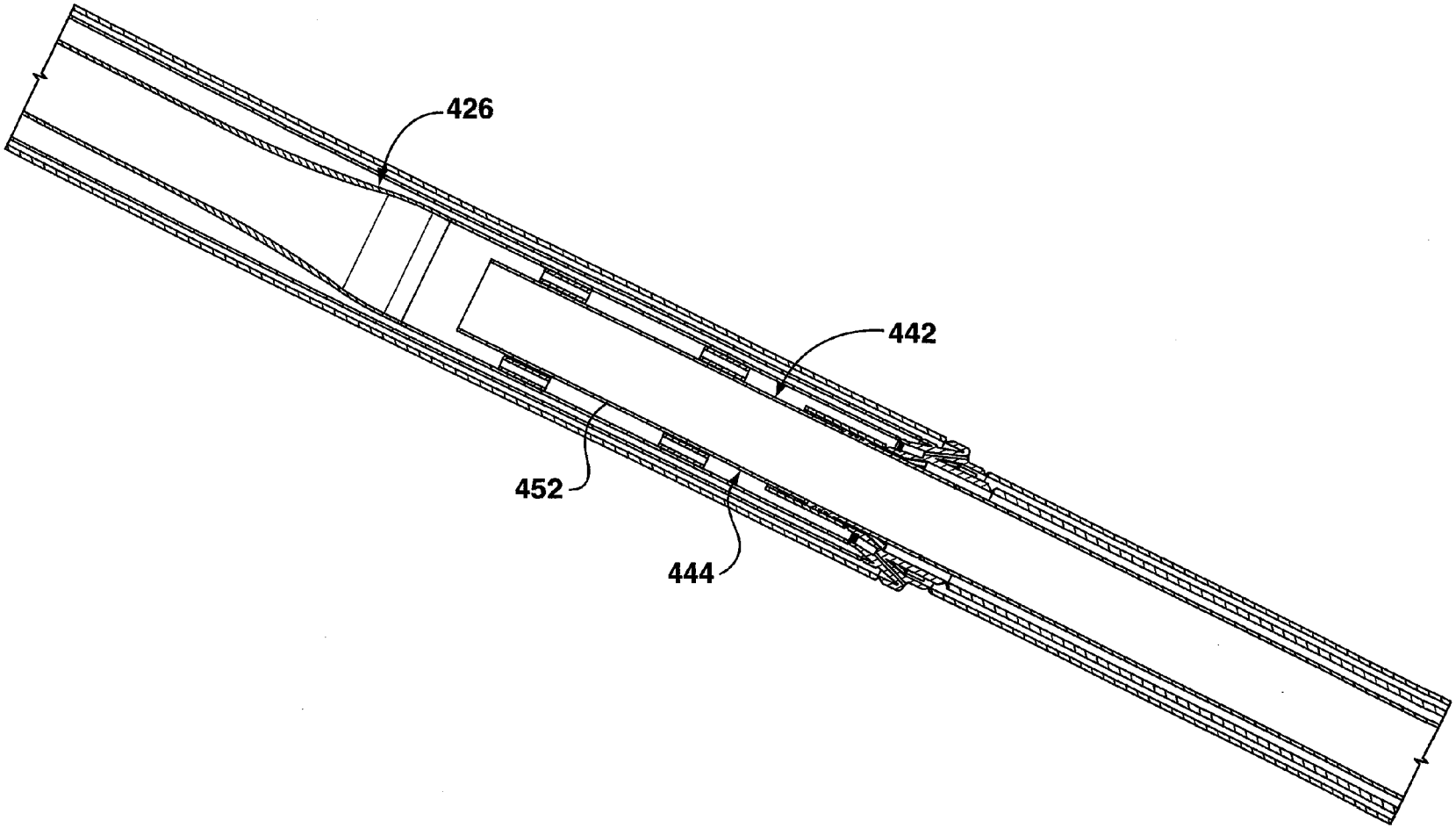
FIG. 4B is a cross-section of a portion of the post-combustion lance of FIG. 4A, drawn at a smaller scale.
Figure 4C:
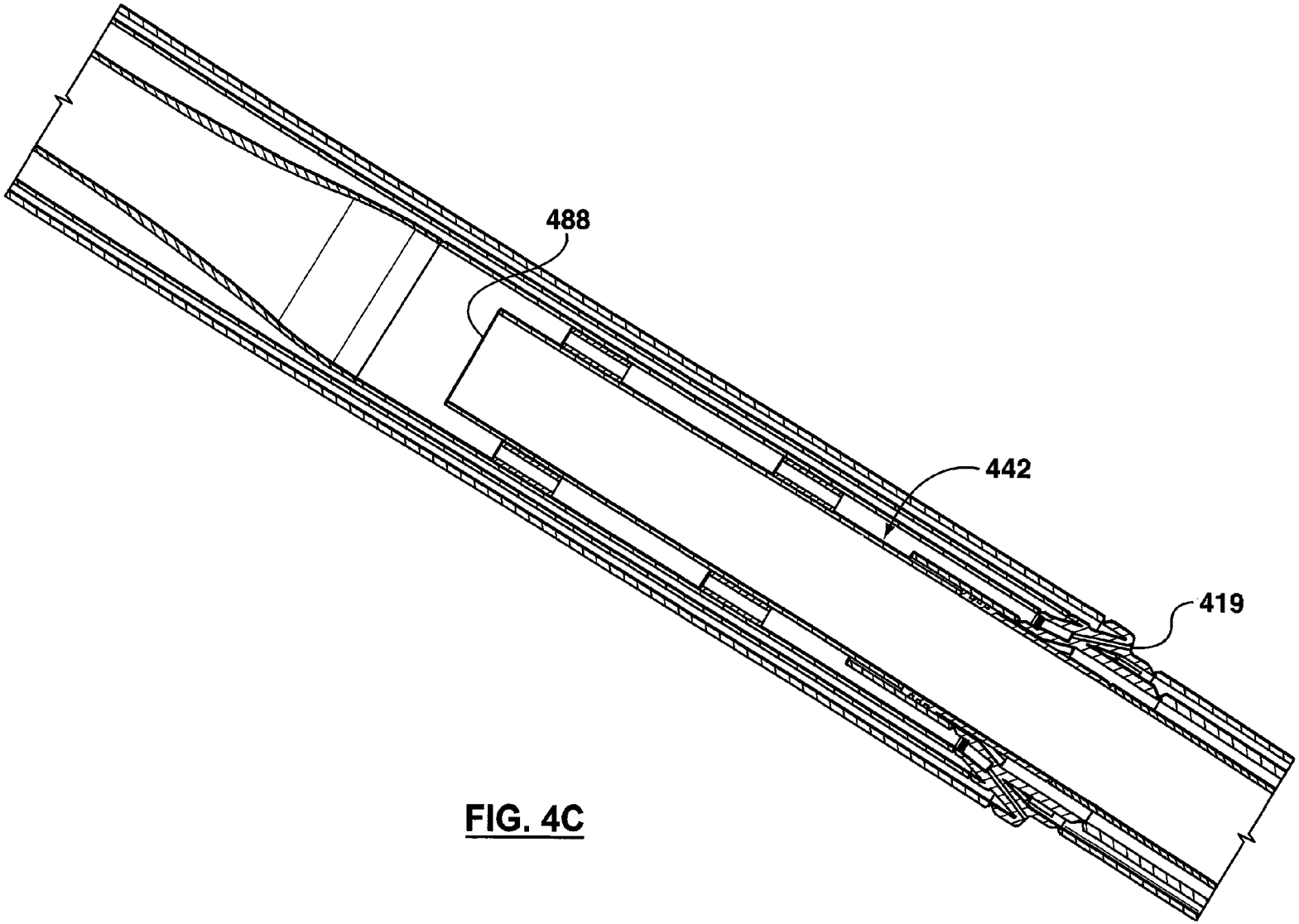
FIG. 4C is a cross-section of a portion of the post-combustion lance of FIG. 4B, drawn at a larger scale.

Another embodiment of the post-combustion lance 440 of the invention is disclosed in FIGS. 4A-4C. The post-combustion lance 440 includes a body 420 extending between an upstream end 412 and a downstream end 414 of the lance 440, the upstream end 412 being adapted to receive the gas. The downstream end 414 includes a primary tip 416 through which a first part of the gas exits the lance 440. The body 420 includes upper and lower portions 422, 424 and a post-combustion distributor 418 mounted therebetween at a predetermined distance from the primary tip 416. The lance 440 preferably also includes an upper inner tube 426 positioned at least partially upstream from the distributor 418 (FIG. 4B) and attached to the upper portion 422. In addition, the lance 440 includes an internal support assembly 442 for supporting the body 420 (FIGS. 4A-4C). In one embodiment, the internal support assembly 442 includes an internal tube 444 extending between a downstream end 487 thereof positioned proximal to the downstream end 414 of the lance 440, and to an upstream end 488 of the internal tube 444 positioned at least partially upstream relative to the ports 419 of the distributor 418. Preferably, the internal support assembly 442 additionally includes one or more collars 446 secured to the internal tube 444 and positioned between the upper inner tube 426 and the internal tube 444, to support the internal tube 444 in a predetermined position substantially coaxial with the upper inner tube 426 so that the internal tube 444 resists deflection of the body 420.

As can be seen in FIGS. 4B and 4C, the lance 440 does not include a lower inner tube in which a downstream portion of the internal tube 444 is slidingly engageable. The internal tube 444 preferably is mounted to the lower portion 424 at the downstream end 487 of the internal tube 444, using any suitable means. For example, the internal tube 444 may be welded to the lower portion 424 at any suitable location(s) thereon, i.e., the internal tube 444 may be welded to the lower portion 424 at the downstream end 487.

Figure 5A:
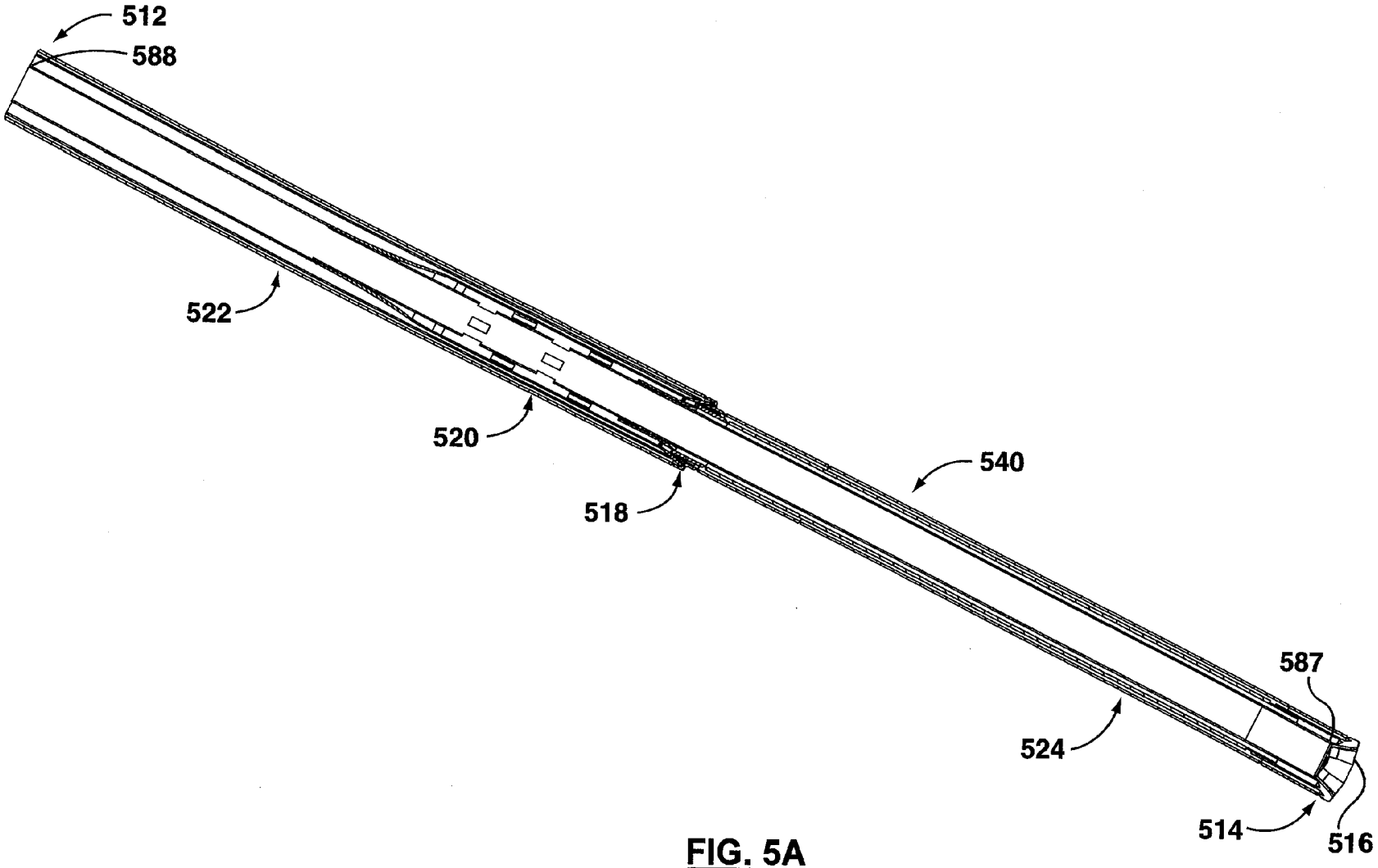
FIG. 5A is a cross-section of another embodiment of the post-combustion lance of the invention, drawn at a smaller scale.
Figure 5B:
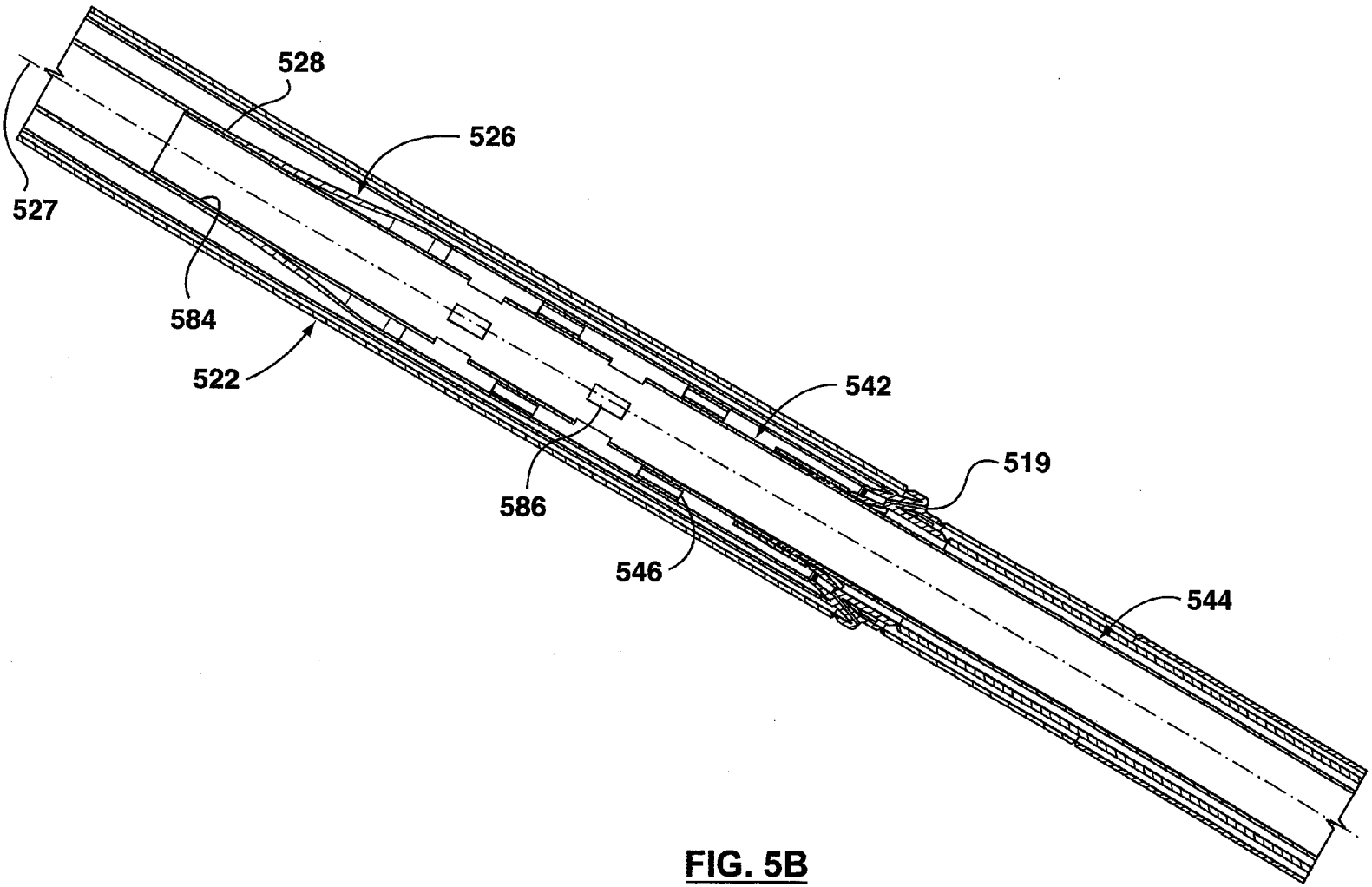
FIG. 5B is a cross-section of a portion of the post-combustion lance of FIG. 5A, drawn at a larger scale.
Figure 5C:
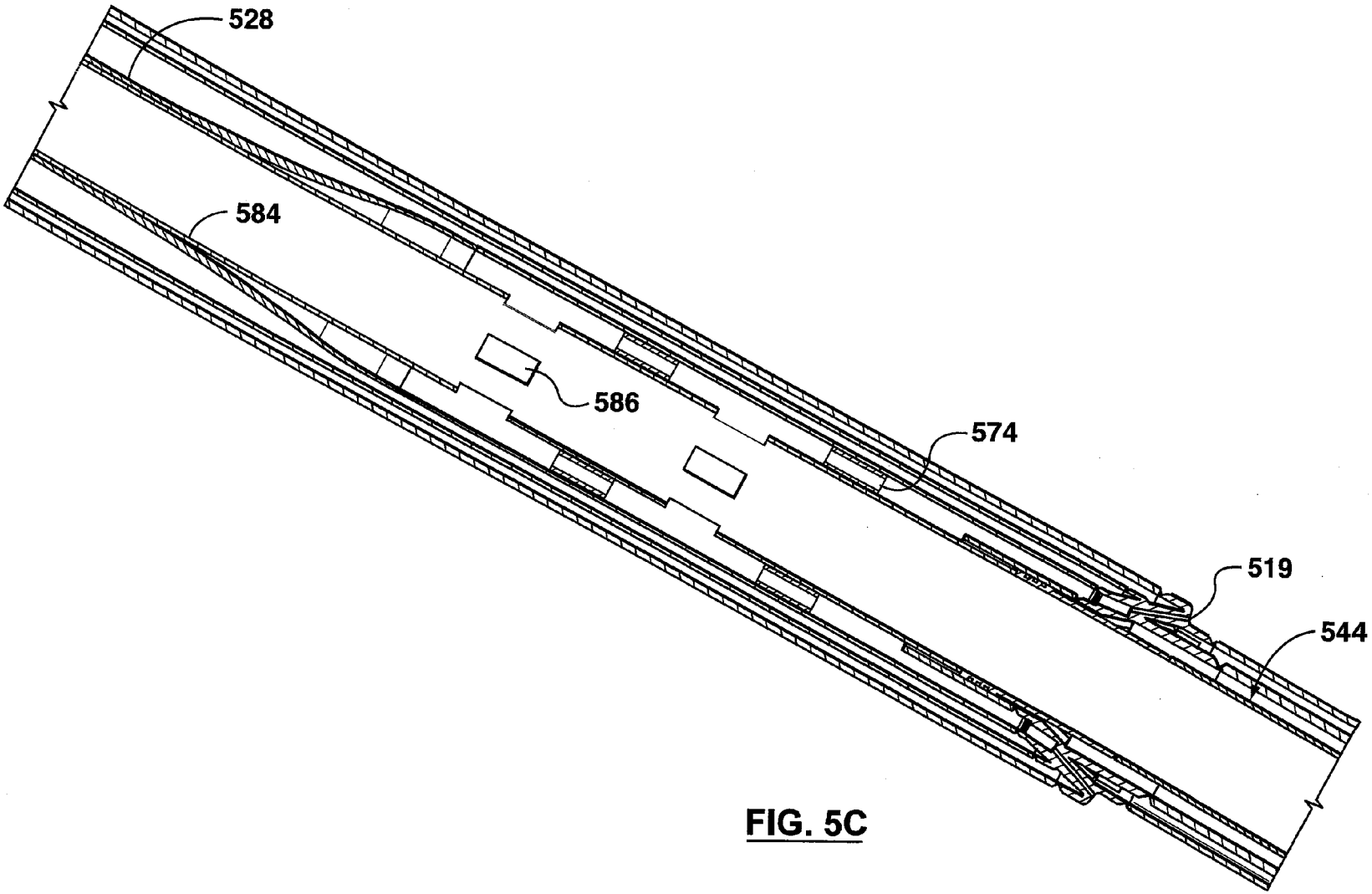
FIG. 5C is a cross-section of a portion of the post-combustion lance of FIG. 5B, drawn at a larger scale.

In FIGS. 5A-5C, another embodiment of the post-combustion lance 540 of the invention is shown. The post-combustion lance 540 includes a body 520 extending between an upstream end 512 and a downstream end 514 of the lance 540, the upstream end 512 being adapted to receive the gas. The downstream end 514 includes a primary tip 516 through which a first part of the gas exits the lance 540. The body 520 includes upper and lower portions 522, 524 and a post-combustion distributor 518 mounted therebetween at a predetermined distance from the primary tip 516. The lance 540 preferably also includes an upper inner tube 526 positioned at least partially upstream from the distributor 518 (FIG. 5B) and attached to the upper portion 522. In addition, the lance 540 includes an internal support assembly 542 for supporting the body 520. In one embodiment, the internal support assembly 542 includes an internal tube 544 extending between a downstream end 587 thereof positioned proximal to the downstream end 514 of the lance 540, and to an upstream end 588 of the internal tube 444.

As can be seen in FIGS. 5A-5C, in one embodiment, an upstream portion 584 preferably is engaged with an upstream portion 528 of the upper inner tube 526. Preferably, the internal support assembly 542 additionally includes one or more collars 546 secured to the internal tube 544 and positioned between the upper inner tube 526 and the internal tube 544, to support the internal tube 544 in a predetermined position substantially coaxial with the body 520 so that the internal tube 544 resists deflection of the body 520. The lance 540 does not include a lower inner tube in which a downstream portion of the internal tube 544 is slidingly engageable. The internal tube 544 preferably is engaged to the lower portion 524 of the internal tube 544, using any suitable means.

As shown in FIGS. 5A-5C, the internal tube 544 preferably also includes one or more apertures 586. The internal tube 544 is positioned in the body 520 so that the apertures 586 are at least partially upstream relative to the ports 519 in the distributor 518.

Figure 8A:
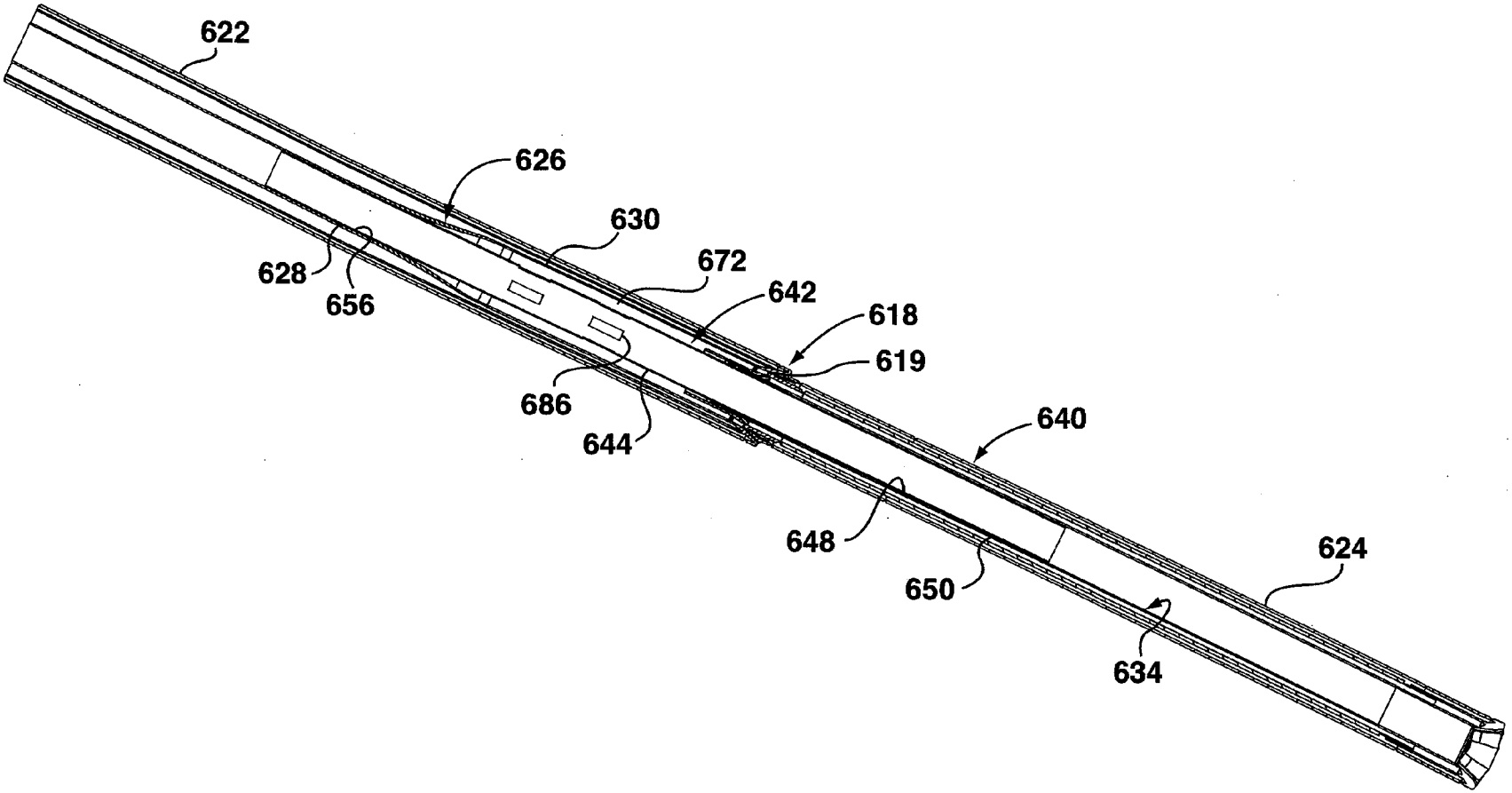
FIG. 8A is a cross-section of another embodiment of the lance of the invention.

Another alternative embodiment of the post-combustion lance 640 of the invention is disclosed in FIG. 8A. As can be seen in FIG. 8A, the lance 640 is similar to the lance 320 disclosed in FIGS. 3A-3C, except that the lance 640 does not include elements corresponding to the collars 346 in the lance 340.

In the lance 640, the internal support assembly 642 includes the internal tube 644, but does not include collars. As can be seen in FIG. 8A, the internal tube 644 includes an upstream portion 656 which is engaged in the upstream portion 628 of the upper inner tube 626. Similarly, a downstream portion 648 of the internal tube 644 is engaged with an upstream portion 650 of the lower inner tube 634. In this embodiment, the internal tube is secured to either the upper inner tube 626 or the lower inner tube 634, or both, in order to maintain the internal tube 644 in position. The internal tube 644 supports the body 620 of the lance, because the internal tube 644 is engaged with each of the upper inner tube 626 and the lower inner tube 634, at the internal tube's upstream and downstream portions 656, 648 respectively. An annulus 672 in fluid communication with the ports 619 of the distributor 618 is defined between the internal tube 644 and the downstream portion 630 of the upper inner tube 626. The internal tube 644 includes apertures 686 to permit the second part of the gas to flow from the upstream portion 628 of the upper inner tube 626 to the annulus 672.

Figure 8B:
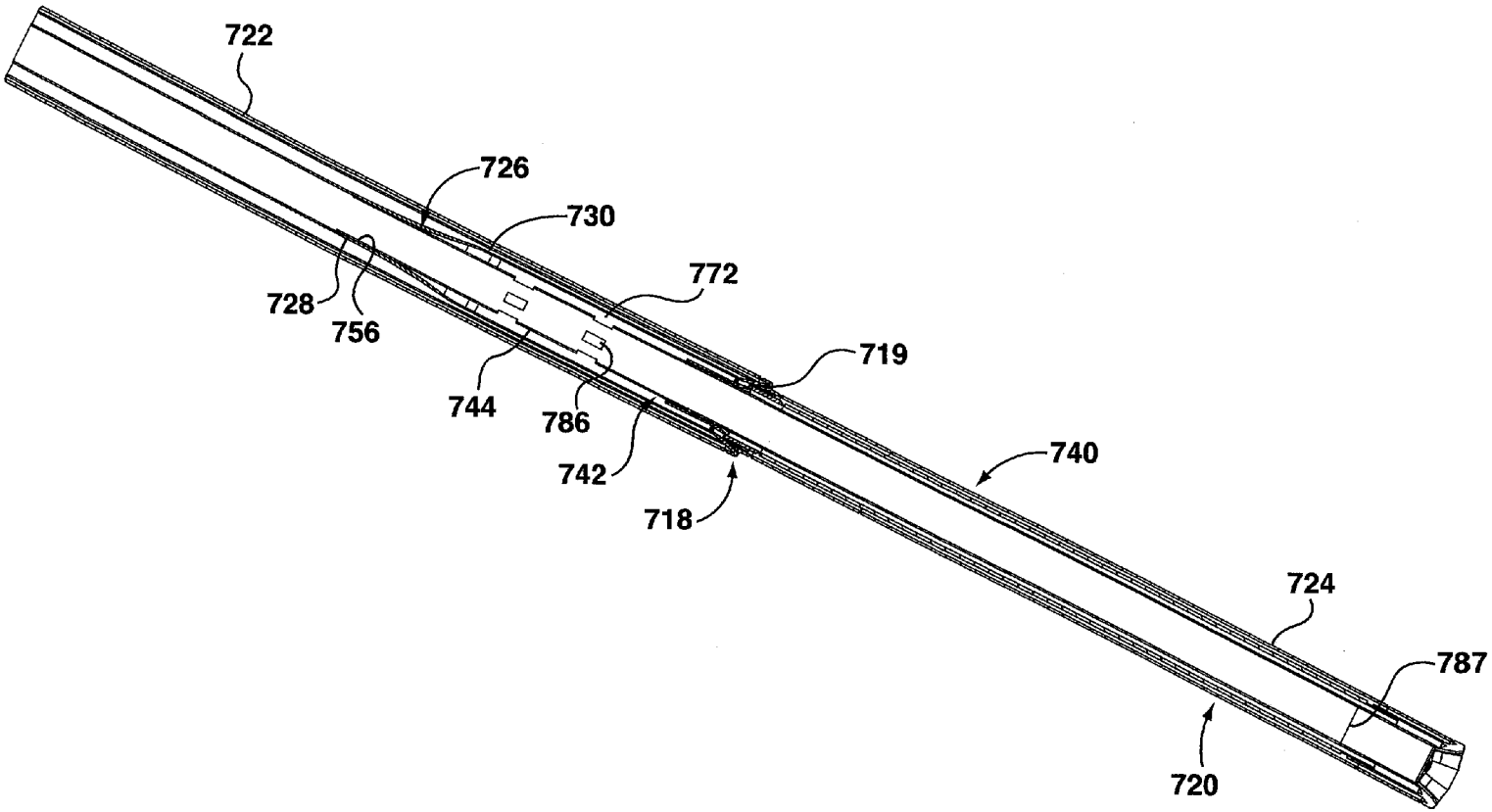
FIG. 8B is a cross-section of another alternative embodiment of the lance of the invention.

Another alternative embodiment of the post-combustion lance 740 of the invention is disclosed in FIG. 8B. The lance 740 is similar to the lance 640, except that the lance 740 does not include an element corresponding to the lower inner tube of the lance 640. The internal tube 744 includes a downstream end 787 which is secured to the lower portion 724 of the lance body 720 by any suitable means. The internal tube 744 also includes an upstream portion 756 which is engaged with an upstream portion 728 of the upper inner tube 726. Accordingly, the internal tube 744 supports the body 720.

An annulus 772 in fluid communication with the ports 719 of the distributor 718 is defined between the internal tube 744 and a downstream portion 730 of the upper inner tube 726. The internal tube 744 includes apertures 786 to permit the second part of the gas to flow from the upstream portion 728 to the annulus 772 which is defined between the internal tube 744 and a downstream portion 730 of the upper inner tube 726.

Figure 9A:
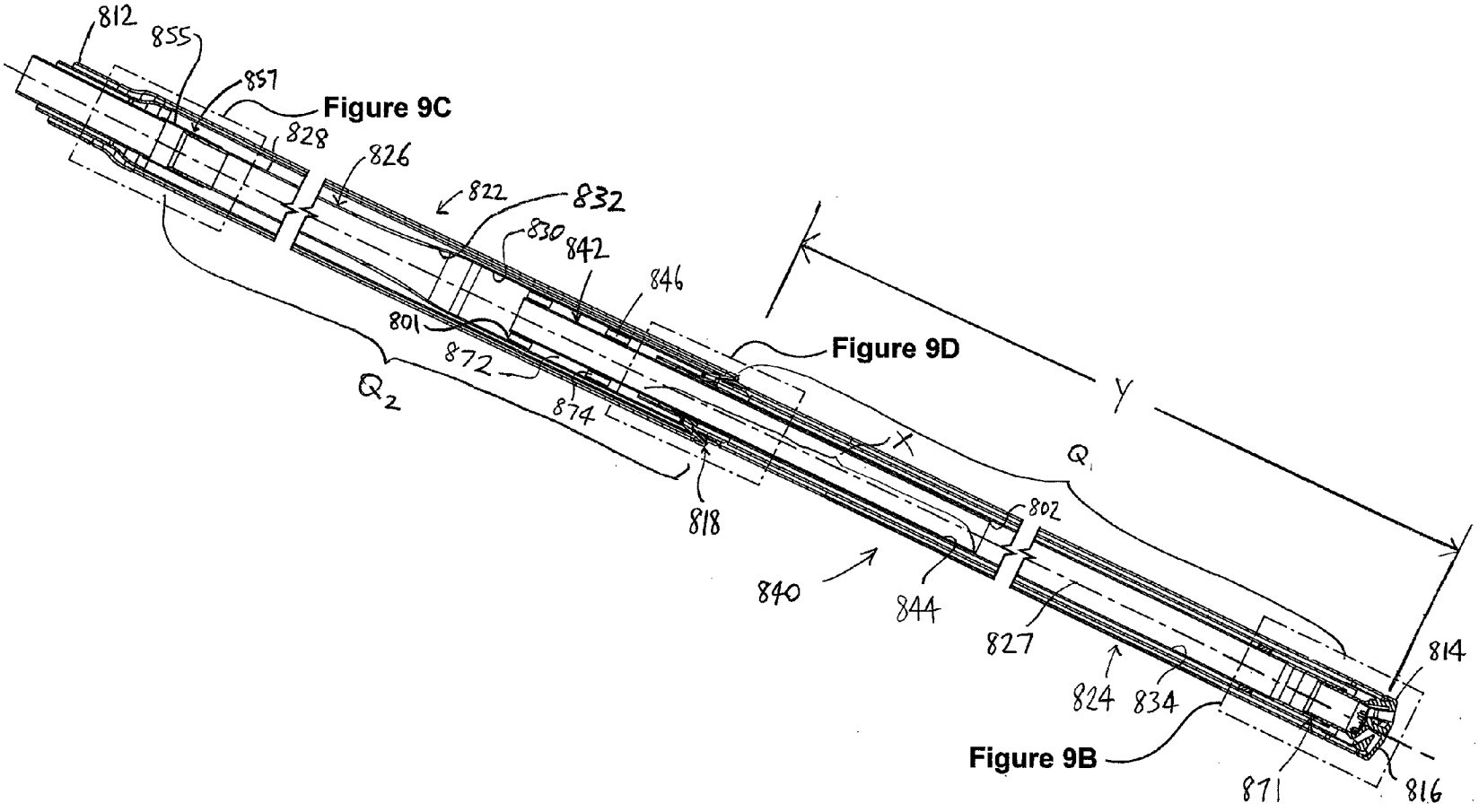
FIG. 9A is a cross-section of another embodiment of the lance of the invention, drawn at a smaller scale.

Another alternative embodiment of the post-combustion lance 840 of the invention is illustrated in FIGS. 9A-9D. The post-combustion lance 840 is for directing a gas at least partially therethrough. As can be seen in FIG. 9A, the post-combustion lance 840 preferably includes a body 820 extending between an upstream end 812 and a downstream end 814 of the lance 840. The downstream end 814 preferably has a primary tip 816, through which a first part of the gas exits the lance. It is also preferred that the body 820 includes upper and lower portions 822, 824, and a post-combustion distributor 818 mounted between the upper and lower portions 822, 824 at a predetermined distance "Y" from the primary tip 816. The distributor includes a number of ports 819 (FIG. 9D) through which a second part of the gas exits the lance. As can be seen in FIG. 9A, the upper and lower portions 822, 824 are located upstream and downstream respectively relative to the distributor 818. Preferably, the lance 840 also includes an internal support assembly 842 for supporting the body 820. The internal support assembly 842 preferably includes an internal tube 844 positioned inside the body 820 and at least partially engaged with the lower portion 824 thereof. The internal support assembly 842 preferably is at least partially engaged with the upper portion 822 of the body, so that the internal support assembly 842 supports the body 820 both upstream and downstream relative to the distributor 818, as will be described. In one embodiment, the lance 840 preferably also includes a lower o-ring gland 871 positioned downstream relative to the distributor 818 to permit movement of at least part of the internal support assembly 842 and at least part of the body 820 relative to each other due to thermal expansion, and an upper o-ring gland 857 positioned upstream relative to the lower o-ring gland 871, to permit movement of at least part of the internal support assembly 842 and at least part of the body 820 relative to each other due to thermal expansion.

For the purposes hereof, it will be understood that the terms "upstream" and "downstream" are to be understood as relative to the direction of flow of the gas through the lance, i.e., such flow generally being from the upstream end toward the downstream end of the lance.

As can be seen in FIG. 9A, the body 820 preferably is at least partially defined by an axis 827 thereof. As noted above, the body 820 extends between the upstream and downstream ends 812, 814 of the lance 840. The upstream end 812 is adapted to receive the gas, and the downstream end 814 preferably includes the primary tip 816, through which the first part of the gas exits the lance 840, as will be described. The body 820 preferably includes the upper and lower portions 822, 824 and the post-combustion distributor 818 mounted therebetween at the predetermined distance from the primary tip 816. As can be seen in FIGS. 9A and 9D, the body 820 preferably also includes an upper inner tube 826 positioned at least partially upstream from the distributor 818, a lower inner tube 834 positioned at least partially downstream from the distributor 818, and a connecting tube 855 for directing the gas to the upper portion 822. Preferably, the lance 840 also includes the internal support assembly 842 for supporting the body 820, the internal support assembly 842 having the internal tube 844 positioned inside the body 820 and engaged with at least a part of the lower inner tube 834. It is also preferred that the internal support assembly 842 includes one or more collars 846 positioned between the upper inner tube 826 and the internal tube 844, to support the internal tube 844 in a preselected position coaxial with the body 820 so that the internal tube 844 resists deflection of the body 820. As will be described, the collars 846 are positioned between the internal tube 844 and the upper portion 822, so that the internal support assembly 842 supports the body 820 both upstream and downstream relative to the distributor 818. In one embodiment, the internal support assembly 842 preferably also includes the lower o-ring gland 871 positioned proximal to the lower portion 824, to permit movement of the internal tube 844 and the primary tip 816 relative to each other due to thermal expansion at least partially in an axial direction substantially parallel to the axis 827, and the upper o-ring gland 857 positioned proximal to the upper portion 822, to permit movement of the upper inner tube 826 and the connecting tube 855 relative to each other due to thermal expansion at least partially in the axial direction. Preferably, the collars 846 include apertures 874 therein to permit the gas to flow therethrough.

As described above, the upper portion 822 is located upstream from the distributor 818, and the lower portion 824 is located downstream from the distributor 818. Certain elements of the body may not necessarily be located entirely in the upper portion, or entirely in the lower portion. It can be seen in FIG. 9A that the upper inner tube 826 is located at least partially in the upper portion 824, and the lower inner tube 834 is located at least partially in the lower portion 824.

Figure 9B:
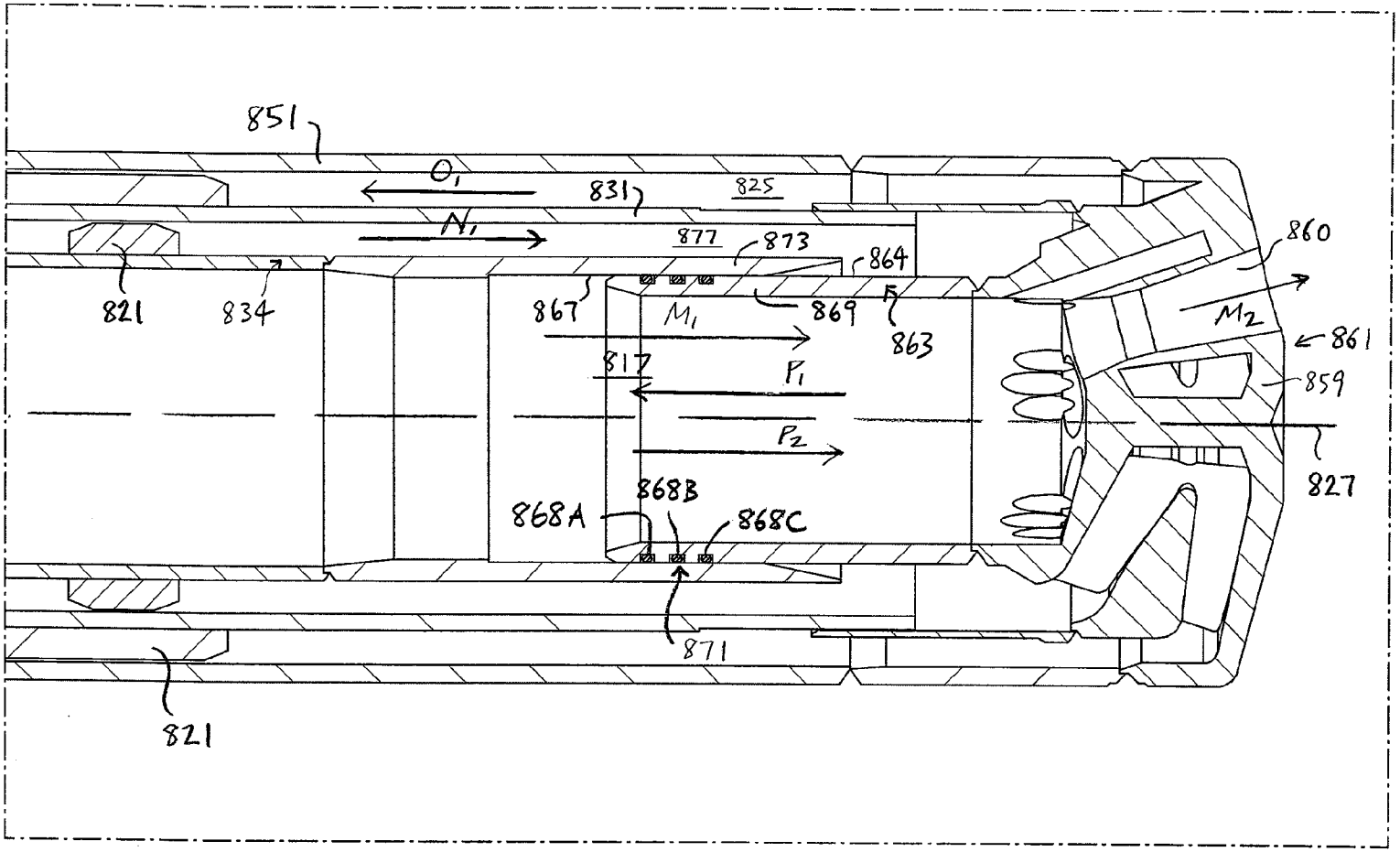
FIG. 9B is a cross-section of a portion of the lance of FIG. 9A, drawn at a larger scale.

As can be seen in FIG. 9B, the primary tip 816 preferably includes a primary nozzle 859 with orifices 860 therein, through which the first part of the gas is directed. It is also preferred that the primary tip 816 includes a tip tube 863. Preferably, the nozzle 859 is secured to the tip tube 863, which is formed and positioned so that the tip tube portion 863 is slidably engaged with a downstream portion 848 of the internal tube 844. The tip tube 863 directs the first part of the gas to the primary tip 814, i.e., the tip tube 863 directs the first part of the gas to the nozzle 859. The tip tube 863 preferably is substantially coaxial with the body 820, and the internal tube 844, so that the internal tube and the tip tube provide a central channel 817 through which the first part of the gas is directed. The tip tube 863 and the lower inner tube 834 include respective engaged parts 869, 873 along which they are engaged. It is preferred that an exterior surface 864 of the tip tube 863 slidably engages an interior surface 867 of the lower inner tube 834 (FIG. 9B).

The positioning of the tip tube partially inside the lower inner tube 834 permits thermal expansion of the tip tube 863 and/or the lower inner tube 834 substantially in the axial direction, i.e., without imposing substantial stresses on those elements due to thermal expansion. Due to the generally axial movement of the engaged parts 869, 873, significant stress due to thermal expansion does not accrue in the tip tube 863 or in the lower inner tube 834.

In one embodiment, the lower o-ring gland 871 preferably is mounted on the tip tube exterior surface 864. Those skilled in the art will appreciate that the o-ring gland 871 preferably includes a number of o-rings, designated 868A-868C in FIG. 9B for convenience.

It will be understood that the lower o-ring gland 871 may include any suitable number of o-rings. Those skilled in the art will appreciate that the specific details of the o-rings and the o-ring gland will be determined, in each case, by taking into account a number of factors specific to a particular installation.

Those skilled in the art would appreciate that thermal expansion of the elements of the lance can be significant, and is taken into account when the lance is constructed. The temperatures in a converter, outside the lance, may be between about 1300° C. and about 1750° C. The lance preferably is cooled by water, as will be described. Accordingly, when the lance is introduced into the converter, it is heated rapidly, and the materials thereof expand accordingly. However, when the lance is removed, it is allowed to cool.

For the purposes hereof, it is understood that the term "thermal expansion" refers both to the expansion of a material due to an increase in its temperature and to the contraction of the material. As is well known in the art, because different materials in the lance have different thermal-expansion coefficients, they expand at different rates. In addition, due to the cooling effect of the water circulated through the lance (and the movement of the lance in and out of the converter), different parts of the lance are heated (or cooled, as the case may be) at different rates.

As can be seen, for example, in FIG. 9B, the first part of the gas (e.g., oxygen) is directed through the internal tube 844 and exits the lance via the orifice 860 of the nozzle 859. The direction of movement of the oxygen through the central channel 817 is indicated by arrows "$M_1$" and "$M_2$" in FIG. 9B. (It will be understood that only one orifice 860 is shown in FIG. 9B for clarity of illustration.) In one embodiment, the lance 840 preferably includes an outer cavity 825 (located between an exterior tube 851 and a lower intermediate element 831) and an inner cavity 877 (located between the lower intermediate element 831, on one side thereof, and the internal tube 844 and the tip tube 863, on the other side thereof). Those skilled in the art will appreciate that, to cool the lance 840, water is circulated through the inner and outer cavities 877, 825, as will be described. For instance, in one embodiment (illustrated in FIG. 9B), water is directed through the inner cavity 877 in the direction indicated by arrow "$N_1$", and the water is also directed through the outer cavity 825 generally in the direction indicated by arrow "$O_1$".

The thermal expansion of the components of the lance 840 results in relative movement of certain parts thereof substantially in the axial direction, i.e., substantially in a direction parallel to the axis 827 of the lance 840. For instance, when the lance 840 is initially positioned in the converter, although the lance 840 is rapidly heated, the temperature of the lower portion 824 initially increases more rapidly than the temperature of the upper portion 822. Due to differences in temperature at different parts of the lance and/or differences in materials, the engaged part 869 of the tip tube 863 moves relative to the engaged part 873 of the lower inner tube 834, and/or vice versa, i.e., because of thermal expansion. As can be seen in FIG. 9B, the relative movement of one of the engaged parts 869, 873 relative to the other (and/or of both of the engaged parts 869, 873 relative to each other, as the case may be) is in the axial direction. Such movement is schematically represented in FIG. 9B by arrows "$P_1$" and "$P_2$".

Those skilled in the art will appreciate that the lower o-ring gland 871 accommodates the axial movement of the engaged parts 869, 873 due to thermal expansion, but also provides a seal between the engaged parts 869, 873, to substantially prevent the water flowing through the inner cavity 877 from entering the central channel 817.

Figure 9C:
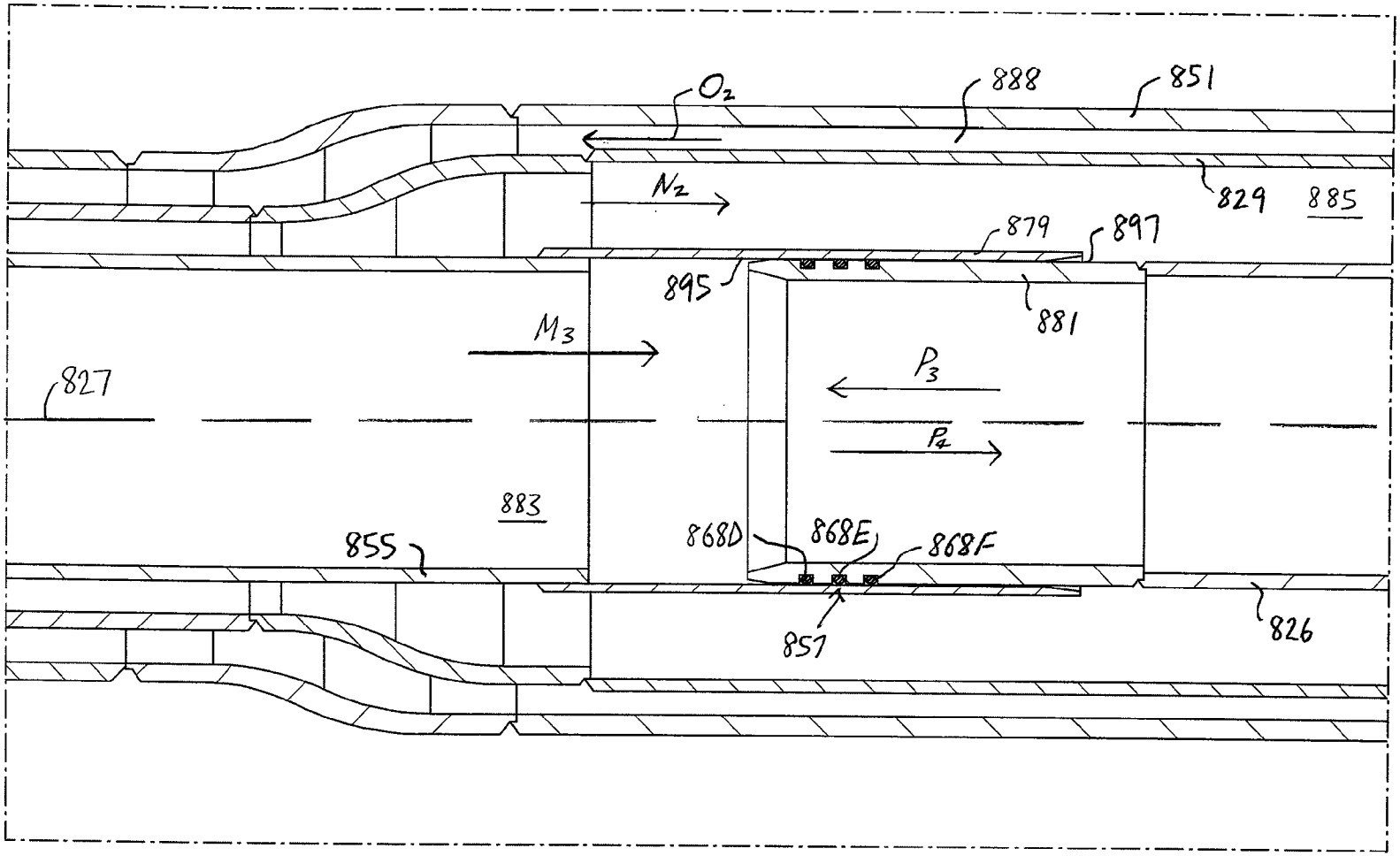
FIG. 9C is a cross-section of another portion of the lance of FIG. 9A.
Figure 9D:
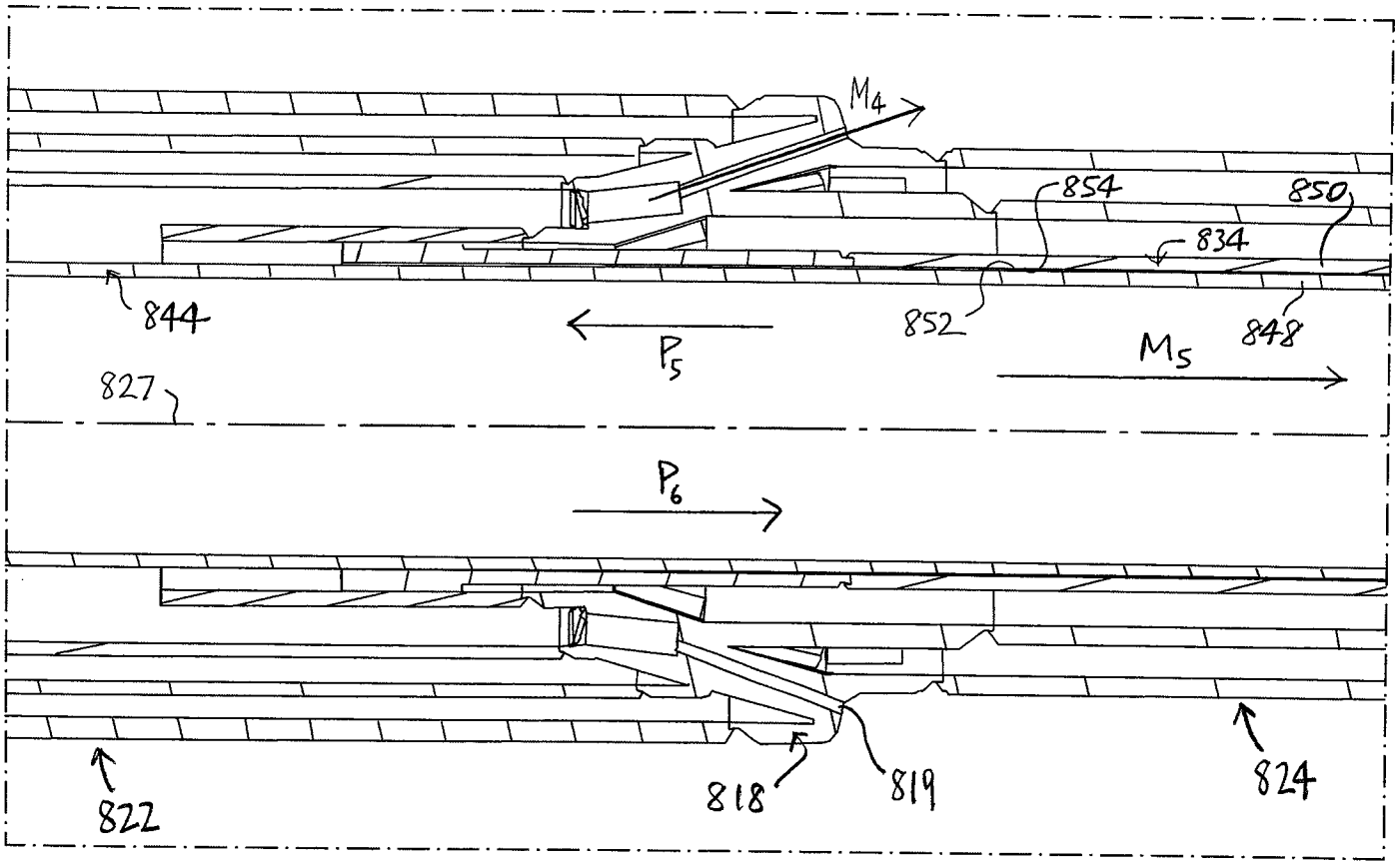
FIG. 9D is a cross-section of another portion of the lance of FIG. 9A.

The upper o-ring gland 857 is illustrated in FIG. 9C. The upper inner tube 826 is positioned coaxially with the axis 827 and with the connecting tube 855. As can be seen in FIG. 9C, the connecting tube 855 includes an engaged part 879 and the upper inner tube 826 includes an engaged part 881, and the engaged parts 879, 881 preferably are engageable with each other. In particular, it will be understood that the engaged parts 879, 881 are slidingly engageable with each other. The connecting tube 855 includes an interior surface 895, and the upper inner tube 826 includes an exterior surface 897. As indicated in FIG. 9C, the interior surface 895 and the exterior surface 897 preferably are slidingly engaged with each other. The oxygen flows in the lance along a central channel 883 defined by the connector tube 855 and the upper inner tube 826 as indicated by arrow "$M_3$".

The body of the lance 840 preferably also includes an upper intermediate element 829. An inner cavity 885 is located between and defined by the upper intermediate element 829, on one side thereof, and the connecting tube 855 and the upper inner tube 826, on the other side thereof. Similarly, an outer cavity 888 is located between the upper intermediate element 829 and the exterior tube 851. It will be understood that the inner cavity 885 of the upper portion is in fluid communication with the inner cavity 877 in the lower portion, and the outer cavity 888 of the upper portion is also in fluid communication with the outer cavity 825 in the lower portion. In FIG. 9C, the directions of flow of the water directed through the cavities, to cool the lance 840, are indicated by arrows "$N_2$" and "$O_2$".

As can also be seen in FIG. 9C, in one embodiment, the o-ring gland 857 preferably includes three o-rings, identified in FIG. 9C as 868D-868F. (It will be understood that the o-ring gland 857 may include any suitable number of o-rings.) The engaged parts 879, 881 are movable relative to each other in the axial direction, as indicated by arrows "$P_3$" and "$P_4$" in FIG. 9C. For the reasons described above, one or both of the engaged parts 879, 881 may move relative to the other, due to thermal expansion. The movement preferably is in the form of sliding engagement of the engaged parts 879, 881 with each other, i.e., one or both of the engaged parts slidingly engaging the other. The o-ring gland 857 permits such movement, and also provides a seal to substantially prevent water in the inner cavity 877 from leaking into the central channel 883.

As can be seen in FIG. 9D, the second part of the gas exits the lance 840 via the ports. In FIG. 9D, such flow of the second part of the gas is represented by arrows "$M_4$". The first part of the gas is represented by arrow "$M_5$".

From the foregoing, it can be seen that the body 820 includes substantially all of the lance 840, excluding the internal support assembly 842. For instance, the body 820 preferably includes the upper inner tube 826 and the lower inner tube 834, as well as the exterior tube 851, the distributor 818, the lower intermediate element 831, the tip tube 863, and the upper intermediate element 829. It will be understood that, in one embodiment, the exterior tube 851 preferably is not a continuous physical element extending between the upstream end and the downstream end of the lance 840, but instead is divided into two portions, i.e., one located upstream from the distributor 818, and the other located downstream relative thereto.

From the foregoing, it can be seen that, in the lance 840, the lower and upper o-ring glands 871, 857 are positioned at the lower and upper ends of the lance, i.e., the o-ring glands 871, 857 are positioned at predetermined distances $Q_1$, $Q_2$ (FIG. 9A) apart from the distributor 818. Also, and as can be seen in FIG. 9D, the lance 840 preferably does not include an o-ring gland positioned at, or proximal to, the distributor 818. The o-ring glands 871, 857 are positioned generally proximal to the lower and upper ends of the lance respectively, and in particular, the lance 840 does not include an o-ring gland proximal to the distributor.

In one embodiment, each of the collars 846 preferably is secured to the internal tube 844. Preferably, the collars 846 are secured to the internal tube 844 by any suitable means. As can be seen in FIG. 9A, the collars 846 preferably are located proximal to the upper portion. It is also preferred that each of the collars 846 is engageable with the upper inner tube. Preferably, the collars 846 are positioned relative to the upper inner tube 826 for sliding engagement therewith, i.e., permitting movement of the internal tube 844 and/or the upper inner tube 826 relative to each other, due to thermal expansion, in substantially the axial direction. At the same time, however, via the collars 846, the internal tube 844 supports the upper portion of the body so that the internal tube 844 resists deflection of the body 820.

As illustrated in FIG. 9A, and as described above, it is preferred that the internal tube 844 is engaged with the lower inner tube 834. A portion of the internal tube 844 preferably is positioned inside the lower inner tube 834 for slidable engagement therewith, i.e., to permit movement of the internal tube 844 and/or the lower inner tube 834 relative to each other due to thermal expansion. The lower inner tube 834 and the internal tube 844 are engaged along a length of the internal tube 844 identified for convenience as "X" in FIG. 9A. The movement of the internal tube 834 and/or the internal tube 844 relative to each other due to thermal expansion is substantially in the axial direction, i.e., in the directions indicated by arrows "$P_5$" and "$P_6$" in FIG. 9D.

In effect, the body 820 is supported above and below the distributor 818 by the internal support assembly 842. Also, and as can be seen in FIGS. 9A and 9D, the internal tube 844 also is partly located proximal to the distributor 818 (i.e., the internal tube 844 extends between its upstream and downstream ends), so that the internal support assembly 842 supports the distributor 818 substantially directly.

As shown in FIG. 9A, the internal support assembly 842 extends between an upstream end 801 thereof and a downstream end 802 thereof. At the upstream end 801, the collar 846 positioned furthest upstream engages the upper inner tube 826. At the downstream end 802, the internal tube 844 terminates. The upstream end 801 and the downstream end 802 are located upstream and downstream respectively relative to the distributor 818. Accordingly, the support provided by the internal support assembly 842 to the body 820 is a "bridging" effect, i.e., the internal support assembly 842 spans the distributor 818 between the upstream end 801 located upstream relative to the distributor 818 and the downstream end 802, located downstream thereto. Also, and as can be seen in FIG. 9A, the o-ring glands 871, 857 are positioned outside the internal support assembly 842, i.e., outside the "bridging" portion of the lance 840. As is known, the o-rings 871, 857 are relatively weak, and because they are located outside the bridging portion, they have virtually no effect on the structural strength of the lance 840 overall.

Those skilled in the art will also appreciate that, because of the sliding engagement of the internal tube 844 at its lower and upper ends (i.e., partly via the collars 846), thermal expansion is accommodated.

The lance 840 preferably includes spacers 821 (FIG. 9B). It will be understood that, although the spacers 821 may provide support to the lance, any such support is localized (i.e., the extent of the support provided by the spacers is generally limited to the immediate vicinity thereof). In particular, it can be seen in FIGS. 9A and 9B that the support provided by the spacers 821 does not extend between a location upstream relative to the distributor 818 and a location downstream relative thereto, i.e., the spacers do not provide the bridging effect relative to the distributor.

As described above, in the prior art lances, the lower portions thereof tend to deflect downwardly at the distributor because the distributor is typically made of copper, in contrast to the tubes above and below the distributor, which are steel, and therefore generally stronger. Also, in the prior art, an o-ring gland is sometimes positioned substantially at the distributor, which also tends to cause the prior art lance to deflect at, or approximately at, the distributor. From the foregoing it can be seen, therefore, that the lance 840 provides a relatively stronger structure in which thermal expansion is accommodated and deflection of the body 820 is resisted by the internal support assembly 842.

As can be seen in FIG. 9D, in one embodiment, a downstream portion 848 of the internal tube 844 preferably engages an upstream portion 850 of the lower inner tube 834, to support the internal tube 844 in the predetermined position coaxial with the body 820 so that the internal tube 844 resists deflection of the body 820. It is also preferred that an outer wall 852 of the internal tube 844 in the downstream portion 848 thereof engages an inner wall 854 of the lower inner tube 834 in the upstream portion 850 thereof, to support the internal tube 844 in the predetermined position coaxial with the body 820 so that the internal tube 844 resists deflection of the body 820. As described above, the downstream portion 848 of the internal tube 844 and the upstream portion 850 of the lower inner tube 826 preferably are slidingly engaged with each other, so that the internal tube 844 thus supports the lower portion of the body generally, while simultaneously permitting movement of the internal tube 844 and/or the lower inner tube 826 relative to each other due to thermal expansion.

As can be seen in FIG. 9A, in one embodiment, the upper inner tube 826 preferably includes an upstream portion 828 proximal to the upstream end 812, the upstream portion 828 being substantially cylindrical and having outer and inner diameters, a downstream portion 830 proximal to the distributor 818, the downstream portion 830 having an outer diameter substantially larger than the outer diameter of the upstream portion and an inner diameter substantially larger than the inner diameter of the upstream portion, and a connecting portion 832 connecting the upstream and downstream portions 828, 830. As illustrated in FIG. 9A, the internal tube 844 has an outer diameter substantially smaller than the inner diameter of the downstream portion 830, so that an annulus 872 is defined between the internal tube 844 and the downstream portion 830. Preferably, the annulus 872 is in fluid communication with the ports 819 of the distributor 818. It will be understood that the annulus 872 permits the second part of the gas to flow from the upstream portion 828 of the upper inner tube 826 to the ports 819 of the distributor 818. It is preferred that each of the collars 846 includes one or more of the apertures 874 therein, to permit the second part of the gas to flow therethrough.

Figure 10A:
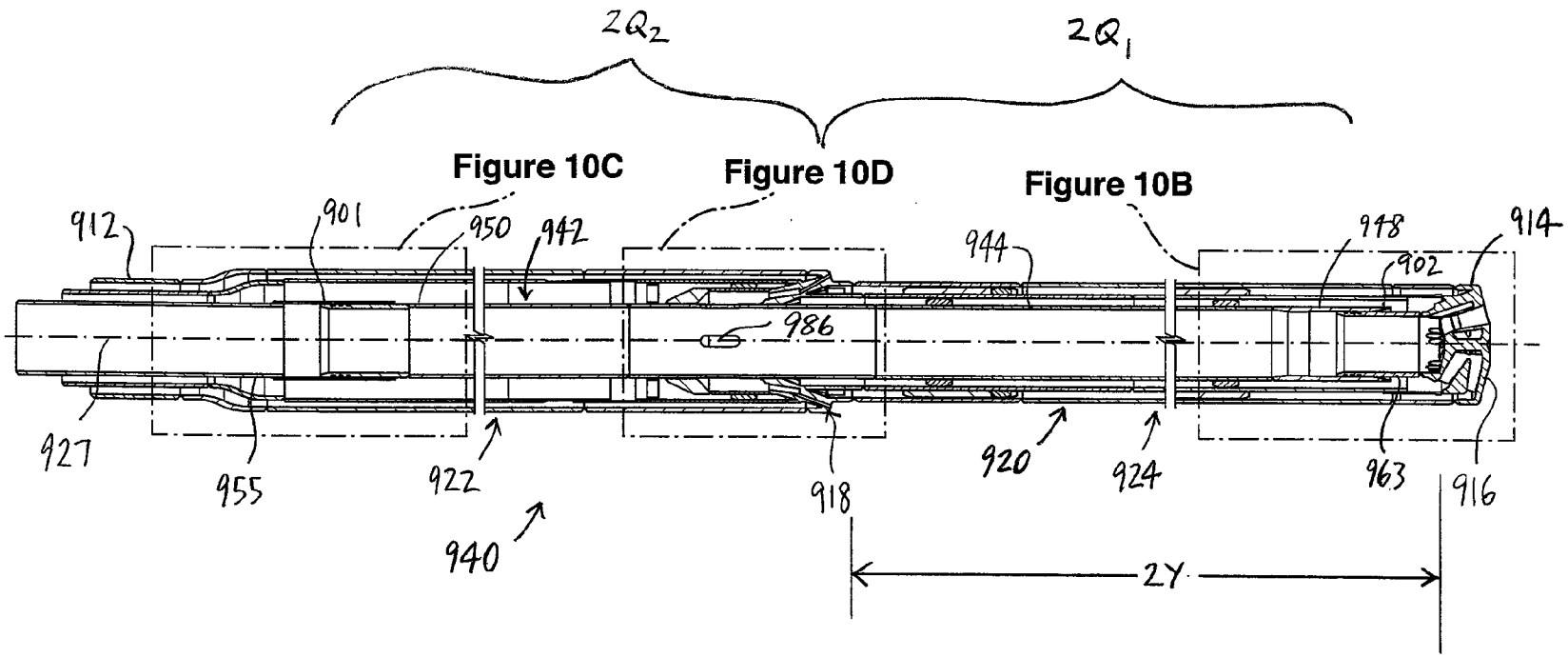
FIG. 10A is a cross-section of another embodiment of the lance of the invention, drawn at a smaller scale.

Another embodiment of a post-combustion lance 940 of the invention is illustrated in FIGS. 10A-10D. As can be seen in FIG. 10A, the lance 940 preferably includes a body 920 at least partially defined by an axis 927 thereof and extending between an upstream end 912 and a downstream end 914 of the lance 940. The upstream end 912 is adapted to receive the gas directed into the lance under pressure, and the downstream end 914 includes a primary tip 916 through which a first part of the gas exits the lance 940. The body 920 preferably includes upper and lower portions 922, 924 and a post-combustion distributor 918 mounted therebetween at a predetermined distance "2Y" from the primary tip 916. The upper and lower portions 922, 924 are located upstream and downstream respectively relative to the distributor 918. The distributor 918 preferably includes a plurality of ports 919 (FIG. 10D) through which a second part of the gas exits the lance. It is also preferred that the lance 940 includes a connecting tube 955 (FIGS. 10A, 10C) for directing the gas to the upper portion 922 and a tip tube 963 (FIGS. 10A, 10B) for directing the first part of the gas to the primary tip 914. In one embodiment, the lance 940 preferably also includes an internal support assembly 942 for supporting the body 920. Preferably, and as can be seen in FIG. 10A, the internal support assembly 942 includes an internal tube 944 extending between a downstream part 948 thereof positioned proximal to the downstream end 914 of the lance 940, and an upstream part 956 of the internal tube 944 positioned upstream relative to the ports 919 of the distributor 918 (FIG. 10A). Preferably, the upstream part 956 is engageable with the connecting tube 955 (FIG. 10C) and the downstream part 948 is engageable with the tip tube 963 (FIG. 10B) downstream relative to the distributor 918. It is also preferred that the lance 940 includes a lower o-ring gland 971 (FIG. 10B) positioned proximal to the lower portion 924, to permit movement of the internal tube 944 and the tip tube 963 relative to each other due to thermal expansion, such movement being at least partially in an axial direction substantially parallel to the axis 927. In one embodiment, the lance 940 preferably also includes an upper o-ring gland 957 (FIG. 10C) positioned proximal to the upper portion 922, to permit movement of the internal tube 944 and the connecting tube 955 relative to each other at least partially in the axial direction due to thermal expansion.

Figure 10B:
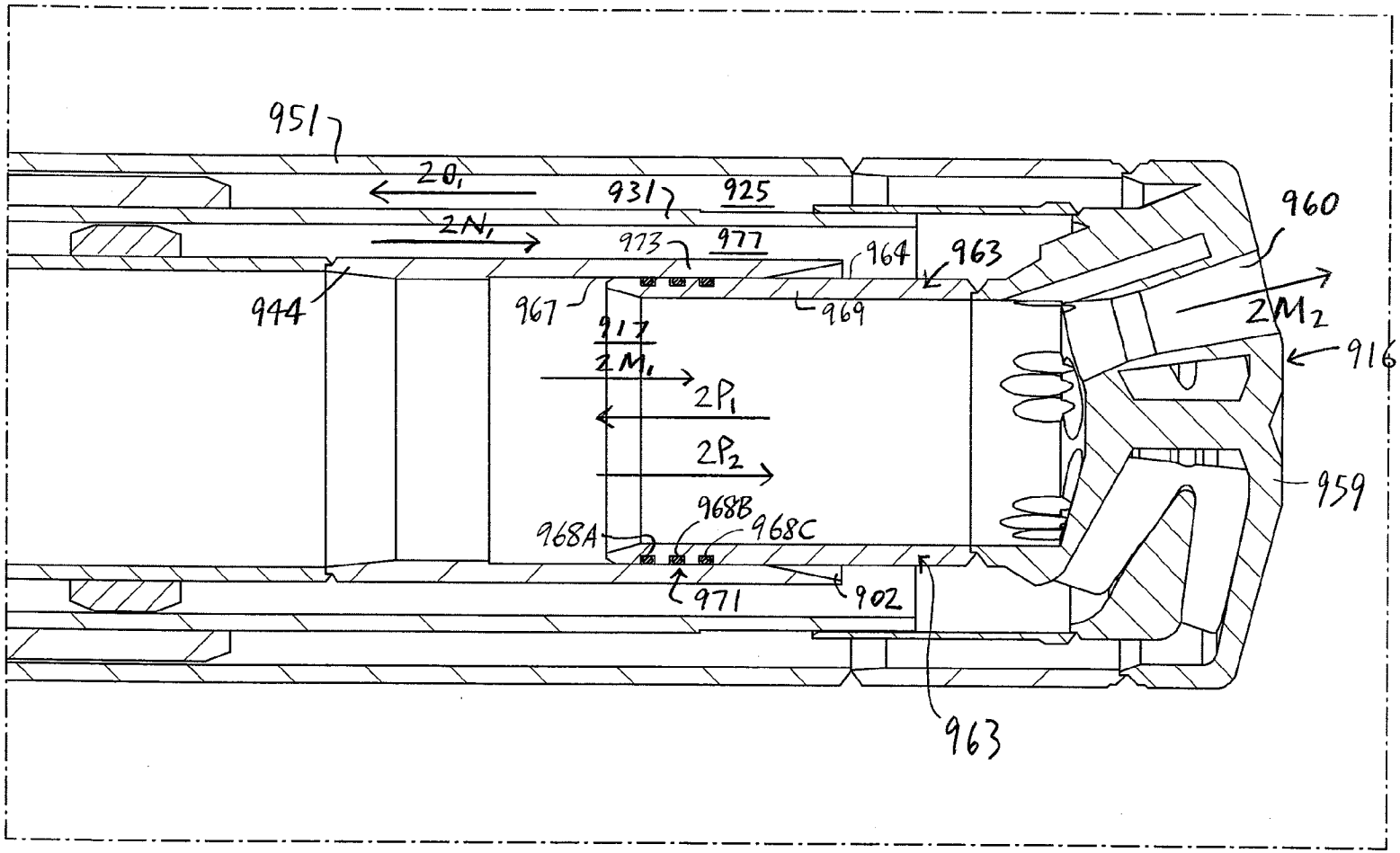
FIG. 10B is a cross-section of a portion of the lance of FIG. 10A, drawn at a larger scale.

As can be seen in FIGS. 10A-10D, the lance 940 preferably includes cavities through which water is directed, to cool the lance 940. An inner cavity 977 is located between a lower intermediate element 931, on one side thereof, and the internal tube 944 and the tip tube 963, on the other side thereof. An outer cavity 925 is located between the lower intermediate element 931 and an exterior tube 951 (FIG. 10B). In one embodiment, it is preferred that water circulate through the cavities 977, 925 to cool the lance. For instance, the water preferably flows through the inner cavity 977 in the direction indicated by arrow "$2N_1$" in FIG. 10B, and the water also flows through the outer cavity 925 in the direction indicated by arrow "$2O_1$" in FIG. 10B.

In one embodiment, the primary tip 916 preferably includes a nozzle 959 having one or more orifices 960, and a tip tube 963 for directing the first part of the gas to the nozzle 959. As can also be seen in FIG. 10B, the first part of the gas (e.g., oxygen) is directed through a central channel 917 defined by the tip tube 963 and the internal tube 944 and exits the lance 940 via the orifice 960 of the nozzle 959. The direction of movement of the first part of the oxygen is indicated in FIG. 10B by arrows "$2M_1$" and "$2M_2$".

For the reasons described above, different elements of the lance are subjected to thermal expansion at different rates. As can be seen in FIG. 10B, the tip tube 963 preferably includes an engaged part 969 thereof which is slidably engaged with an engaged part 973 of the internal tube 944. As indicated by arrows "$2P_1$" and "$2P_2$" in FIG. 10B, the engaged parts 969, 973 are positioned for sliding engagement with each other, in the axial direction (i.e., substantially in the directions indicated by arrows "$2P_1$" and "$2P_2$" in FIG. 10B) due to thermal expansion of one or the other, or both, of the tip tube 963 and the internal tube 944. In particular, an exterior surface 964 of the tip tube 963 and an interior surface 967 of the internal tube 944 preferably are positioned for sliding engagement with each other.

It is also preferred that the lower o-ring gland 971 is mounted on the exterior surface 964 of the tip tube 963. It will be understood that the o-ring gland 971 preferably includes a suitable number of o-rings. For instance, in the embodiment illustrated in FIG. 10B, the lower o-ring 971 includes three o-rings, identified as 968A-968C. Those skilled in the art will appreciate that the lower o-ring gland 971 accommodates the axial movement of the engaged parts 969, 973 due to thermal expansion, and also provides a seal between the engaged parts 969, 973, to substantially prevent the water flowing through the inner cavity 977 from entering the central channel 917.

Figure 10C:
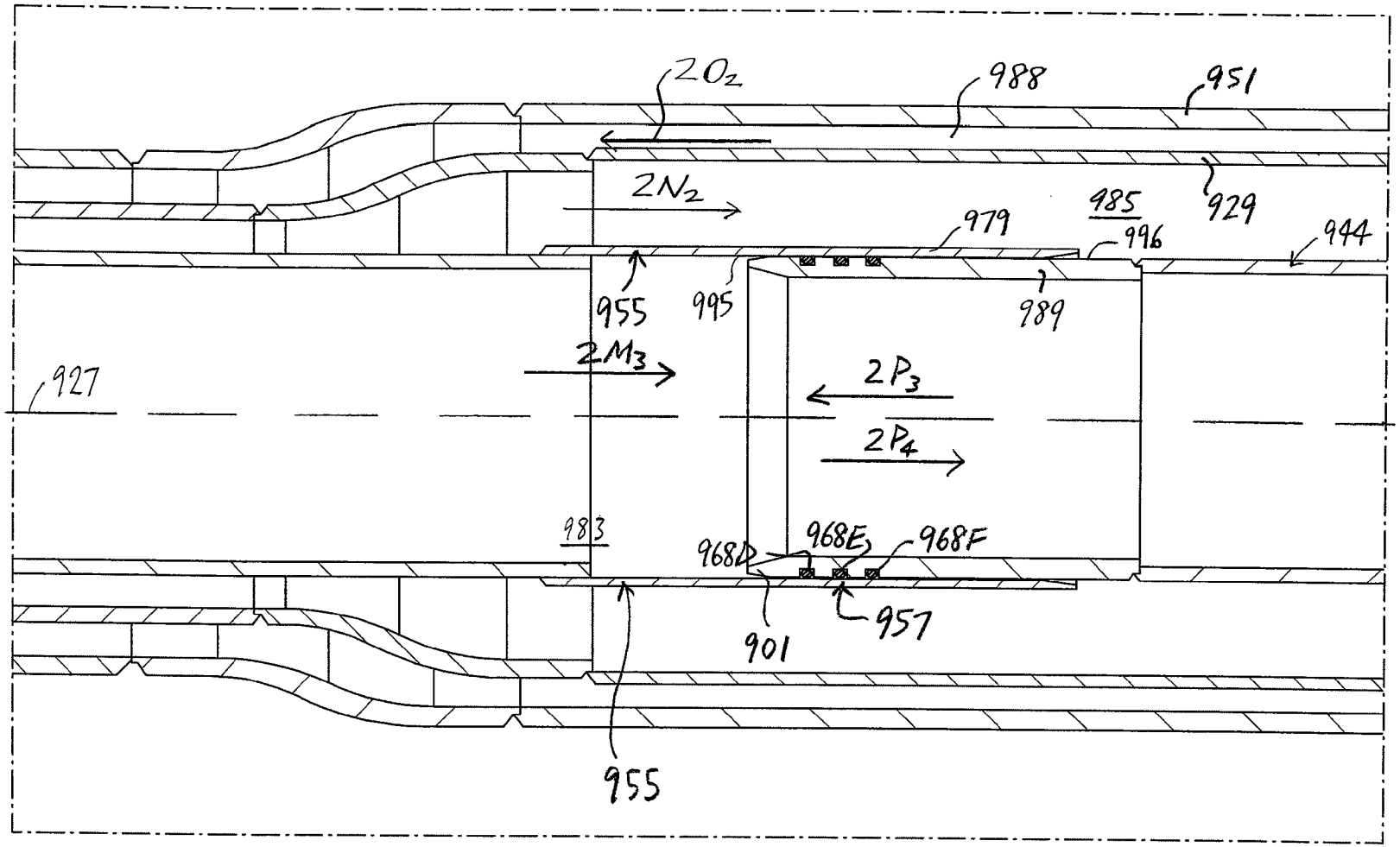
FIG. 10C is a cross-section of another portion of the lance of FIG. 10A.

The upper o-ring gland 957 is illustrated in FIG. 10C. The internal tube 944 is positioned coaxially with the axis 927 and with the connecting tube 955. As can be seen in FIG. 10C, the connecting tube 955 includes an engaged part 979 and the internal tube 944 includes an upper engaged part 989, and the engaged parts 979, 989 preferably are engageable with each other. In particular, it will be understood that the engaged parts 979, 989 are slidingly engageable with each other, i.e., substantially in the axial direction. In particular, an interior surface 995 of the connecting tube 955 and an exterior surface 996 of the internal tube 944 preferably are positioned for sliding engagement with each other. As can be seen in FIG. 10C, the oxygen flows into the lance along a central channel 983 defined by the connector tube 955 and the internal tube 944 as indicated by arrow "$2M_3$".

The body of the lance 940 preferably also includes an upper intermediate element 929. An inner cavity 985 is located between and defined by the upper intermediate element 929, on one side thereof, and the connecting tube 955 and the internal tube 944, on the other side thereof. Similarly, an outer cavity 988 is located between the upper intermediate element 929 and the exterior tube 951. It will be understood that the inner cavity 985 of the upper portion is in fluid communication with the inner cavity 977 in the lower portion, and the outer cavity 988 of the upper portion is also in fluid communication with the outer cavity 925 in the lower portion. In FIG. 10C, the directions of flow of the water directed through the cavities, to cool the lance 940, are indicated by arrows "$2N_2$" and "$2O_2$".

As can also be seen in FIG. 10C, in one embodiment, the o-ring gland 957 preferably includes three o-rings, identified in FIG. 10C as 968D-968F. (It will be understood that the o-ring gland 957 may include any suitable number of o-rings.) The engaged parts 979, 989 are movable relative to each other in the axial direction, as indicated by arrows "$2P_3$" and "$2P_4$" in FIG. 10C. For the reasons described above, one or both of the engaged parts 979, 989 may move relative to the other, due to thermal expansion. As noted above, such movement preferably is in the form of sliding engagement of the engaged parts 979, 989 with each other, i.e., one or both of the engaged parts 979, 989 slidingly engaging the other, for movement relative to one or the other (or movement of both) substantially in the axial direction. The o-ring gland 957 permits such movement, and also provides a seal to substantially prevent water in the inner cavity 977 from leaking into the central channel 983.

Figure 10D:
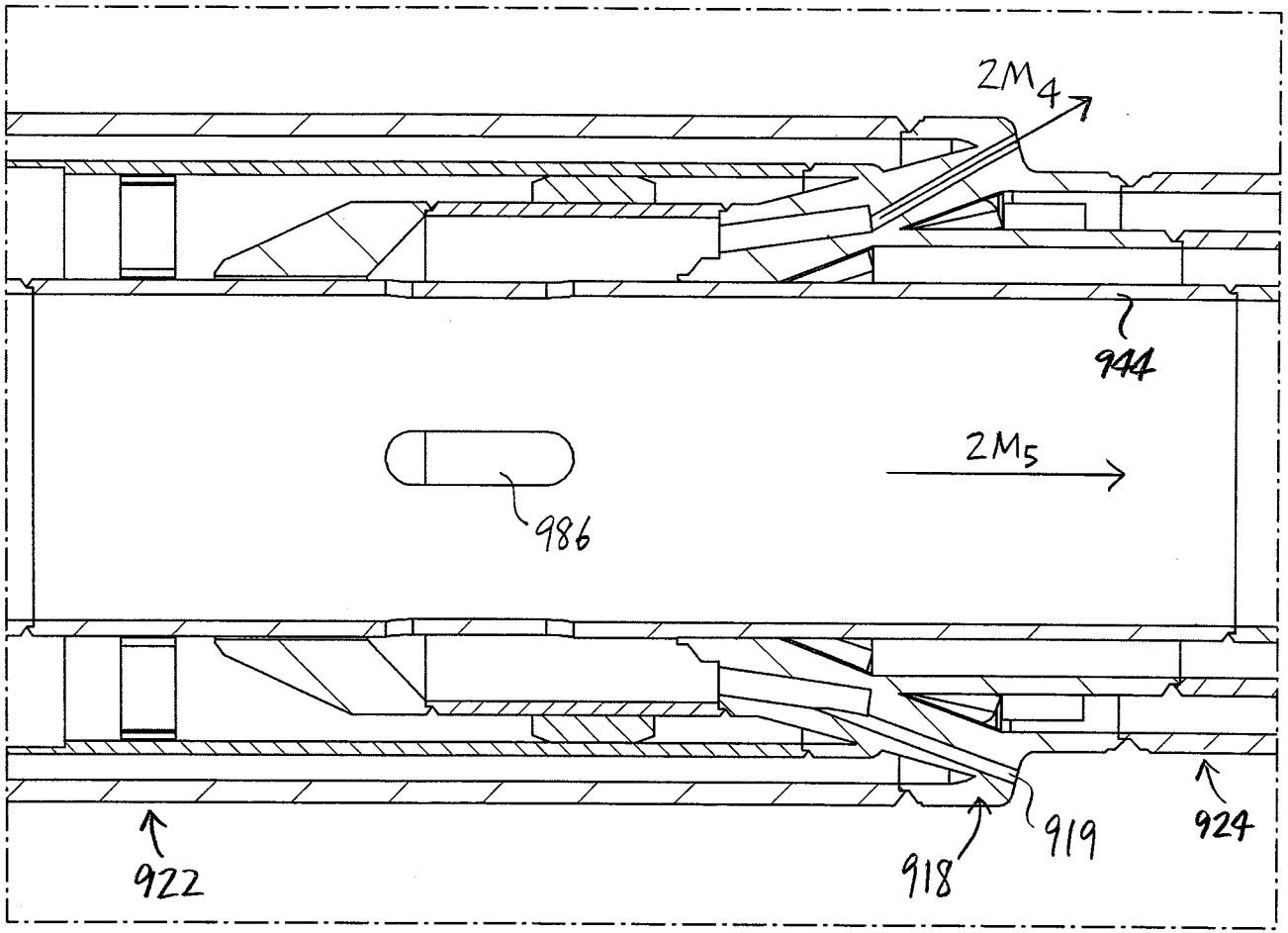
FIG. 10D is a cross-section of another portion of the lance of FIG. 10A.

As illustrated in FIG. 10D, the second part of the gas exits the lance 940 via the ports 919. The flow of the second part of the gas is schematically represented in FIG. 10D by arrow "$2M_4$". As can also be seen in FIG. 10D, the first part of the gas flows past the distributor 918 via the internal tube 944. The movement of the first part of the gas is schematically represented by arrow "$2M_5$" in FIG. 10D.

The internal support assembly 942 preferably includes the internal tube 944 and one or more collars 946 located upstream relative to the distributor 918. As can be seen in FIG. 10A-10C, the internal support assembly 942 preferably extends between an upstream end 901 (FIG. 10C) and a downstream end 902 (FIG. 10B), each of which is slidably engaged with a tube element respectively. For example, the upstream end 901 includes the engaged part 989 which, as described above, is engaged inside the engaged part 979 of the upper connecting tube 955 (FIG. 10C). As noted above, the engaged parts 979, 989 are engaged with each other, but movable in the directions indicated by arrows $2P_3$, $2P_4$ in order to accommodate thermal expansion of the connecting tube and/or the internal tube 944. The connecting tube 955 accordingly supports the internal tube 944 at its upstream end 901. Similarly, and as shown in FIG. 10B, the downstream end 902 of the internal tube 944 includes the engaged part 973, which is slidably engaged with the engaged part 969 of the tip tube 963. The tip tube 963 accordingly supports the internal tube 944 at its downstream end 902.

In one embodiment, the internal support assembly 942 preferably includes one or more collars 946 secured to the internal tube 944 and engageable with the upper intermediate element 929 (FIG. 10D). Those skilled in the art will appreciate that the collar 946 is slidably engageable with the upper intermediate element 929, to accommodate thermal expansion of, among other elements, the internal tube 944 and the upper intermediate element 929.

From the foregoing, it can be seen that the body 920 includes substantially all of the lance 940, excluding the internal support assembly 942. For instance, the body 920 preferably includes the connecting tube 955 and the lower inner tube 934, as well as the exterior tube 951, the distributor 918, the lower intermediate element 931, the tip tube 963, and the upper intermediate element 929. It will be understood that, in one embodiment, the exterior tube 951 preferably is not a continuous physical element extending between upstream and downstream ends of the lance 940, but instead is divided into two portions, i.e., one located upstream relative to the distributor 918, and the other located downstream relative thereto.

From the foregoing, it can be seen that, in the lance 940, the lower and upper o-ring glands 971, 957 are positioned at the lower and upper ends of the lance, i.e., the o-ring glands 971, 957 are positioned at predetermined distances $2Q_1$, $2Q_2$ (FIG. 10A) apart from the distributor 918. Also, and as can be seen in FIG. 10D, the lance 940 does not include an o-ring gland positioned at, or proximal to, the distributor 918. The o-ring glands 971, 957 are positioned generally proximal to the lower and upper ends of the lance respectively, and as shown in FIG. 10D, the lance 940 does not include an o-ring gland proximal to the distributor. As a result, the lance 940 is less prone to bending at the distributor 918 than the prior art lances, in which an o-ring gland typically is located proximal to the distributor.

In effect, the body 920 is supported above and below the distributor 918 by the internal support assembly 942. The internal tube 944 is a single, unitary element extending between the upstream and downstream ends 901, 902 of the internal support assembly 942. Also, and as can be seen in FIGS. 10A and 10D, the internal tube 944 also is partly located proximal to the distributor 918, so that the internal support assembly 942 supports the distributor 918 substantially directly.

The upstream end 901 and the downstream end 902 are located upstream and downstream respectively relative to the distributor 918. Accordingly, the support provided by the internal support assembly 942 to the body 920 is a "bridging" effect, i.e., the internal support assembly 942 spans the distributor 918 between the upstream end 901 located upstream relative to the distributor 918 and the downstream end 902, located downstream thereto. Also, and as can be seen in FIG. 10A, the o-ring glands 971, 957 are positioned outside the internal support assembly 942, i.e., outside the "bridging" portion of the lance 940. As is known, the o-rings 971, 957 are relatively weak. Because they are located at the ends of the internal support assembly 942, they have virtually no effect on the structural strength of the lance 940 overall.

Those skilled in the art will also appreciate that, because of the sliding engagement of the internal tube 944 at its lower and upper ends, thermal expansion is accommodated.

In one embodiment, the post-combustion lance 940 preferably also includes one or more spacers 921 secured to the internal tube 944 and positioned between the upper intermediate element 929 and the internal tube, to support the internal tube in a predetermined position substantially coaxial with the upper portion 922 so that the internal tube 944 resists deflection of the body 920. As described above, although the spacers provide only localized support to internal lance elements, the spacers help to align the elements of the lance properly as they are assembled. In particular, the spacers are not sufficiently extensive to provide the bridging effect provided by the internal support assembly 942, as described above.

As can be seen in FIGS. 10A and 10D, the internal tube 944 additionally includes one or more openings 986 positioned at least partially upstream relative to the ports 919 of the distributor, to permit the second part of the gas to flow to the distributor.

Figure 11A:
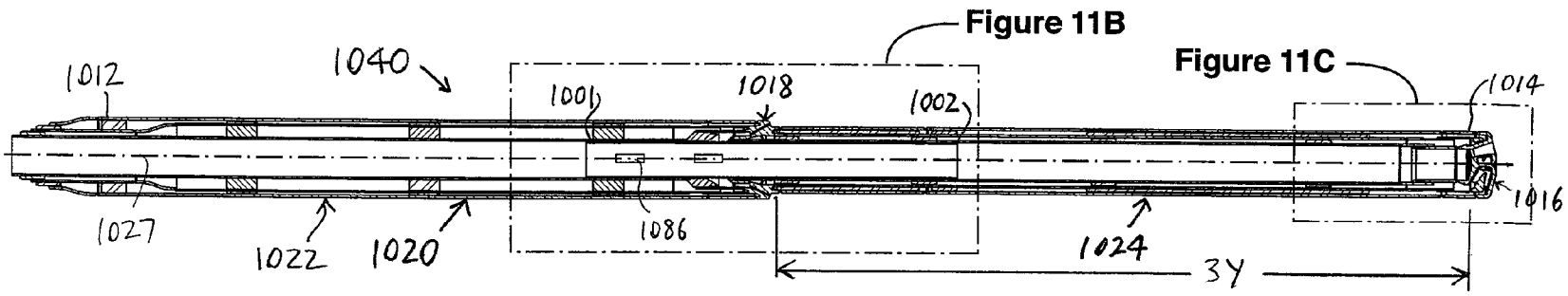
FIG. 11A is a cross-section of another embodiment of the lance of the invention, drawn at a smaller scale.
Figure 11B:
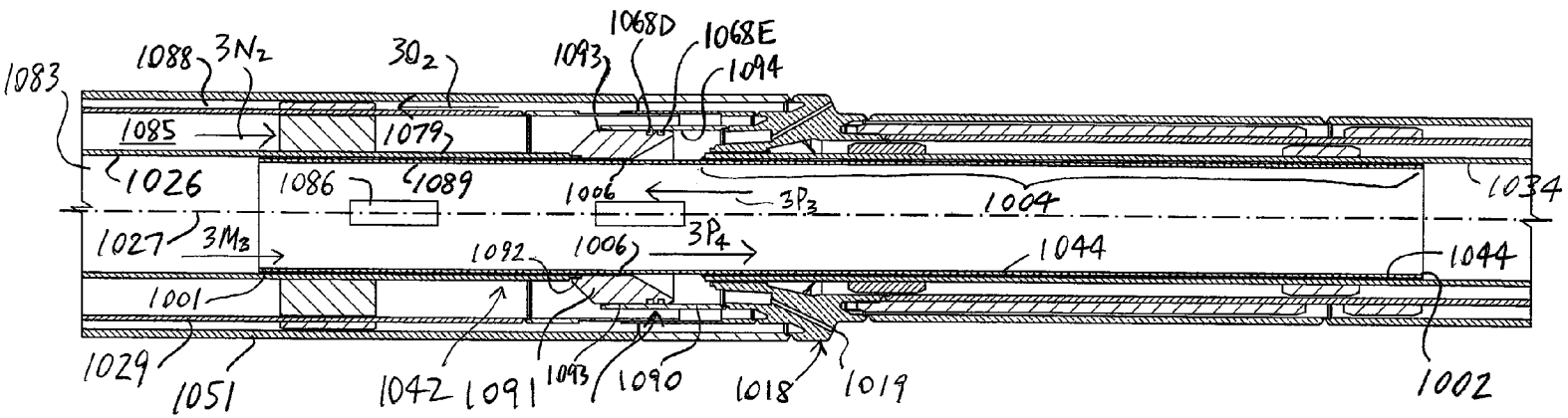
FIG. 11B is a cross-section of a portion of the lance of FIG. 11A, drawn at a larger scale.
Figure 11C:
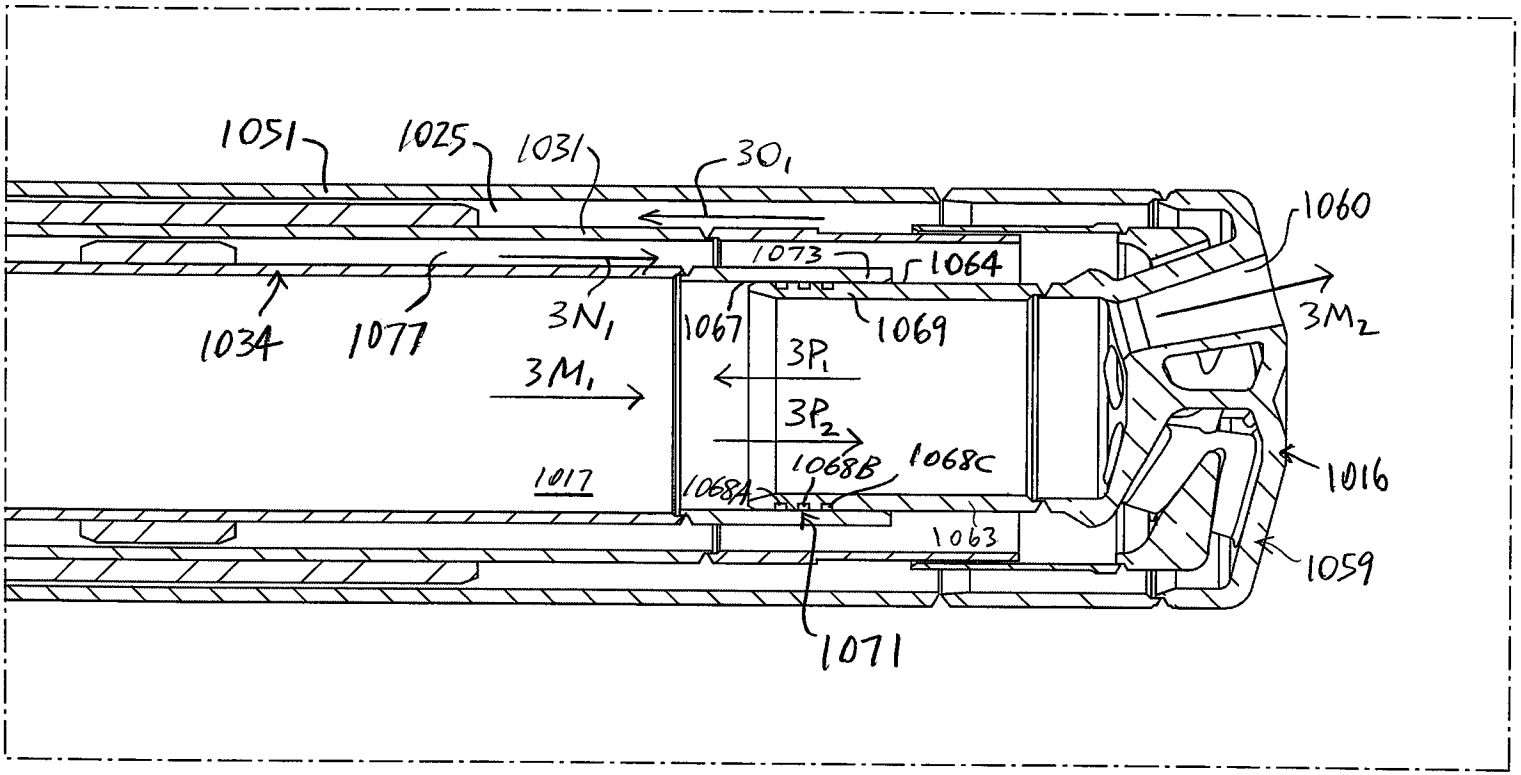
FIG. 11C is a cross-section of another portion of the lance of FIG. 11A.

An alternative embodiment of the post-combustion lance 1040 of the invention is illustrated in FIGS. 11A-11C. The post-combustion lance 1040 is for directing the gas at least partially therethrough, and includes a body 1020 at least partially defined by an axis 1027 thereof and extending between an upstream end 1012 and a downstream end 1014 of the lance 1040. Preferably, the upstream end 1012 is adapted to receive the gas, and the downstream end includes a primary tip 1016 through which a first part of the gas exits the lance 1040. It is also preferred that the body 1020 includes upper and lower portions 1022, 1024 and a post-combustion distributor 1018 mounted therebetween at a predetermined distance "3Y" from the primary tip 1016. The upper and lower portions 1022, 1024 are located upstream and downstream respectively relative to the distributor 1018. The distributor 1018 includes a number of ports 1019 (FIG. 11B) through which a second part of the gas exits the lance 1040. In one embodiment, the distributor 1018 additionally includes a distributor tube 1090 extending upstream relative to the ports 1019 (FIG. 11B), and an upper inner tube 1026 positioned at least partially upstream from the distributor. The lance 1040 also includes an adaptor 1091 secured to the upper inner tube 1026 and engageable with the distributor tube 1090, and a lower inner tube 1034 positioned at least partially downstream from the distributor (FIG. 11B). It is also preferred that the lance 1040 includes an internal support assembly 1042 for supporting the body 1020. Preferably, the internal support assembly 1042 includes an internal tube 1044 positioned inside the body 1020 and engaged with the lower inner tube 1034 at least partially downstream relative to the distributor 1018, and also engaged with the upper inner tube 1026 at least partially upstream relative to the distributor 1018. As will be described, the lance 1040 preferably also includes a lower o-ring gland 1071 positioned proximal to the lower portion 1024, to permit movement of the lower inner tube 1034 and the primary tip 1016 relative to each other due to thermal expansion at least partially in an axial direction substantially parallel to the axis. It is also preferred that the lance includes an upper o-ring gland 1057 positioned on the adaptor 1091 for engagement with the distributor tube 1090, to permit movement of the upper inner tube 1026 and the distributor tube 1090 relative to each other due to thermal expansion at least partially in the axial direction. As illustrated in FIG. 11A, the upper inner tube 1026 is at least partially positioned in the upper portion 1022, and the lower inner tube 1034 is at least partially positioned in the lower portion 1024.

As can be seen in FIGS. 11A-11C, the lance 1040 preferably includes cavities through which water is directed, to cool the lance 1040. An inner cavity 1077 is located between, on one side thereof, a lower intermediate element 1031, and on the other side thereof, the lower inner tube 1034 and the tip tube 1063. An outer cavity 1025 is located between the lower intermediate element 1031 and an exterior tube 1051 (FIG. 11C). In one embodiment, it is preferred that water circulates through the cavities 1077, 1025 to cool the lance. For instance, the water preferably flows through the inner cavity 1077 in the direction indicated by arrow "$3N_1$" in FIG. 11C, and the water also flows through the outer cavity 1025 in the direction indicated by arrow "$3O_1$" in FIG. 11C.

Preferably, the primary tip 1016 includes a nozzle 1059, and a tip tube 1063 for directing the first part of the gas to the nozzle 1059. As can also be seen in FIG. 11C, the first part of the gas (e.g., oxygen) is directed through a central channel 1017 defined by the tip tube 1063 and the internal tube 1044 and exits the lance 1040 via an orifice 1060 of the nozzle 1059. The direction of movement of the first part of the oxygen is indicated in FIG. 11C by arrows "$3M_1$" and "$3M_2$".

For the reasons described above, different elements of the lance are subjected to thermal expansion at different rates. As can be seen in FIG. 11C, the tip tube 1063 preferably includes an engaged part 1069 thereof which is slidably engaged with an engaged part 1073 of the lower inner tube 1034. As indicated by arrows "$3P_1$" and "$3P_2$" in FIG. 11C, the engaged parts 1069, 1073 are formed and positioned for sliding engagement with each other, in the axial direction (i.e., substantially in the directions indicated by arrows "$3P_1$" and "$3P_2$" in FIG. 11C) due to thermal expansion of one or the other, or both, of the tip tube 1063 and the lower inner tube 1034. An exterior surface 1064 of the tip tube 1063 and an interior surface 1067 of the lower inner tube 1034 preferably are positioned for sliding engagement with each other.

It is also preferred that the lower o-ring gland 1071 is mounted on the exterior surface 1064 of the tip tube 1063. It will be understood that the o-ring gland 1071 preferably includes a suitable number of o-rings. For instance, in the embodiment illustrated in FIG. 11C, the lower o-ring 1071 includes three o-rings, identified for convenience as 1068A-1068C. Those skilled in the art will appreciate that the lower o-ring gland 1071 accommodates the axial movement of the engaged parts 1069, 1073 due to thermal expansion, and also provides a seal between the engaged parts 1069, 1073, to substantially prevent the water flowing through the inner cavity 1077 from entering the central channel 1017.

The upper o-ring gland 1057 is illustrated in FIG. 11B. The internal tube 1044 is positioned coaxially with the axis 1027 and with the upper inner tube 1026. As can be seen in FIG. 11B, the upper inner tube 1026 includes an engaged part 1079, and the internal tube 1044 includes an upper engaged part 1089. The engaged parts 1079, 1089 preferably are formed and positioned to be engageable with each other. In particular, it will be understood that the engaged parts 1079, 1089 are slidingly engageable with each other, i.e., they are movable, while slidingly engaged with each other, substantially in the axial direction. As can be seen in FIG. 11B, the oxygen flows into the lance along a central channel 1083 defined by the upper inner tube 1026 and the internal tube 1044 as indicated by arrow "$3M_3$".

The body 1020 of the lance 1040 preferably also includes an upper intermediate element 1029. An inner cavity 1085 is located between and substantially defined by the upper intermediate element 1029, on one side thereof, and the upper inner tube 1026 and the distributor tube 1090, on the other side thereof. Similarly, an outer cavity 1088 is located between the upper intermediate element 1029 and the exterior tube 1051. It will be understood that the inner cavity 1085 of the upper portion is in fluid communication with the inner cavity 1077 in the lower portion, and the outer cavity 1088 of the upper portion is also in fluid communication with the outer cavity 1025 in the lower portion. In FIG. 11B, the directions of flow of the water directed through the cavities, to cool the lance 1040, are indicated by arrows "$3N_2$" and "$3O_2$".

As can also be seen in FIG. 11B, the adaptor 1091 preferably is secured to the upper inner tube 1026 at a location 1092 proximal to the adaptor's inner side 1006. Also, the adaptor's inner side 1006 preferably is adapted for sliding engagement with the internal tube 1044. The adaptor's outer side 1093 preferably is formed and positioned for sliding engagement with an interior surface 1094 of the distributor tube 1090. It is also preferred that the upper o-ring gland 1057 is mounted on the outer side 1093 of the adaptor 1091, so that the o-ring gland 1057 sealingly engages the interior surface 1094 of the distributor tube 1090.

In one embodiment, the o-ring gland 1057 preferably includes two o-rings, identified in FIG. 11B as 1068D and 1068E. (It will be understood that the o-ring gland 1057 may include any suitable number of o-rings.) The engaged parts 1079, 1089 are movable relative to each other in the axial direction, as indicated by arrows "$3P_3$" and "$3P_4$" in FIG. 11B. However, it will also be understood that the distributor tube 1090 and the adaptor 1091 are also movable relative to each other (i.e., individually, or both of them simultaneously) due to thermal expansion. Movement of the adaptor 1091 and the distributor tube 1090, or of each of them relative to the other, is substantially in the axial direction, i.e., in the directions indicated by arrows "$3P_3$" and "$3P_4$" in FIG. 11B.

For the reasons described above, one or both of the engaged parts 1079, 1089 may move relative to the other, due to thermal expansion. As noted above, such movement preferably is in the form of sliding engagement of the engaged parts 1079, 1089 with each other, i.e., one or both of the engaged parts 1079, 1089 are movable due to thermal expansion. Also as described above, because the distributor tube 1090 and the adaptor 1091 are movable relative to each other substantially in the axial direction, such movement being due to thermal expansion, the interior surface 1094 of the distributor tube 1090 and the outer side 1093 of the adaptor 1091 slidingly engage each other when such movement takes place. The o-ring gland 1057 permits such movement, and also provides a seal to substantially prevent water in the inner cavity 1077 from leaking into the central channel 1083.

As can be seen in FIGS. 11A and 11B, the internal tube 1044 extends between upstream and downstream ends 1001, 1002 thereof that are respectively located upstream and downstream relative to the distributor 1018. Proximal to the upstream end 1001, the engaged part 1089 of the internal tube 1044 is slidably engaged with the engaged part 1079 of the upper inner tube 1026, as described above. Also, along a length 1004 of the internal tube 1044, the internal tube 1044 is slidably engaged with the lower inner tube 1034. Accordingly, the internal tube 1044 is movable relative to the upper and lower inner tubes 1026, 1034 (i.e., such relative movement taking place due to thermal expansion), in the directions indicated by arrows $3P_3$ and $3P_4$ in FIG. 11B. The adaptor's inner side 1006 preferably is also slidingly engaged with the internal tube 1044.

From the foregoing, it can be seen that the body 1020 includes substantially all of the lance 1040, excluding the internal support assembly 1042. For instance, the body 1020 preferably includes the upper inner tube 1026 and the lower inner tube 1034, as well as the exterior tube 1051, the distributor 1018, the lower intermediate element 1031, the tip tube 1063, and the upper intermediate element 1029. It will be understood that, in one embodiment, the exterior tube 1051 preferably is not a continuous physical element extending between upstream and downstream ends of the lance 1040, but instead is divided into two portions, i.e., one located upstream relative to the distributor 1018, and the other located downstream relative thereto.

In effect, the body 1020 is supported above and below the distributor 1018 by the internal support assembly 1042. Also, and as can be seen in FIGS. 11A and 11B, the internal tube 1044 also is partly located proximal to the distributor 1018, so that the internal support assembly 1042 supports the distributor 1018 substantially directly.

The upstream end 1001 and the downstream end 1002 are located upstream and downstream respectively relative to the distributor 1018. Accordingly, the support provided by the internal support assembly 1042 to the body 1020 is a "bridging" effect, i.e., the internal support assembly 1042 spans the distributor 1018 between the upstream end 1001 located upstream relative to the distributor 1018 and the downstream end 1002, located downstream thereto. Also, and as can be seen in FIG. 11A, the o-ring gland 1071 is positioned outside the internal support assembly 1042, i.e., outside the "bridging" portion of the lance 1040.

As noted above, the o-ring gland 1057 preferably is positioned on the adaptor 1091, i.e., the o-ring gland 1057 is located proximal to the distributor 1018, i.e., the o-ring gland 1057 is located between the upstream and downstream ends 1001, 1002 of the internal support assembly 1042. However, it is believed that, due to the support provided by the internal support assembly 1042 between the upstream and downstream ends 1001, 1002 thereof, the o-ring gland 1057 does not materially adversely affect the structural strength of the lance 1040 overall.

The lance 1040 preferably includes spacers 1021 (FIG. 11B). It will be understood that, although the spacers 1021 may provide support to the lance, any such support is localized (i.e., the extent of the support provided by the spacers is generally limited to the immediate vicinity thereof). In particular, it can be seen in FIGS. 11A and 11B that the support provided by the spacers 1021 does not extend between a location upstream relative to the distributor 1018 and a location downstream relative thereto, i.e., the spacers do not provide the bridging effect relative to the distributor.

As can be seen in FIG. 11A, the internal tube 1044 preferably includes one or more apertures 1086 for permitting the second part of the gas to flow to the ports 1019 of the distributor 1018.

In one embodiment, the internal tube 1044 preferably is slidingly engaged with the lower inner tube 1034. It is also preferred that the internal tube 1044 is slidingly engaged with the upper inner tube 1026. Preferably, and as described, the adaptor 1091 is slidingly engaged with the distributor tube 1090. Such sliding engagement is to accommodate relative movement of these components (i.e., relative to each other, respectively) due to thermal expansion.

Accordingly, the internal tube 1044 supports the body 1020, creating a "bridging" effect in which the internal support assembly 1042 supports the body 1020 at locations that are both upstream and downstream relative to the distributor 1018. Also, in the lance 1040, the lower o-ring gland 1071 is positioned at the lower end of the lance, but the upper o-ring gland 1071 is positioned proximal to the distributor 1018. However, the distributor tube, supported by the internal tube 1044 (via the adaptor 1091) and the upper inner tube, resists deflection of the body 1020 in the vicinity of the distributor. As a result, the lance 1040 is less prone to bending at the distributor 1018 than the prior art lance.

It will be appreciated by those skilled in the art that the invention can take many forms, and that such forms are within the scope of the invention as described above. The foregoing descriptions are exemplary, and their scope should not be limited to the preferred versions provided therein.

We claim:

1. A post-combustion lance for directing a gas at least partially therethrough, the post-combustion lance comprising:

a body at least partially defined by an axis thereof and extending between an upstream end and a downstream end of the lance, the upstream end being adapted to receive the gas, and the downstream end comprising a primary tip through which a first part of the gas exits the lance;

the body comprising:

upper and lower portions;

a post-combustion distributor mounted between the upper and lower portions at a predetermined distance from the primary tip, the distributor comprising a plurality of ports through which a second part of the gas exits the lance, the upper and lower portions being located upstream and downstream respectively relative to the distributor;

an upper inner tube positioned at least partially upstream from the distributor;

a lower inner tube positioned at least partially downstream from the distributor;

a connecting tube for directing the gas to the upper portion;

an internal support assembly for supporting the body, the internal support assembly comprising:

an internal tube positioned inside the body and engaged with at least a part of the lower inner tube;

at least one collar positioned between the internal tube and the upper portion, such that the internal support assembly supports the body upstream and downstream relative to the distributor;

a lower o-ring gland positioned proximal to the lower portion, to permit movement of the internal tube and the primary tip relative to each other due to thermal expansion at least partially in an axial direction substantially parallel to the axis;

an upper o-ring gland positioned proximal to the upper portion, to permit movement of the upper inner tube and the connecting tube relative to each other due to thermal expansion at least partially in the axial direction;

the upper inner tube comprising:

an upstream portion proximal to the upstream end, the upstream portion being substantially cylindrical and having outer and inner diameters;

a downstream portion proximal to the distributor, the downstream portion having an outer diameter larger than the outer diameter of the upstream portion and an inner diameter larger than the inner diameter of the upstream portion;

a connecting portion connecting the upstream and downstream portions;

the internal tube comprising an outer diameter smaller than the inner diameter of the downstream portion of the upper inner tube such that an annulus is defined between the internal tube and the downstream portion of the upper inner tube;

the annulus being in fluid communication with said ports; and said at least one collar comprising at least one aperture therein to permit said second part of the gas to flow therethrough.

* * * * *